US011635701B2

(12) United States Patent
Yokokawa et al.

(10) Patent No.: US 11,635,701 B2
(45) Date of Patent: Apr. 25, 2023

(54) PLANOGRAPHIC PRINTING PLATE PRECURSOR, METHOD OF PREPARING PLANOGRAPHIC PRINTING PLATE, AND PLANOGRAPHIC PRINTING METHOD

(71) Applicant: FUJIFILM Corporation, Tokyo (JP)

(72) Inventors: Natsumi Yokokawa, Shizuoka (JP); Kazuaki Enomoto, Shizuoka (JP); Akira Sakaguchi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 17/386,024

(22) Filed: Jul. 27, 2021

(65) Prior Publication Data

US 2021/0356879 A1 Nov. 18, 2021

Related U.S. Application Data

(63) Continuation of application No. PCT/JP2019/051255, filed on Dec. 26, 2019.

(30) Foreign Application Priority Data

Jan. 31, 2019 (JP) ..... JP2019-016538

(51) Int. Cl.
*B41N 1/12* (2006.01)
*B41M 1/06* (2006.01)
*G03G 13/28* (2006.01)

(52) U.S. Cl.
CPC ..... *G03G 13/28* (2013.01); *B41M 1/06* (2013.01); *B41N 1/12* (2013.01)

(58) Field of Classification Search
None
See application file for complete search history.

(56) References Cited

U.S. PATENT DOCUMENTS

2005/0153239 A1 7/2005 Hoshi et al.
2009/0183647 A1 7/2009 Jarek
(Continued)

FOREIGN PATENT DOCUMENTS

CN 104684735 A 6/2015
EP 1 552 923 A2 7/2005
(Continued)

OTHER PUBLICATIONS

International Search Report dated Mar. 24, 2020 in International Application No. PCT/JP2019/051255.
(Continued)

*Primary Examiner* — Joshua D Zimmerman
(74) *Attorney, Agent, or Firm* — Sughrue Mion, PLLC

(57) ABSTRACT

Provided are a planographic printing plate precursor including a support, and an image recording layer on the support, in which the image recording layer contains an infrared absorbing agent, a polymerization initiator, and a core-shell particle, a core portion of the core-shell particle contains a resin A containing a functional group A, and a shell portion of the core-shell particle contains a resin B containing a functional group B that is bondable to or interactable with the functional group A and a dispersion group; a method of preparing a planographic printing plate using the planographic printing plate precursor; and a planographic printing method carried out using the planographic printing plate precursor.

16 Claims, 9 Drawing Sheets

(56) References Cited

U.S. PATENT DOCUMENTS

| | | | | |
|---|---|---|---|---|
| 2010/0316850 | A1 | 12/2010 | Tao et al. | |
| 2015/0198878 | A1 | 7/2015 | Takanashi | |
| 2018/0361774 | A1* | 12/2018 | Aizu | B41M 1/00 |
| 2019/0329545 | A1 | 10/2019 | Shibamoto et al. | |
| 2020/0041899 | A1 | 2/2020 | Ishiji et al. | |
| 2020/0094542 | A1 | 3/2020 | Hirano et al. | |

FOREIGN PATENT DOCUMENTS

| | | | | |
|---|---|---|---|---|
| EP | 2 440 977 | A1 | | 4/2012 |
| JP | 2005-271576 | A | | 10/2005 |
| JP | 2007-62051 | A | | 3/2007 |
| JP | 2012-071590 | A | | 4/2012 |
| JP | 2012071590 | A | * | 4/2012 |
| JP | 2012-529669 | A | | 11/2012 |
| WO | 2010/144119 | A1 | | 12/2010 |
| WO | 2017/150039 | A1 | | 9/2017 |
| WO | 2018/092661 | A1 | | 5/2018 |
| WO | 2018/221133 | A1 | | 12/2018 |
| WO | 2019/013268 | A1 | | 1/2019 |

OTHER PUBLICATIONS

Written Opinion of the International Searching Authority dated Mar. 24, 2020 in International Application No. PCT/JP2019/051255.

International Preliminary Report on Patentability dated Jul. 27, 2021 in International Application No. PCT/JP2019/051255.

Communication dated Aug. 1, 2022 from the Chinese Patent Office in Chinese Application No. 201980090975.9.

Extended European Search Report dated Apr. 25, 2022, issued in European Application No. 19913396.8.

Communication dated Apr. 26, 2022, issued in Japanese Application No. 2020-569457.

* cited by examiner

PLANOGRAPHIC PRINTING PLATE PRECURSOR, METHOD OF PREPARING PLANOGRAPHIC PRINTING PLATE, AND PLANOGRAPHIC PRINTING METHOD

CROSS-REFERENCE TO RELATED APPLICATION

This application is a continuation application of International Application No. PCT/JP2019/051255, filed Dec. 26, 2019, the disclosure of which is incorporated herein by reference in its entirety. Further, this application claims priority from Japanese Patent Application No. 2019-016538, filed Jan. 31, 2019, the disclosure of which is incorporated herein by reference in its entirety.

BACKGROUND OF THE INVENTION

1. Field of the Invention

The present disclosure relates to a planographic printing plate precursor, a method of preparing a planographic printing plate, and a planographic printing method.

2. Description of the Related Art

A planographic printing plate is typically formed of a lipophilic image area that receives ink in the process of printing and a hydrophilic non-image area that receives dampening water. Planographic printing is a method of performing printing by utilizing the property that water and oil-based ink repel each other to generate a difference in adhesiveness of ink onto a surface of a planographic printing plate using a lipophilic image area of the planographic printing plate as an ink receiving unit and a hydrophilic non-image area as a dampening water receiving unit (ink non-receiving unit), allowing the ink to land only on an image area, and transferring the ink to a printing material such as paper.

In the related art, a planographic printing plate precursor (PS plate) obtained by providing a lipophilic photosensitive resin layer (image recording layer) on a hydrophilic support has been widely used in order to prepare such a planographic printing plate. A planographic printing plate is typically obtained by performing plate-making according to a method of exposing a planographic printing plate precursor through an original picture such as a lith film, allowing a part which is an image area of an image recording layer to remain, dissolving the other unnecessary part of the image recording layer in an alkaline developer or an organic solvent so that the part is removed, and exposing a surface of a hydrophilic support to form a non-image area.

Further, environmental problems related to a waste liquid associated with wet treatments such as a development treatment have been highlighted due to the growing interest in the global environment.

In order to deal with the above-described environmental problem, it is desired to simplify the process of development or plate-making or not to perform any treatment. As one of simple preparation methods, a method referred to as "on-press development" has been performed. That is, the on-press development is a method of exposing a planographic printing plate precursor, mounting the planographic printing plate precursor on a printing press without performing development of the related art, and removing an unnecessary part of an image recording layer, at an initial stage of a typical printing step.

In the present disclosure, a planographic printing plate precursor that can be used for such on-press development is referred to as an "on-press development type planographic printing plate precursor".

Examples of the printing method using a planographic printing plate precursor or a planographic printing plate precursor of the related art include those described in JP2012-71590A and JP2012-529669A.

JP2012-71590A describes a planographic printing plate precursor including an image recording layer on a support, which contains (A) radically polymerizable compound, (B) infrared absorbing dye, (C) radical generator, and (D) resin fine particle having a core-shell structure in which the core portion has a lipophilic resin and the shell portion has a resin having a structural unit represented by Formula (I) and can be removed by at least any one of ink or dampening water.

Formula (I)

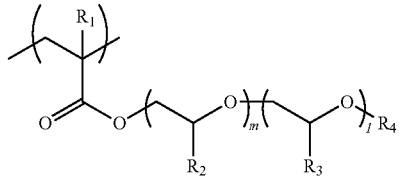

In Formula (I), $R_1$, $R_2$, $R_3$, and $R_4$ each independently represent a hydrogen atom or a methyl group, and m and l represent 0 or a positive integer that satisfies an expression of "$1 \leq m+1 \leq 200$".

JP2012-529669A describes an image-forming element for a negative type operation, including a base material which has an image-forming layer containing: a free radically polymerizable component, an initiator composition which is capable of generating radicals sufficient enough to initiate polymerization of a free radically polymerizable component upon exposure to radiation for image formation, a radiation absorbing compound, one or more polymer binders, and at least 5% by mass of core-shell particle having a core of a hydrophobic polymer and a shell of a hydrophilic polymer that forms a covalent bond with the core of the polymer and contains one or more amphoteric ionic functional groups.

SUMMARY OF THE INVENTION

An object to be achieved by an aspect of the present disclosure is to provide a planographic printing plate precursor from which a planographic printing plate with excellent printing durability is obtained even in a case where UV ink is used.

An object to be achieved by another aspect of the present disclosure is to provide a method of preparing a planographic printing plate using the planographic printing plate precursor and a planographic printing method.

The means for achieving the above-described object includes the following aspects.

<1> A planographic printing plate precursor comprising: a support; and an image recording layer on the support, in which the image recording layer contains an infrared absorbing agent, a polymerization initiator, and a core-shell particle, a core portion of the core-shell particle contains a resin A containing a functional group A, and a shell portion of the core-shell particle contains a resin B containing a functional group B that is bondable to or interactable with the functional group A and a dispersion group.

<2> The planographic printing plate precursor according to <1>, in which the dispersion group contains a group represented by Formula 1,

*-Q-W—Y Formula 1 in Formula 1, Q represents a divalent linking group, W represents a divalent group having a hydrophilic structure or a divalent group having a hydrophobic structure, Y represents a monovalent group having a hydrophilic structure, any one of W or Y has a hydrophilic structure, and * represents a bonding site with respect to another structure.

<3> The planographic printing plate precursor according to <1> or <2>, in which the polymerization initiator includes an electron-accepting polymerization initiator.

<4> The planographic printing plate precursor according to <3>, in which a difference between LUMO of the electron-accepting polymerization initiator and LUMO of the infrared absorbing agent is 0.70 eV or less.

<5> The planographic printing plate precursor according to any one of <1> to <4>, in which the polymerization initiator includes an electron-donating polymerization initiator.

<6> The planographic printing plate precursor according to <5>, in which a difference between HOMO of the infrared absorbing agent and HOMO of the electron-donating polymerization initiator is 0.70 eV or less.

<7> The planographic printing plate precursor according to any one of <1> to <6>, in which the image recording layer further contains a polymerizable compound.

<8> The planographic printing plate precursor according to any one of <1> to <7>, in which the image recording layer further contains an acid color former.

<9> The planographic printing plate precursor according to any one of <1> to <8>, in which the functional group B is a group that forms a covalent bond with the functional group A.

<10> The planographic printing plate precursor according to any one of <1> to <8>, in which the functional group B is a group that forms an ionic bond with the functional group A.

<11> The planographic printing plate precursor according to any one of <1> to <8>, in which the functional group B is a group that forms a hydrogen bond with the functional group A.

<12> The planographic printing plate precursor according to any one of <1> to <8>, in which the functional group B is a group that is dipole-interactable with the functional group A.

<13> The planographic printing plate precursor according to any one of <1> to <12>, in which the resin A contains a resin having a crosslinked structure.

<14> The planographic printing plate precursor according to any one of <1> to <13>, in which the resin B further contains a polymerizable group.

<15> The planographic printing plate precursor according to <14>, in which the polymerizable group is a (meth) acryloxy group.

<16> The planographic printing plate precursor according to <14> or <15>, in which an ethylenically unsaturated group value of the resin B contained in the core-shell particle is in a range of 0.05 mmol/g to 5 mmol/g.

<17> A method of preparing a planographic printing plate, comprising: a step of imagewise-exposing the planographic printing plate precursor according to any one of <1> to <16>; and a step of supplying at least one selected from the group consisting of printing ink and dampening water to remove an image recording layer of a non-image area on a printing press.

<18> A planographic printing method comprising: a step of imagewise-exposing the planographic printing plate precursor according to any one of <1> to <16>; a step of supplying at least one selected from the group consisting of printing ink and dampening water to remove an image recording layer of a non-image area on a printing press and preparing a planographic printing plate; and a step of performing printing using the obtained planographic printing plate.

According to an aspect of the present disclosure, it is possible to provide a planographic printing plate precursor from which a planographic printing plate with excellent printing durability is obtained even in a case where UV ink is used.

According to another embodiment of the present disclosure, it is possible to provide a method of preparing a planographic printing plate using the planographic printing plate precursor and a printing method for a planographic printing plate.

DESCRIPTION OF THE PREFERRED EMBODIMENTS

Figure 1:
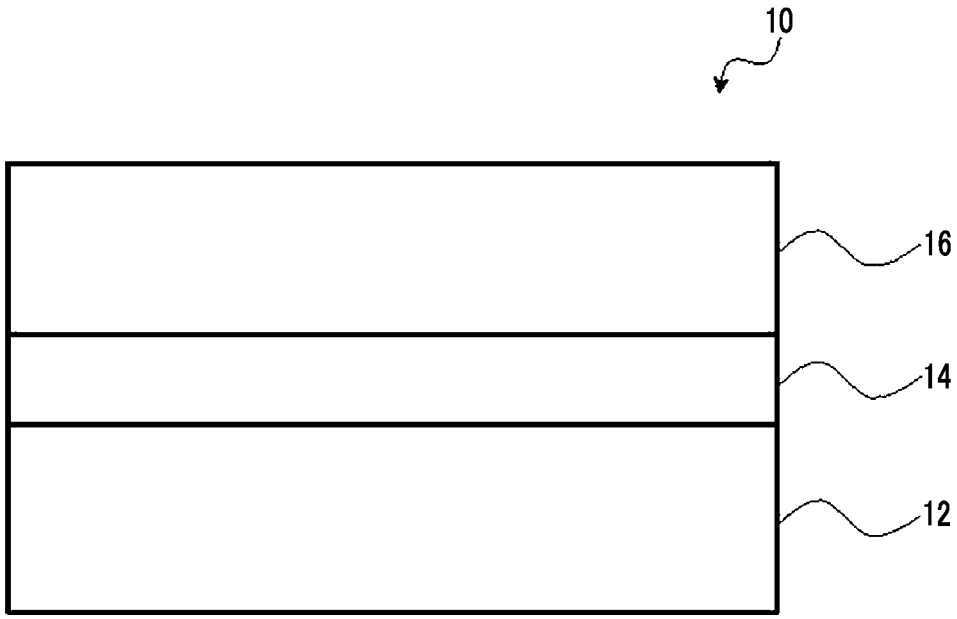
FIG. 1 is a schematic cross-sectional view illustrating an embodiment of a planographic printing plate precursor according to the embodiment of the present disclosure.

Hereinafter, the contents of the present disclosure will be described in detail. The description of constituent elements below is made based on representative embodiments of the present disclosure in some cases, but the present disclosure is not limited to such embodiments.

Further, in the present specification, a numerical range shown using "to" indicates a range including numerical values described before and after "to" as a lower limit and an upper limit.

Further, in a case where substitution or unsubstitution is not noted in regard to the notation of a "group" (atomic group) in the present specification, the "group" includes not only a group that does not have a substituent but also a group having a substituent. For example, the concept of an "alkyl group" includes not only an alkyl group that does not have a substituent (unsubstituted alkyl group) but also an alkyl group having a substituent (substituted alkyl group).

In the present specification, the concept of "(meth)acryl" includes both acryl and methacryl, and the concept of "(meth)acryloyl" includes both acryloyl and methacryloyl.

Further, the term "step" in the present specification indicates not only an independent step but also a step which cannot be clearly distinguished from other steps as long as the intended purpose of the step is achieved. Further, in the present disclosure, "% by mass" has the same definition as that for "% by weight", and "part by mass" has the same definition as that for "part by weight".

In the present disclosure, a composition may contain only one or two or more components in combination and a polymer may have only one or two or more constitutional units in combination, unless otherwise specified.

In the present disclosure, the amount of each component in a composition or each constitutional unit in a polymer indicates the total amount of a plurality of materials corresponding to each component in the composition or the total amount of a plurality of constitutional units corresponding to each constitutional unit in the polymer in a case where the composition contains a plurality of materials corresponding to each component described above or the polymer has a plurality of constitutional units corresponding to each constitutional unit described above, unless otherwise specified.

Further, in the present disclosure, a combination of two or more preferred embodiments is a more preferred embodiment.

Further, the weight-average molecular weight (Mw) and the number average molecular weight (Mn) in the present disclosure are molecular weights in terms of polystyrene used as a standard substance, which are detected by using tetrahydrofuran (THF) as a solvent, a differential refractometer, and a gel permeation chromatography (GPC) analyzer using TSKgel GMHxL, TSKgel G4000HxL, and TSKgel G2000HxL (all trade names, manufactured by Tosoh Corporation) as columns, unless otherwise specified.

In the present disclosure, the term "planographic printing plate precursor" includes not only a planographic printing plate precursor but also a key plate precursor. Further, the term "planographic printing plate" includes not only a planographic printing plate prepared by performing operations such as exposure and development on a planographic printing plate precursor as necessary but also a key plate. In a case of a key plate precursor, the operations of exposure, development, and the like are not necessarily required. Further, a key plate is a planographic printing plate precursor for attachment to a plate cylinder that is not used in a case where printing is performed on a part of a paper surface with one or two colors in color newspaper printing.

Further, in the present disclosure, "*" in a chemical structural formula represents a bonding position with respect to another structure.

Hereinafter, the present disclosure will be described in detail.

(Planographic Printing Plate Precursor)

A planographic printing plate precursor according to the embodiment of the present disclosure is a planographic printing plate precursor including a support, and an image recording layer on the support, in which the image recording layer contains an infrared absorbing agent, a polymerization initiator, and a core-shell particle, a core portion of each core-shell particle contains a resin A containing a functional group A, and a shell portion of the core-shell particle contains a resin B containing a functional group B that is bondable to or interactable with the functional group A and a dispersion group.

Further, the planographic printing plate precursor according to the embodiment of the present disclosure may be a negative type planographic printing plate precursor or a positive type planographic printing plate precursor, but it is preferable that the planographic printing plate precursor is a negative type planographic printing plate precursor.

Further, the planographic printing plate precursor according to the embodiment of the present disclosure can be suitably used as a planographic printing plate precursor for on-press development.

In the planographic printing plate, a planographic printing plate in which the number of printable plates (hereinafter, also referred to as "printing durability") is high is required.

Particularly, in recent years, an ink that is cured by being irradiated with ultraviolet rays (UV) (also referred to as "ultraviolet curable ink" or "UV ink") is used as an ink for printing in some cases.

The UV ink has high productivity because the ink can be dried instantly, can easily reduce environmental pollution because the ink usually has a small content of a solvent or does not contain a solvent, and can form an image without being dried with heat or by being dried with heat in a short time, and thus the ink has an advantage that the range of applications for printing targets and the like is expanded.

Therefore, a planographic printing plate precursor that can provide a planographic printing plate having excellent printing durability even in a case of using UV ink is considered to be extremely industrially useful.

As a result of intensive examination on the planographic printing plate precursors described in JP2012-71590A and JP2012-529669A, the present inventors found that the printing durability of the planographic printing plate to be obtained is insufficient particularly in a case where UV ink is used as the ink.

As a result of intensive examination conducted by the present inventors, it was found that a planographic printing plate precursor from which a planographic printing plate with excellent printing durability is obtained even in a case of using UV ink can be provided.

The detailed mechanism by which the above-described effect is obtained is not clear, but can be assumed as follows.

It is assumed that since the image recording layer of the planographic printing plate precursor according to the embodiment of the present disclosure contains an infrared absorbing agent, a polymerization initiator, and a core-shell particle, the core portion of each core-shell particle contains a resin A containing a functional group A, and the shell portion of the core-shell particle contains a resin B containing a functional group B that is bondable to or interactable with the functional group A and a dispersion group, the core portion and the shell portion of the core-shell particle are bonded to or interact with each other by the functional group A and the functional group B so that the hardness of the image recording layer is more excellent, a large amount of the dispersion group is likely to be present in the surface of each core-shell particle with the configuration described above so that the dispersibility of the core-shell particle is improved, the film hardness of the image recording layer is further improved, and thus the printing durability (UV printing durability) is excellent even in a case where UV ink is used.

Further, in a case where the image recording layer of the planographic printing plate precursor according to the embodiment of the present disclosure corresponds to the above-described embodiment, the detailed mechanism is not clear, but it is assumed that since aggregation of the infrared absorbing agent and the core-shell particle in the image recording layer is likely to be suppressed and the dispersibility in dampening water is also excellent, a property of suppressing contamination of dampening water is likely to be excellent, and a property of suppressing development scum is also likely to be excellent.

Further, it is assumed that in a case where the image recording layer of the planographic printing plate precursor according to the embodiment of the present disclosure corresponds to the above-described embodiment, the printing durability is likely to be improved even in a case of using oil-based ink.

Further, it is assumed that since the image recording layer of the planographic printing plate precursor according to the embodiment of the present disclosure includes a core-shell particle containing the resin B that contains a dispersion group, the dispersibility of the core-shell particle in the image recording layer is likely to be excellent, the surface of the planographic printing plate precursor tends to be smooth, and thus the surface state thereof is likely to be excellent.

Hereinafter, details of each constituent element in the planographic printing plate precursor according to the embodiment of the present disclosure will be described.

<Image Recording Layer>

The planographic printing plate precursor according to the embodiment of the present disclosure includes an image recording layer formed on the support.

The image recording layer of the present disclosure contains an infrared absorbing agent, a polymerization initiator, and a core-shell particle.

The image recording layer used in the present disclosure is preferably a negative type image recording layer and more preferably a water-soluble or water-dispersible negative type image recording layer.

In the planographic printing plate precursor according to the embodiment of the present disclosure, from the viewpoint of the on-press developability, it is preferable that the unexposed portion of the image recording layer can be removed by at least one of dampening water or printing ink.

Hereinafter, details of each component contained in the image recording layer will be described.

<Core-Shell Particle>

The image recording layer used in the present disclosure contains a core-shell particle, the core portion of each core-shell particle contains a resin A containing a functional group A, and the shell portion of the core-shell particle contains a resin B containing a functional group B that is bondable to or interactable with the functional group A and a dispersion group.

Further, in each of the following constitutional units in the resin A or the resin B, the resin A or the resin B may each independently have only one or two or more of the constitutional units unless otherwise specified.

<<Functional Group A and Functional Group B>>

In the core-shell particle, the functional group A and the functional group B are functional groups that are bondable to or interactable with each other.

Examples of the bond which can be formed by the functional group A and the functional group B include a covalent bond, an ionic bond, and a hydrogen bond. Further, examples of the interaction which can be made by the functional group A and the functional group B include dipole interaction.

—Group Capable of Covalent Bonding Between Functional Group A and Functional Group B—

The group that is capable of covalent bonding between the functional group A and the functional group B is not particularly limited as long as the group is capable of forming a covalent bond through the reaction between the functional group A and the functional group B, and examples thereof include a hydroxy group, a carboxy group, an amino group, an amide group, an epoxy group, an isocyanate group, a thiol group, a glycidyl group, an aldehyde group, and a sulfonic acid group. Among these, from the viewpoint of the UV printing durability, an isocyanate group, a hydroxy group, a carboxy group, an amino group, and a glycidyl group are preferable, and a carboxy group and a glycidyl group are more preferable.

—Group Capable of Ionic Bonding Between Functional Group A and Functional Group B—

The group that is capable of ionic bonding is not particularly limited as long as one of the functional group A and the functional group B contains a cationic group and the other contains an anionic group.

It is preferable that the cationic group is an onium group. Examples of the onium group include an ammonium group, a pyridinium group, a phosphonium group, an oxonium group, a sulfonium group, a selenonium group, and an iodonium group. Among these, from the viewpoint of the UV printing durability, an ammonium group, a pyridinium group, a phosphonium group, or a sulfonium group is preferable, an ammonium group or a phosphonium group is more preferable, and an ammonium group is particularly preferable.

The anionic group is not particularly limited, and examples thereof include a phenolic hydroxyl group, a carboxy group, $—SO_3H$, $—OSO_3H$, $—PO_3H$, $—OPO_3H_2$, $—CONHSO_2—$, and $—SO_2NHSO_2—$. Among these, a phosphoric acid group, a phosphonic acid group, a phosphinic acid group, a sulfuric acid group, a sulfonic acid group, a sulfinic acid group, or a carboxy group is preferable, a phosphoric acid group or a carboxy group is more preferable, and a carboxy group is still more preferable.

—Group Capable of Hydrogen Bonding Between Functional Group A and Functional Group B—

The group that is capable of hydrogen bonding is not particularly limited as long as one of the functional group A and the functional group B has a hydrogen bond-donating site and the other has a hydrogen bond receiving site.

The hydrogen bond-donating site may have a structure that has an active hydrogen atom capable of hydrogen bonding, and a structure represented by X—H is preferable.

X represents a hetero atom. Among hetero atoms, a nitrogen atom or an oxygen atom is preferable.

From the viewpoint of the UV printing durability, as the hydrogen bond-donating site, at least one structure selected from the group consisting of a hydroxy group, a carboxy group, a primary amide group, a secondary amide group, a primary amino group, a secondary amino group, a primary sulfonamide group, a secondary sulfonamide group, an imide group, a urea bond, and a urethane bond is preferable, at least one structure selected from the group consisting of a hydroxy group, a carboxy group, a primary amide group, a secondary amide group, a primary sulfonamide group, a secondary sulfonamide group, a maleimide group, a urea bond, and a urethane bond is more preferable, at least one structure selected from the group consisting of a hydroxy group, a carboxy group, a primary amide group, a secondary amide group, a primary sulfonamide group, a secondary sulfonamide group, and a maleimide group is still more preferable, and at least one structure selected from the group consisting of a hydroxy group and a secondary amide group is particularly preferable.

The hydrogen bond receiving site may be a structure having an atom with an unshared electron pair, and a structure having an oxygen atom with an unshared electron pair is preferable, at least one structure selected from the group consisting of a carbonyl group (including a carbonyl structure such as a carboxy group, an amide group, an imide group, a urea bond, or a urethane bond) and a sulfonyl group (including a sulfonyl structure such as a sulfonamide group) is more preferably, and a carbonyl group (including a carbonyl structure such as a carboxy group, an amide group, an imide group, a urea bond, or a urethane bond) is particularly preferable.

As the group capable of hydrogen bonding between the functional group A and the functional group B, a group having the above-described hydrogen bond-donating site and the above-described hydrogen bond receiving site is preferable, a group containing a carboxy group, an amide group, an imide group, a urea bond, a urethane bond, or a sulfonamide group is preferable, and a group containing a carboxy group, an amide group, an imide group, or a sulfonamide group is more preferable.

—Group Capable of Dipole Interaction Between Functional Group A and Functional Group B—

The group capable of dipole interaction between the functional group A and the functional group B may be a group having a polarized structure other than the structure represented by X—H (X represents a hetero atom, a nitrogen atom, or an oxygen atom) in the group capable of hydrogen bonding described above, and suitable examples thereof include a group to which atoms with different electronegativities are bonded.

As a combination of atoms with different electronegativities, a combination of a carbon atom and at least one atom selected from the group consisting of an oxygen atom, a nitrogen atom, a sulfur atom, and a halogen atom is preferable, and a combination of a carbon atom and at least one atom selected from the group consisting of an oxygen atom, a nitrogen atom, and a sulfur atom is more preferable.

Among these, from the viewpoint of the UV printing durability, a combination of a nitrogen atom and a carbon atom and a combination of a carbon atom, a nitrogen atom, an oxygen atom, and a sulfur atom are preferable. Specifically, a cyano group, a cyanuric group, and a sulfonic acid amide group are more preferable.

Further, it is preferable that the functional group A and the functional group B are groups capable of the same dipole interaction.

The bond between the functional group A and the functional group B and the interaction between the functional group A and the functional group B can be confirmed by the following method.

Specifically, 2 g of the resin A (an aqueous solution in which the concentration of solid contents thereof is 20% by mass) and 8 g of the resin B (a 1-methoxy-2-propanol (MFG) solution in which the concentration of solid contents thereof is 7.5% by mass) are allowed to react to or mixed with each other and centrifuged at 21000×g for 60 minutes to collect a precipitate. Next, the precipitate is washed with a solvent that dissolves the resin B to wash the resin B containing the functional group B that does not react to or interact with the functional group A, and the precipitate is dried at 40° C.

It can be determined that the functional group A and the functional group B are bonded to or interact with each other at an optional ratio in a case where infrared absorption spectrum (IR) measurement is performed on the dried material of the obtained precipitate, an increase in weight before and after the reaction or the mixing is quantified, the weight of the dried solid material of the supernatant is measured, the number of absorption peaks derived from the functional group B in the IR measurement is increased, the weight of the dried solid material is decreased, and the weight of the dried material is increased.

As the functional group B that is bondable to or interactable with the functional group A (that is, the functional group A that is bondable to or interactable with the functional group B), a group capable of covalent bonding to the functional group A (hereinafter, also simply referred to as a "group capable of covalent bonding"), a group capable of ionic bonding to the functional group A (hereinafter, also simply referred to as a "group capable of ionic bonding"), a group capable of hydrogen bonding to the functional group A (hereinafter, also simply referred to as a "group capable of hydrogen bonding"), or a group capable of dipole interaction with the functional group A (hereinafter, also simply referred to as a "group capable of dipole interaction") is preferable from the viewpoint of the UV printing durability.

—Group Capable of Covalent Bonding—

The group capable of covalent bonding is appropriately selected according to the kinds of the functional group A and the functional group B.

In a case where one of the functional group A and the functional group B is, for example, a carboxy group, examples of the group capable of covalent bonding to the carboxy group include a hydroxy group and a glycidyl group.

Further, in a case where one of the functional group A and the functional group B is, for example, —$NH_2$ (primary amino group), examples of the group capable of covalent bonding to —$NH_2$ include an isocyanate group, a glycidyl group, a carboxyl group, and an acrylate group.

—Group Capable of Ionic Bonding—

The group capable of ionic bonding to the functional group A is appropriately selected according to the kinds of the functional group A and the functional group B.

In a case where one of the functional group A and the functional group B is, for example, a carboxy group, examples of the group capable of ionic bonding to the carboxy group include groups having basicity such as primary to tertiary amino groups, a pyridyl group, and a piperidyl group.

In a case where one of the functional group A and the functional group B is, for example, a sulfonic acid group, examples of the group capable of ionic bonding to the sulfonic acid group include groups having basicity such as primary to tertiary amino groups, a pyridyl group, and a piperidyl group.

In a case where one of the functional group A and the functional group B is, for example, —$SO_3^-$, examples of the group capable of ionic bonding to —$SO_3^-$ include a cationic group such as a quaternary ammonium group.

In a case where one of the functional group A and the functional group B is a phosphoric acid group, examples of the group capable of ionic bonding to the phosphoric acid group include groups having basicity such as primary to tertiary amino groups.

—Group Capable of Hydrogen Bonding—

The group capable of hydrogen bonding is appropriately selected according to the kinds of the functional group A and the functional group B.

In a case where one of the functional group A and the functional group B is a carboxy group, examples of the group capable of hydrogen bonding include an amide group and a carboxy group.

In a case where one of the functional group A and the functional group B is a phenolic hydroxyl group, examples of the group capable of hydrogen bonding include a phenolic hydroxyl group.

Further, examples of the combination of the functional group A and the functional group B include a combination of an amide group and an amide group, a combination of a urethane group and a urethane group, a combination of a urea group and a urea group, a combination of a urea group and a phenolic hydroxyl group, and a combination of an acrylamide group and a carboxy group.

—Group Capable of Dipole Interaction—

The group capable of dipole interaction is appropriately selected according to the kinds of the functional group A and the functional group B.

In a case where one of the functional group A and the functional group B is, for example, a cyano group, examples of the group capable of dipole interaction with the cyano group include a cyano group.

In a case where one of the functional group A and the functional group B is a sulfonic acid amide group, examples of the group capable of dipole interaction with the sulfonic acid amide group include a sulfonic acid amide group.

<<Examples of Bonding or Interaction>>

Specific examples of bonding or interaction between the functional group A and the functional group B are shown below, but the bonding or interaction between the functional group A and the functional group B in the present disclosure is not limited thereto.

Covalent bond

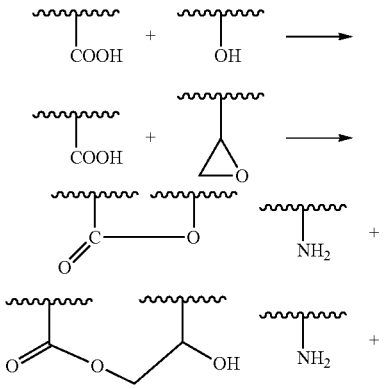

-continued

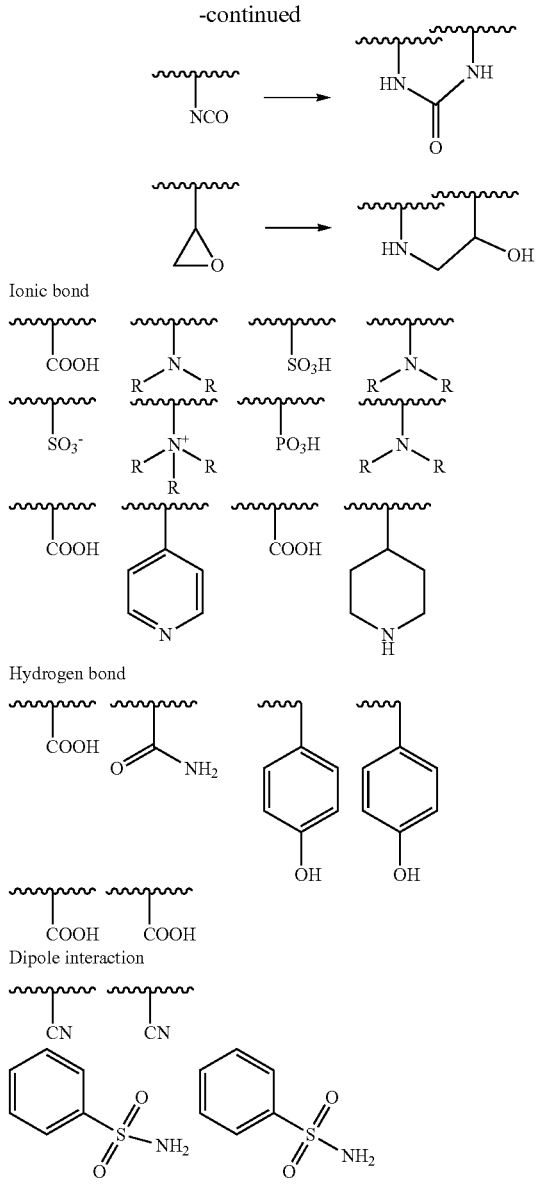

<<Core Portion>>

The core portion of each core-shell particle contains the resin A having the functional group A.

[Resin A]

The resin A may be an addition polymerization type resin or a polycondensation resin, but from the viewpoints of the UV printing durability and ease of production, the resin A is preferably an acrylic resin, a polyurea resin, or a polyurethane resin, more preferably an acrylic resin or a polyurethane resin, and particularly preferably an acrylic resin.

As the acrylic resin, a resin in which the content of a constitutional unit formed of a (meth)acrylic compound (a constitutional unit derived from a (meth)acrylic compound) is 50% by mass or greater is preferable.

Suitable examples of the (meth)acrylic compound include a (meth)acrylate compound and a (meth)acrylamide compound.

Further, as a styrene-acrylic copolymer, a resin in which the content of a constitutional unit formed of a styrene compound (a constitutional unit derived from a styrene compound) is 30% by mass or greater is preferable, a resin in which the content thereof is 40% by mass or greater is more preferable, and a resin in which the content thereof is 50% by mass or greater is particularly preferable.

The resin A may be used alone or in combination of two or more kinds thereof. Further, the resin A may be in a latex state.

The functional group A contained in the resin A is not particularly limited as long as the functional group A is bondable to or interactable with the functional group B contained in the resin B. The functional group A can be appropriately set according to the kind of the functional group B described below.

The resin A may contain a single functional group A or a combination of two or more kinds thereof.

In the resin A, from the viewpoint of the UV printing durability, the functional group A is preferably at least one group selected from the group consisting of a carboxy group, a cyano group, and an amino group and more preferably a carboxy group or an amino group.

Further, it is preferable that the resin A has a constitutional unit having a functional group A.

—Constitutional Unit Containing Cyano Group (—CN)—

From the viewpoint of the UV printing durability, it is preferable that the resin A has a constitutional unit formed of a compound containing a cyano group.

It is preferable that the cyano group is introduced to the resin A as a constitutional unit containing a cyano group, typically using a compound (monomer) containing a cyano group. Examples of the compound containing a cyano group include an acrylonitrile compound, and suitable examples thereof include (meth)acrylonitrile.

As the constitutional unit containing a cyano group, a constitutional unit formed of an acrylonitrile compound is preferable, and a constitutional unit formed of (meth)acrylonitrile is more preferable.

Further, preferred examples of the constitutional unit formed of a compound containing a cyano group include a constitutional unit represented by Formula a1.

Formula a1

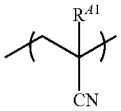

In Formula a1, $R^{A1}$ represents a hydrogen atom or an alkyl group.

In Formula a1, $R^{A1}$ represents preferably a hydrogen atom or an alkyl group having 1 to 4 carbon atoms, more preferably a hydrogen atom or a methyl group, and still more preferably a hydrogen atom.

In a case where the resin A has a constitutional unit containing a cyano group, from the viewpoint of the UV printing durability, the content of the constitutional unit containing a cyano group is preferably in a range of 55% by mass to 90% by mass and more preferably in a range of 60% by mass to 85% by mass with respect to the total mass of the resin A.

—Constitutional Unit Containing Carboxy Group (—COOH)—

From the viewpoint of the UV printing durability, it is preferable that the resin A has a constitutional unit containing a carboxy group. It is preferable that the carboxy group is introduced to the resin A as a constitutional unit containing a carboxy group, typically using a compound (monomer) containing a carboxy group.

The constitutional unit containing a carboxy group may be a constitutional unit formed of a compound containing a carboxy group such as acrylic acid, methacrylic acid, itaconic acid, crotonic acid, isocrotonic acid, or maleic acid.

It is preferable that the resin A has at least one constitutional unit selected from the group consisting of a constitutional unit formed of acrylic acid and a constitutional unit represented by Formula a2.

Formula a2

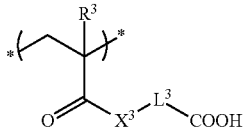

In Formula a2, $R^3$ represents a hydrogen atom or a methyl group, $X^3$ represents —O— or —$NR^7$—, $R^7$ represents a hydrogen atom or an alkyl group, $L^3$ represents a single bond or a divalent hydrocarbon group having 1 or more carbon atoms, and each * independently represent a bonding site with respect to another structure.

In Formula a2, in a case where $X^3$ represents —$NR^7$, $R^7$ represents preferably a hydrogen atom or an alkyl group having 1 to 4 carbon atoms, more preferably a hydrogen atom or a methyl group, and still more preferably a hydrogen atom.

In Formula a2, $L^3$ represents a single bond or a divalent hydrocarbon group having 1 or more carbon atoms, preferably a single bond or a divalent hydrocarbon group which may have an ester bond or an ether bond therein, more preferably a single bond or a divalent hydrocarbon group, and still more preferably a single bond or a divalent saturated aliphatic hydrocarbon group. In a case where $L^3$ represents a divalent hydrocarbon group, the number of carbon atoms in the divalent hydrocarbon group as $L^3$ is preferably in a range of 2 to 15 and more preferably in a range of 3 to 12.

The content of the constitutional unit containing a carboxy group (preferably a constitutional unit a2) is preferably in a range of 5% by mass to 70% by mass and more preferably in a range of 10% by mass to 50% by mass with respect to the total mass of the resin A.

—Constitutional Unit Containing Amino Group—

From the viewpoint of the UV printing durability, it is preferable that the resin A has a constitutional unit formed of a compound containing an amino group.

The amino group may be a primary amino group, a secondary amino group, or a tertiary amino group, but is preferably a tertiary amino group from the viewpoint of synthesizing the resin A.

In a case where the resin A contains a tertiary amino group, it is preferable that the resin A has a constitutional unit represented by Formula a3.

Formula a3

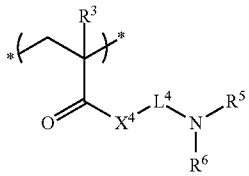

In Formula a3, $R^4$ represents a hydrogen atom or a methyl group, $X^4$ represents —O— or —$NR^8$—, $R^8$ represents a hydrogen atom or an alkyl group, at least two of $L^4$, $R^5$, and $R^6$ may be bonded to form a ring, $L^4$ represents a single bond or a divalent hydrocarbon group having 1 or more carbon atoms, $R^5$ and $R^6$ each independently represent a monovalent hydrocarbon group having 1 or more carbon atoms, and each * independently represents a bonding site with respect to another structure.

In Formula a3, in a case where $X^4$ represents —$NR^8$, $R^8$ represents preferably a hydrogen atom or an alkyl group having 1 to 4 carbon atoms, more preferably a hydrogen atom or a methyl group, and still more preferably a hydrogen atom.

In Formula a3, $L^4$ represents a single bond or a divalent hydrocarbon group having 1 or more carbon atoms, preferably a single bond or a divalent hydrocarbon group which may have a urea bond or an ether bond, more preferably a single bond or a divalent hydrocarbon group, and still more preferably a single bond or a divalent saturated aliphatic hydrocarbon group. The number of carbon atoms of $L^4$ is more preferably in a range of 2 to 10 and still more preferably in a range of 2 to 8.

$R^5$ and $R^6$ each independently represent a monovalent hydrocarbon group having 1 or more carbon atoms and preferably a saturated aliphatic hydrocarbon group having 1 or more carbon atoms. $R^5$ and $R^6$ each independently have preferably 1 to 10 carbon atoms, more preferably 1 to 5 carbon atoms, and still more preferably 1 to 3 carbon atoms.

The content of the constitutional unit containing an amino group (preferably a constitutional unit a3) is preferably in a range of 5% by mass to and 70% by mass, more preferably in a range of 10% by mass to 50% by mass, and still more preferably in a range of 10% by mass to 40% by mass with respect to the total mass of the resin A.

It is preferable that the resin A further has at least one constitutional unit selected from the group consisting of a constitutional unit formed of an aromatic vinyl compound, a constitutional unit containing a dispersion group, a constitutional unit formed of a compound containing a polymerizable group, and a constitutional unit formed of a compound having a crosslinked structure.

<<Constitutional Unit Formed of Aromatic Vinyl Compound>>

From the viewpoint of the UV printing durability, it is preferable that the resin A further has a constitutional unit formed of an aromatic vinyl compound.

The aromatic vinyl compound may be a compound having a structure in which a vinyl group is bonded to an aromatic ring, and examples thereof include a styrene compound and a vinylnaphthalene compound. Among these, a styrene compound is preferable, and styrene is more preferable.

Examples of the styrene compound include styrene, p-methylstyrene, p-methoxystyrene, β-methylstyrene, p-methyl-β-methylstyrene, α-methylstyrene, and p-methoxy-β-methylstyrene. Among these, styrene is preferable.

Examples of the vinylnaphthalene compound include 1-vinylnaphthalene, methyl-1-vinylnaphthalene, β-methyl-1-vinylnaphthalene, 4-methyl-1-vinylnaphthalene, and 4-methoxy-1-vinylnaphthalene. Among these, 1-vinylnaphthalene is preferable.

Further, preferred examples of the constitutional unit formed of the aromatic vinyl compound include a constitutional unit represented by Formula Z1.

Formula Z1

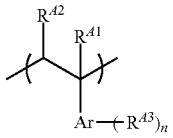

In Formula Z1, $R^{A1}$ and $R^{A2}$ each independently represent a hydrogen atom or an alkyl group, Ar represents an aromatic ring group, $R^{A3}$ represents a substituent, and n represents an integer of 0 to the maximum number of substituents for Ar.

In Formula Z1, $R^{A1}$ and $R^{A2}$ each independently represent preferably a hydrogen atom or an alkyl group having 1 to 4 carbon atoms, more preferably a hydrogen atom or a methyl group, and still more preferably a hydrogen atom.

In Formula Z1, Ar represents preferably a benzene ring or a naphthalene ring and more preferably a benzene ring.

In Formula Z1, $R^{A3}$ represents preferably an alkyl group or an alkoxy group, more preferably an alkyl group having 1 to 4 carbon atoms or an alkoxy group having 1 to 4 carbon atoms, and still more preferably a methyl group or a methoxy group.

In Formula Z1, in a case where a plurality of $R^{A3}$'s are present, the plurality of $R^{A3}$'s may be the same as or different from each other.

In Formula Z1, n represents preferably an integer of 0 to 2, more preferably 0 or 1, and still more preferably 0.

From the viewpoint of the ink impressing property, the content of the constitutional unit formed of the aromatic vinyl compound in the resin A contained in the core portion of each core-shell particle is more preferably in a range of 15% by mass to 85% by mass and still more preferably in a range of 30% by mass to 70% by mass with respect to the total mass of the resin A.

<<Constitutional Unit Formed of Compound Having Crosslinked Structure>>

From the viewpoint of the UV printing durability, the resin A contained in the core portion of each core-shell particle has preferably a crosslinked structure and more preferably a constitutional unit having a crosslinked structure.

It is considered that since the resin A has a crosslinked structure, the hardness of the core-shell particle is improved, the strength of the image area is improved, and thus the printing durability (UV printing durability) is further improved even in a case where an ultraviolet curable ink that is more likely to deteriorate a plate than other inks is used.

The crosslinked structure is not particularly limited, but a constitutional unit formed by polymerizing a polyfunctional ethylenically unsaturated compound or a constitutional unit in which one or more reactive groups form a covalent bond inside a particle is preferable. From the viewpoints of the UV printing durability and the on-press developability, the number of functional groups in the polyfunctional ethylenically unsaturated compound is preferably in a range of 2 to 15, more preferably in a range of 3 to 10, still more preferably in a range of 4 to 10, and particularly preferably in a range of 5 to 10.

That is, from the viewpoints of the UV printing durability and the on-press developability, it is preferable that the constitutional unit having a crosslinked structure is a bifunctional to pentadeca-functional branched unit.

Further, an n-functional branched unit indicates a branched unit having n molecular chains, that is, a constitutional unit having an n-functional branching point (crosslinked structure).

Further, it is also preferable that a crosslinked structure is formed by a polyfunctional mercapto compound.

The ethylenically unsaturated group in the polyfunctional ethylenically unsaturated compound is not particularly limited, and examples thereof include a (meth)acryloxy group, a (meth)acrylamide group, an aromatic vinyl group, and a maleimide group.

Further, it is preferable that the polyfunctional ethylenically unsaturated compound is a polyfunctional (meth)acrylate compound, a polyfunctional (meth)acrylamide compound, or a polyfunctional aromatic vinyl compound.

Examples of the polyfunctional (meth)acrylate compound include diethylene glycol diacrylate, triethylene glycol diacrylate, tetraethylene glycol diacrylate, trimethylolpropane diacrylate, trimethylolpropane triacrylate, 1,4-butanediol diacrylate, 1,6-hexanediol diacrylate, polyethylene glycol diacrylate, polypropylene glycol diacrylate, tricyclodecane dimethylol diacrylate, ditrimethylolpropane tetraacrylate, pentaerythritol triacrylate, pentaerythritol tetraacrylate, dipentaerythritol triacrylate, dipentaerythritol hexaacrylate, and triacrylate of tris(β-hydroxyethyl)isocyanurate.

Examples of the polyfunctional (meth)acrylate compound include N,N'-methylene bisacrylamide, and N-[tris(3-acrylamidopropoxymethyl)methyl]acrylamide.

Examples of the polyfunctional aromatic vinyl compound include divinylbenzene.

The number of carbon atoms in the branched unit is not particularly limited, but is preferably in a range of 8 to 100 and more preferably in a range of 8 to 70.

Further, from the viewpoints of the UV printing durability, the on-press develop ability, and the strength of particles, as the constitutional unit having a crosslinked structure, at least one constitutional unit selected from the group consisting of constitutional units represented by Formulae BR-1 to BR-17 is preferable, at least one constitutional unit selected from the group consisting of constitutional units represented by Formulae BR-1 to BR-10 or Formulae BR-13 to BR-17 is more preferable, at least one constitutional unit selected from the group consisting of constitutional units represented by Formulae BR-1 to BR-7 or BR-13 to BR-17 is still more preferable, and a constitutional unit represented by Formula BR-1 is particularly preferable.

BR-1

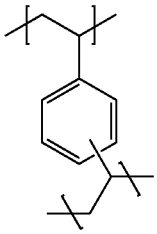

BR-2

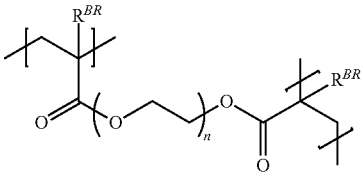

BR-3

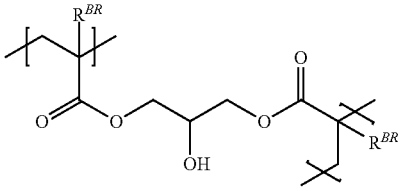

BR-4

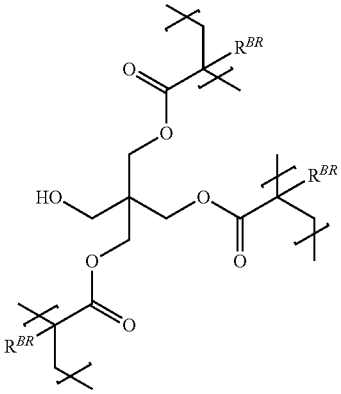

BR-5

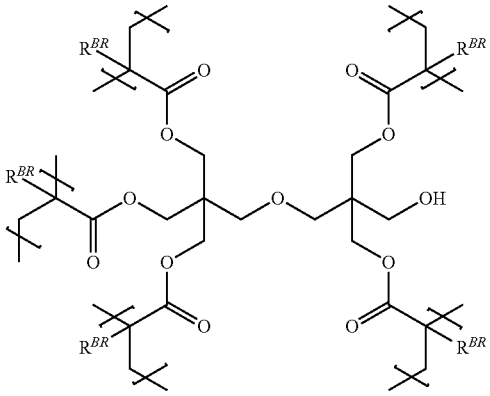

BR-6

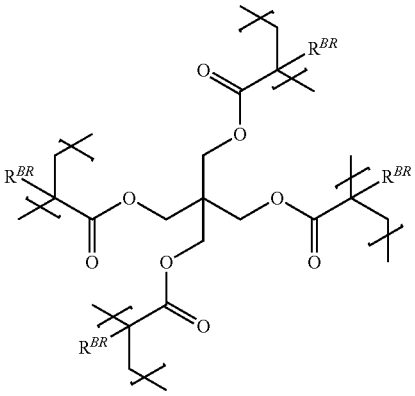

-continued
BR-7
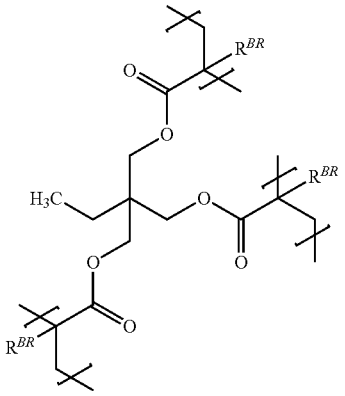
BR-8
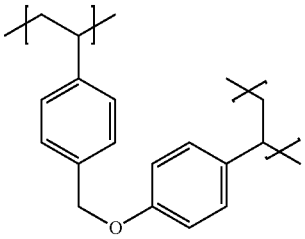
BR-9
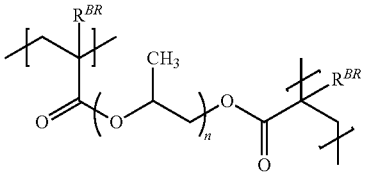
BR-10
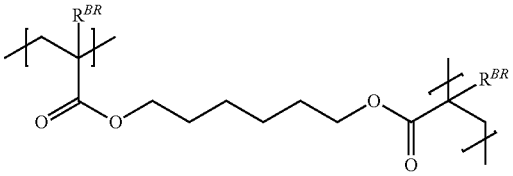
BR-11
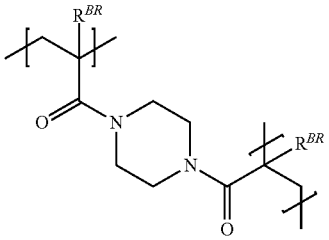
BR-12
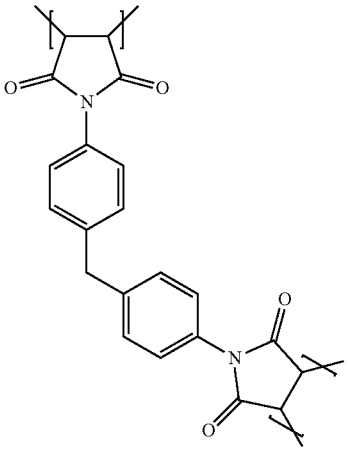
BR-13
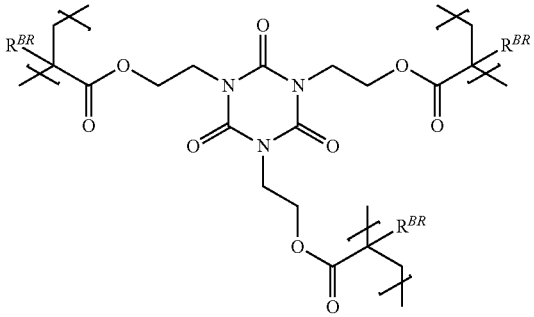
BR-14
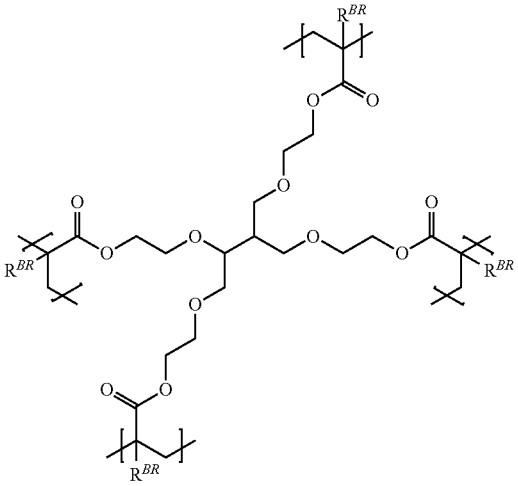

-continued

BR-15

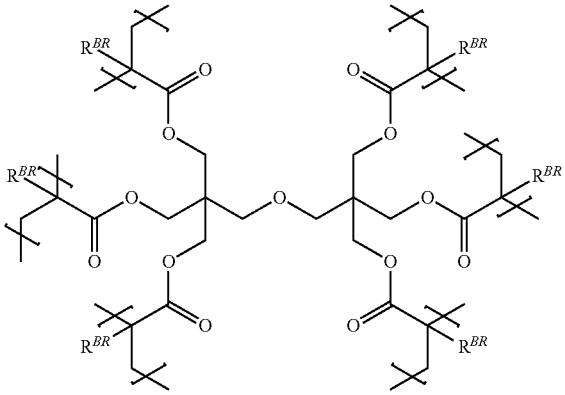

BR-16

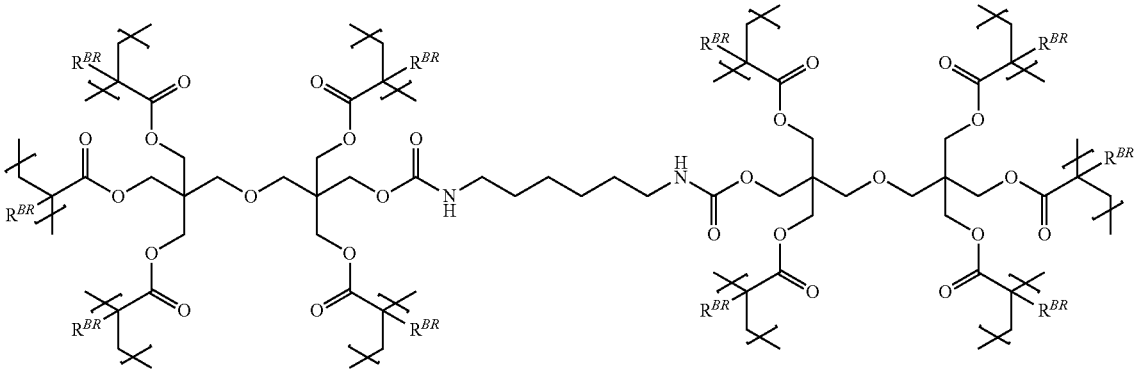

In the above-described structures, $R^{BR}$'s each independently represent a hydrogen atom or a methyl group, and n represents an integer of 1 to 20.

BR-17

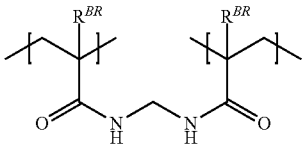

In the above-described structures, $R^{BR}$'s each independently represent a hydrogen atom or a methyl group, and n represents an integer of 1 to 20.

Further, preferred examples of the constitutional unit having a crosslinked structure formed by a polyfunctional mercapto compound include BR-18 shown below.

BR-18

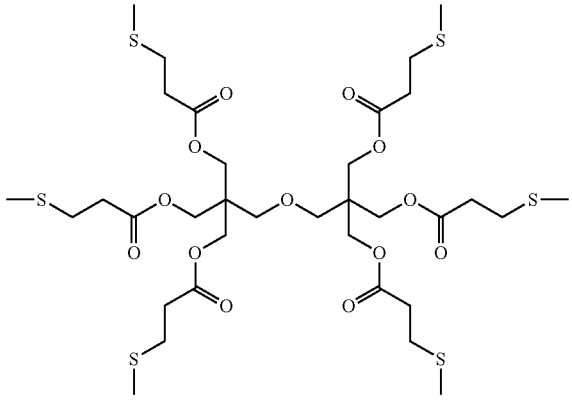

From the viewpoints of the UV printing durability and the on-press developability, the content of the constitutional unit having a crosslinked structure in the resin A is preferably in a range of 1% by mass to 50% by mass, more preferably in a range of 5% by mass to 45% by mass, still more preferably in a range of 10% by mass to 40% by mass, and particularly preferably in a range of 10% by mass to 35% by mass with respect to the total mass of the resin A.

<<Constitutional Unit Containing Dispersion Group>>

The constitutional unit containing a dispersion group in the resin A has the same definition as that for the constitutional unit containing a dispersion group in the resin B described below, and the preferred embodiments thereof are also the same as described above.

In a case where the resin A has a constitutional unit containing a dispersion group as another constitutional unit A, the content of the constitutional unit containing a dispersion group is preferably 50% by mass or less, more preferably in a range of 1% by mass to 20% by mass, and still more preferably in a range of 2% by mass to 10% by mass with respect to the total amount of all constitutional units constituting the resin A.

<<Constitutional Unit Containing Hydrophobic Group>>

In the core-shell particle, the resin A contained in the core portion may have a constitutional unit containing a hydrophobic group from the viewpoint of the ink impressing property.

Examples of the hydrophobic group include an alkyl group, an aryl group and an aralkyl group.

As the constitutional unit containing a hydrophobic group, a constitutional unit formed of an alkyl(meth)acrylate compound, an aryl(meth)acrylate compound, or an aralkyl (meth)acrylate compound is preferable, and a constitutional unit formed of an alkyl(meth)acrylate compound is more preferable.

The number of carbon atoms in the alkyl group in the alkyl (meth)acrylate compound is preferably in a range of 1 to 10. The alkyl group may be linear or branched and may have a cyclic structure. Examples of the alkyl (meth)acrylate compound include methyl (meth)acrylate, ethyl (meth)acrylate, propyl (meth)acrylate, cyclohexyl (meth)acrylate, 2-ethylhexyl (meth)acrylate, and dicyclopentanyl (meth) acrylate.

The aryl group in the aryl (meth)acrylate compound preferably has 6 to 20 carbon atoms and is more preferably a phenyl group. Further, the aryl group may have a known substituent. Preferred examples of the aryl (meth)acrylate compound include phenyl (meth)acrylate.

The carbon number of the alkyl group in the aralkyl (meth)acrylate compound is preferably in a range of 1 to 10. The alkyl group may be linear or branched and may have a cyclic structure. Further, the aryl group in the aralkyl(meth) acrylate compound preferably has 6 to 20 carbon atoms and is more preferably a phenyl group. Preferred examples of the aralkyl (meth)acrylate compound include benzyl (meth) acrylate.

In the core-shell particle, the content of the constitutional unit containing a hydrophobic group in the resin A contained in the core portion is preferably in a range of 5% by mass to 50% by mass and more preferably in a range of 10% by mass to 30% by mass with respect to the total mass of the resin A.

In the core-shell particle, the resin A contained in the shell portion may have constitutional units other than the above-described constitutional units in the resin A without particular limitation, and examples thereof include constitutional units formed of an acrylamide compound, a vinyl ether compound, and the like.

Examples of the acrylamide compound include (meth) acrylamide, N-methyl (meth)acrylamide, N-ethyl (meth) acrylamide, N-propyl (meth)acrylamide, N-butyl (meth) acrylamide, N,N'-dimethyl (meth)acrylamide, N,N'-diethyl (meth)acrylamide, N-hydroxyethyl (meth)acrylamide, N-hydroxypropyl (meth)acrylamide, and N-hydroxybutyl (meth)acrylamide.

Examples of the vinyl ether compound include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexyl methyl vinyl ether, 4-methylcyclohexyl methyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxy polyethylene glycol vinyl ether.

In a case where the resin A has other constitutional units, the content of other constitutional units is preferably in a range of 5% by mass to 50% by mass and more preferably in a range of 10% by mass to 30% by mass with respect to the total mass of the resin A.

The core portion may contain the resin A, and from the viewpoint of the UV printing durability, the content of the resin A in the core portion is preferably 80% by mass or greater, more preferably 90% by mass or greater, and still more preferably and 95% by mass or greater, and it is particularly preferable that the core portion is formed of the resin A.

Further, the core portion is preferably a particle and more preferably a particle formed of the resin A.

<<Shell Portion>>

The shell portion of each core-shell particle contains the resin B containing the functional group B that is bondable to or interactable with the functional group A and a dispersion group.

[Resin B]

The resin B contained in the shell portion of each core-shell particle contains the functional group B that is bondable to or interactable with the functional group A and a dispersion group.

The resin B may be an addition polymerization type resin or a polycondensation resin, but from the viewpoints of the UV printing durability and ease of production, the resin B is preferably an acrylic resin, a polyurea resin, or a polyurethane resin, more preferably an acrylic resin or a polyurethane resin, and particularly preferably an acrylic resin.

As the acrylic resin, a resin in which the content of a constitutional unit formed of a (meth)acrylic compound (a constitutional unit derived from a (meth)acrylic compound) is 50% by mass or greater is preferable.

Suitable examples of the (meth)acrylic compound include a (meth)acrylate compound and a (meth)acrylamide compound.

<Functional Group B>

The resin B contains the functional group B is bondable to or interactable with the functional group A. Examples of the functional group B that is bondable to or interactable with the functional group A include the above-described groups that are bondable to or interactable with the functional group.

The resin B may contain only one or two or more functional groups B.

In the resin B, from the viewpoint of the UV printing durability, the functional group B is preferably at least one group selected from the group consisting of primary to tertiary amino groups, a carboxy group, an epoxy group, and a cyano group, more preferably any of primary to tertiary amino groups or a cyano group, and particularly preferably any of primary to tertiary amino groups.

Further, it is preferable that the resin B has a constitutional unit containing a functional group B.

From the viewpoint of the UV printing durability, it is preferable that the resin B has a constitutional unit represented by Formula b-1 or Formula a1 as the constitutional unit containing the functional group B that is bondable to or interactable with the functional group A.

Formula b-1

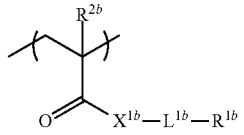

In Formula b-1, $X^1b$ represents —O—, OH, $NR^3b$, or $NH_2$, $L^{1b}$ represents a divalent linking group having 1 to 20 carbon atoms, $R^{1b}$ represents a carboxy group, a hydroxy group, a glycidyl group, or an amino group, $R^{2b}$ represents a hydrogen atom or a methyl group, and $R^{3b}$ represents a hydrogen atom, an alkyl group, or an aryl group. Here, in a case where $X^{1b}$ represents OH or $NH_2$, $L^{1b}$ and $R^{1b}$ may not be present accordingly.

It is preferable that $X^{1b}$ represents —O— or OH.

In a case where $X^{1b}$ represents $NR^{3b}$, $R^{3b}$ represents preferably a hydrogen atom, an alkyl group having 1 to 4 carbon atoms, or a phenyl group and more preferably a hydrogen atom.

$L^{1b}$ represents preferably a divalent linking group having 2 to 10 carbon atoms, more preferably a divalent linking group having 2 to 8 carbon atoms, still more preferably an alkylene group having 2 to 8 carbon atoms, and particularly preferably an alkylene group having 2 to 5 carbon atoms.

As the divalent linking group represented by $L^{1b}$, a group represented by a bond formed of at least two structures selected from the group consisting of a group represented by Formula LD1, the above-described alkylene group, an ester bond, and an alkyleneoxy group is more preferable.

Formula LD1

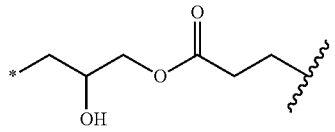

The wavy line and the symbol "*" in Formula LD1 represent a bonding position with respect to another structure.

The amino group as $R^{1b}$ may be a primary amino group, a secondary amino group, or a tertiary amino group, but from the viewpoint of the UV printing durability, a tertiary amino group is preferable.

From the viewpoint of the UV printing durability, the content of the constitutional unit containing the functional group B in the resin B is preferably in a range of 1% by mass to 80% by mass and more preferably in a range of 5% by mass to 60% by mass with respect to the total mass of the resin B.

<<Dispersion Group>>

The resin B has a dispersion group, and it is preferable that the resin B has a constitutional unit containing a dispersion group.

The dispersion group may be, for example, an alkyl chain having 10 or more carbon atoms. From the viewpoint of the UV printing durability, the alkyl chain is preferably a branched or linear saturated alkyl chain, more preferably a linear alkyl chain, and still more preferably a linear alkyl chain having 10 or more carbon atoms.

From the viewpoints of the UV printing durability and the surface state of the image area in the planographic printing plate to be obtained, the dispersion group contains preferably an alkyl group having 10 to 30 carbon atoms and more preferably an alkyl group having 12 to 24 carbon atoms.

Further, from the viewpoints of the UV printing durability and the surface state of the image area in the planographic printing plate to be obtained, it is preferable that the resin contains a group represented by Formula 1 as the dispersion group.

*-Q-W—Y Formula 1

In Formula 1, Q represents a divalent linking group, W represents a divalent group having a hydrophilic structure or a divalent group having a hydrophobic structure, Y represents a monovalent group having a hydrophilic structure or a monovalent group having a hydrophobic structure, any one of W or Y has a hydrophilic structure, and * represents a bonding site with respect to another structure Q represents preferably a divalent linking group having 1 to 20 carbon atoms and more preferably a divalent linking group having 1 to 10 carbon atoms.

Further, Q represents preferably an alkylene group, an arylene group, an ester bond, an amide bond, or a group formed by combining two or more of these groups and more preferably a phenylene group, an ester bond, or an amide bond.

It is preferable that the divalent group having a hydrophilic structure as W is a polyalkyleneoxy group or a group in which $—CH_2CH_2NR^W—$ is bonded to one terminal of a polyalkyleneoxy group. Further, $R^W$ represents a hydrogen atom or an alkyl group.

It is preferable that the divalent group having a hydrophobic structure as W is $—R^{WA}—$, $—O—R^{WA}—O—$, $—R^WN—R^{WA}—NR^W—$, $—OC(=O)—R^{WA}—O—$, or $—OC(=O)—R^{WA}—O—$. Further, $R^{WA}$'s each independently represent a linear, branched, or cyclic alkylene group having 6 to 120 carbon atoms, a haloalkylene group having 6 to 120 carbon atoms, an arylene group having 6 to 120 carbon atoms, an alkarylene group having 6 to 120 carbon atoms (a divalent group obtained by removing one hydrogen atom from an alkylaryl group), or an aralkylene group having 6 to 120 carbon atoms.

It is preferable that the monovalent group having a hydrophilic structure as Y is —OH, —C(=O)OH, a polyalkyleneoxy group having a hydrogen atom or an alkyl group at a terminal, or a group in which $—CH_2CH_2N(R^W)—$ is bonded to a terminal of a polyalkyleneoxy group having a hydrogen atom or an alkyl group at the other terminal.

It is preferable that the monovalent group having a hydrophobic structure as Y is a linear, branched, or cyclic alkyl group having 6 to 120 carbon atoms, a haloalkyl group having 6 to 120 carbon atoms, an aryl group having 6 to 120 carbon atoms, an alkaryl group (an alkylaryl group) 6 to 120 carbon atoms, an aralkyl group having 6 to 120 carbon atoms, $—OR^{WB}$, $—C(=O)OR^{WB}$, or $—OC(=O)R^{WB}$. $R^{WB}$ represents an alkyl group having 6 to 20 carbon atoms.

From the viewpoint of the UV printing durability, it is preferable that the group represented by Formula 1 has a hydrophilic structure, more preferable that W in Formula 1 represents a divalent group having a hydrophilic structure, and still more preferable that Q in Formula 1 represents a phenylene group, an ester bond, or an amide bond, W in Formula 1 represents a polycaprolactone group, a polyoxazoline group, or a polyalkyleneoxy group, and Y represents a polyalkyleneoxy group or a polyoxazoline group having a hydrogen atom or an alkyl group at the terminal.

From the viewpoints of the UV printing durability and the surface state of the image area in the planographic printing plate to be obtained, the resin B has preferably a constitutional unit containing a dispersion group, more preferably a constitutional unit formed of a compound containing a group represented by Formula 1, still more preferably a constitutional unit represented by Formula b-3 or Formula b-4, and particularly preferably a constitutional unit represented by Formula b-3.

Formula b-3

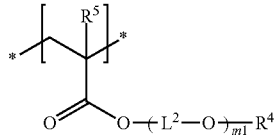

-continued

Formula b-4

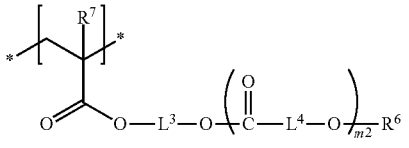

In Formulae b-3 and b-4, $L^2$ represents an ethylene group or a propylene group, $L^3$ represents an alkylene group having 2 to 10 carbon atoms, $L^4$ represents an alkylene group having 1 to 10 carbon atoms, $R^4$ and $R^6$ each independently represent a hydrogen atom, an alkyl group, or an aryl group, $R^5$ and $R^7$ each independently represent a hydrogen atom or a methyl group, m1 represents an integer of 2 to 200, and m2 represents an integer of 2 to 20.

It is preferable that $L^2$ represents an ethylene group or a 1,2-propylene group.

$L^3$ represents preferably an alkylene group having 2 to 8 carbon atoms, more preferably an alkylene group having 2 to 4 carbon atoms, and still more preferably an ethylene group.

$L^4$ represents preferably an alkylene group having 2 to 8 carbon atoms, more preferably an alkylene group having 3 to 8 carbon atoms, and still more preferably an alkylene group having 4 to 6 carbon atoms.

$R^4$ and $R^6$ each independently represent preferably a hydrogen atom, an alkyl group having 1 to 4 carbon atoms, or a phenyl group, preferably a hydrogen atom or an alkyl group having 1 to 4 carbon atoms, and still more preferably a hydrogen atom or a methyl group.

m1 represents preferably an integer of 5 to 200 and more preferably an integer of 8 to 150.

m2 represents preferably an integer of 2 to 10 and more preferably an integer of 4 to 10.

From the viewpoint of the UV printing durability, the resin B has preferably a constitutional unit represented by Formula b-1 or Formula a1 as the functional group B that is bondable to or interactable with the functional group A and a constitutional unit represented by Formula b-3 or Formula b-4 as the dispersion group and more preferably a constitutional unit represented by Formula b-1 or Formula a1 and a constitutional unit represented by Formula b-3.

—Content of Constitutional Unit Containing Functional Group B—

From the viewpoint of the UV printing durability, the content of the constitutional unit containing the functional group B in the resin B is preferably in a range of 1% by mass to 80% by mass and more preferably in a range of 5% by mass to 60% by mass with respect to the total mass of the resin B.

—Content of Constitutional Unit Containing Dispersion Group—

From the viewpoints of the UV printing durability and the surface state of the image area in the planographic printing plate to be obtained, the content of the constitutional unit containing the functional group B in the resin B is preferably in a range of 1% by mass to 50% by mass and more preferably in a range of 5% by mass to 40% by mass with respect to the total mass of the resin B.

<<Polymerizable Group>>

It is preferable that the resin B further contains a polymerizable group.

The polymerizable group may be, for example, a cationically polymerizable group or a radically polymerizable group, but a radically polymerizable group is preferable from the viewpoint of the reactivity.

The polymerizable group is not particularly limited, but from the viewpoint of the reactivity, an ethylenically unsaturated group is preferable, a vinylphenyl group (styryl group), a (meth)acryloxy group, or a (meth)acrylamide group is more preferable, and a (meth)acryloxy group is most preferable.

Further, in a case where the resin B contains a polymerizable group, it is preferable that the resin B has a constitutional unit containing a polymerizable group.

Further, the introduction of these polymerizable groups to the resin B may be carried out by a method of introducing polymerizable groups using residues of polyfunctional monomers to be added in a case of synthesis of core-shell particles or a method of introducing polymerizable groups to the surface of each particle through the polymer reaction after synthesis of core-shell particles. In the present disclosure, the method of introducing polymerizable groups through the polymer reaction after synthesis of core-shell particles is desirable. This is because more active polymerizable groups can be allowed to be present on the surface of each core-shell particle in a case where the polymerizable groups are introduced after the synthesis of core-shell particle, and thus the reactivity of the polymerizable groups with the matrix is enhanced and the polymerizable groups are likely to be strongly crosslinked with the matrix.

As described above, the constitutional unit containing a polymerizable group can be introduced to the addition polymerization type resin by, for example, the polymer reaction. Specifically, the introduction can be carried out by, for example, a method of allowing a compound (such as glycidyl methacrylate) containing an epoxy group and a polymerizable group to react with a polymer to which a constitutional unit containing a carboxy group such as methacrylic acid has been introduced or a method of allowing a compound (such as 2-isocyanatoethyl methacrylate) containing an isocyanate group and a polymerizable group to react with a polymer to which a constitutional unit containing a group having active hydrogen such as a hydroxy group or an amino group has been introduced.

In such an introduction method, a constitutional unit containing a carboxy group or a constitutional unit containing a group that has active hydrogen can be allowed to remain in the addition polymerization type resin by adjusting the reaction rate of the compound containing an epoxy group and a polymerizable group or the compound containing an isocyanate group and a polymerizable group with respect to the constitutional unit containing a carboxy group such as methacrylic acid or the constitutional unit containing a group having active hydrogen (hereinafter, also collectively referred to as "constitutional units before the reaction", and these constitutional units after the introduction of polymerizable groups are also referred to as "constitutional units after the reaction").

Since the constitutional unit before the reaction corresponds to a constitutional unit having a hydrophilic structure described below, in a case where the reaction rate is decreased, the addition polymerization type resin is allowed to contain the constitutional unit having a hydrophilic structure (an ionic group such as a carboxy group or an amino group), and the dispersibility of the specific polymer particle, the developability of the planographic printing plate precursor, and the like can also be further improved.

The reaction rate is, for example, preferably in a range of 10% to 100% and more preferably in a range of 30% to 70%.

The reaction rate is a value defined by Equation R.

Reaction rate=(number of moles of constitutional unit after reaction in obtained addition polymerization type resin/total number of moles of constitutional unit before reaction in obtained addition polymerization type resin)×100 Equation R Further, the constitutional unit containing a polymerizable group may be introduced to the resin B according to a method of allowing a compound containing a carboxy group and a polymerizable group to react with a polymer to which a constitutional unit containing an epoxy group such as glycidyl (meth)acrylate has been introduced.

Further, the constitutional unit containing a polymerizable group may be introduced to the resin B by using, for example, a monomer having a partial structure represented by Formula d1 or Formula d2. Specifically, for example, the constitutional unit containing a polymerizable group is introduced to the resin B by forming an ethylenically unsaturated group on the partial structure represented by Formula d1 or Formula d2 through an elimination reaction using a base compound, after the polymerization carried out using at least the monomer described above.

Formula d1

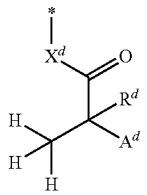

Formula d2

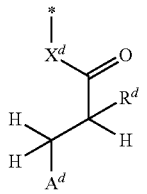

In Formulae d1 and d2, Rd represents a hydrogen atom or an alkyl group, $A^d$ represents a halogen atom, $X^d$ represents —O— or —$NR^N$—, $R^N$ represents a hydrogen atom or an alkyl group, and * represents a bonding site with respect to another structure.

In Formulae d1 and d2, it is preferable that Rd represents a hydrogen atom or a methyl group.

In Formulae d1 and d2, it is preferable that $A^d$ represents a chlorine atom, a bromine atom, or an iodine atom.

In Formulae d1 and d2, it is preferable that $X^d$ represents —O—. In a case where $X^d$ represents —$NR^N$—, $R^N$ represents preferably a hydrogen atom or an alkyl group having 1 to 4 carbon atoms and more preferably a hydrogen atom.

Examples of the constitutional unit containing a polymerizable group include a constitutional unit represented by Formula D1.

Formula D1

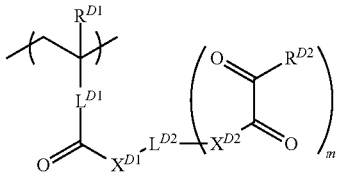

In Formula D1, $L^{D1}$ represents a single bond or a divalent linking group, $L^{D2}$ represents an (m+1)-valent linking group, $X^{D1}$ and $X^{D2}$ each independently represent —O— or —$NR^N$—, $R^N$ represents a hydrogen atom or an alkyl group, $R^{D1}$ and $R^{D2}$ each independently represent a hydrogen atom or a methyl group, and m represents an integer of 1 or greater.

In Formula D1, it is preferable that $L^{D1}$ represents a single bond. In a case where Lm represents a divalent linking group, an alkylene group, an arylene group, or a divalent group in which two or more of these groups are bonded to each other is preferable, and an alkylene group having 2 to 10 carbon atoms or a phenylene group is more preferable.

In Formula D1, $L^{D2}$ represents preferably a linking group containing a group represented by any of Formulae D2 to D6 and more preferably a group represented by a bond of at least two structures selected from the group consisting of a group represented by any of Formulae D2 to D6, an ester bond, an alkylene group, and an alkyleneoxy group.

In Formula D1, it is preferable that both $X^{D1}$ and $X^{D2}$ represent —O—. Further, in a case where at least one of $X^{D1}$ or $X^{D2}$ represents —$NR^N$—, $R^N$ represents preferably a hydrogen atom or an alkyl group having 1 to 4 carbon atoms and more preferably a hydrogen atom.

In Formula D1, it is preferable that $R^{D1}$ represents a methyl group.

In Formula D1, it is preferable that at least one of m $R^{D2}$'s represents a methyl group.

In Formula D1, m represents preferably an integer of 1 to 4, more preferably 1 or 2, and still more preferably 1.

Formula D2

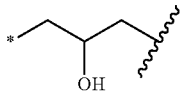

Formula D3

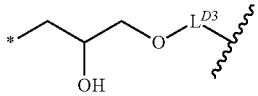

Formula D4

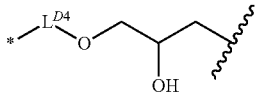

Formula D5

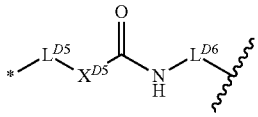

-continued

Formula D6

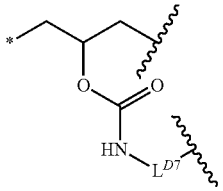

In Formulae D2 to D6, $L^{D3}$ to $L^{D7}$ represent a divalent linking group, $L^{D5}$ and $L^{D6}$ may be different from each other, $X^{D5}$ represents —O— or —$NR^N$—, $R^N$ represents a hydrogen atom or an alkyl group, * represents a bonding site with respect to $X^{D1}$ in Formula D1, and the wavy line represents a bonding site with respect to $X^{D2}$ in Formula D1.

In Formula D3, $L^{D3}$ represents preferably an alkylene group, an arylene group, or a group in which two or more of these groups are bonded to each other and more preferably an alkylene group having 1 to 10 carbon atoms, a phenylene group, or a group in which two or more of these groups are bonded to each other.

In Formula D4, $L^{D4}$ represents preferably an alkylene group, an arylene group, or a group in which two or more of these groups are bonded to each other and more preferably an alkylene group having 1 to 10 carbon atoms, a phenylene group, or a group in which two or more of these groups are bonded to each other.

In Formula D5, $L^{D5}$ represents preferably an alkylene group, an arylene group, or a group in which two or more of these groups are bonded to each other and more preferably an alkylene group having 1 to 10 carbon atoms, a phenylene group, or a group in which two or more of these groups are bonded to each other.

In Formula D5, it is preferable that $X^{D5}$ represents —O— or —NH—.

In Formula D5, $L^{D6}$ represents preferably an alkylene group, an arylene group, or a group in which two or more of these groups are bonded to each other and more preferably an alkylene group having 1 to 10 carbon atoms, a phenylene group, or a group in which two or more of these groups are bonded to each other.

In Formula D6, $L^{D7}$ represents preferably an alkylene group, an arylene group, or a group in which two or more of these groups are bonded to each other and more preferably an alkylene group having 1 to 10 carbon atoms, a phenylene group, or a group in which two or more of these groups are bonded to each other.

Specific examples of the constitutional unit containing a polymerizable group will be described below, but the constitutional unit containing a polymerizable group in the resin B of the present disclosure is not limited thereto.

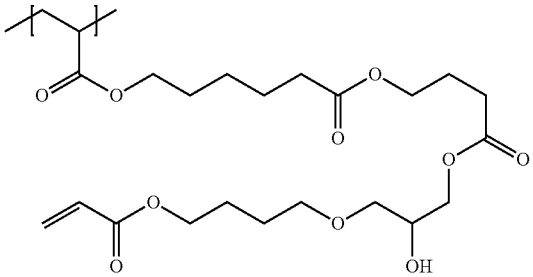

-continued

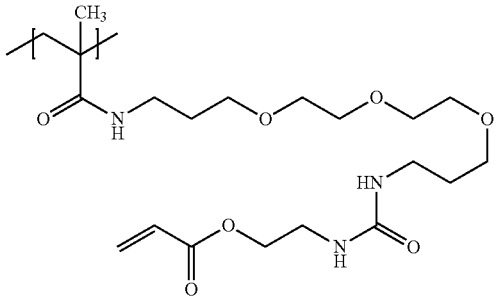

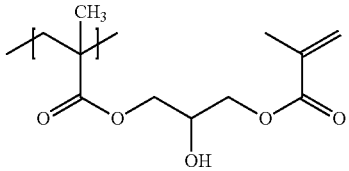

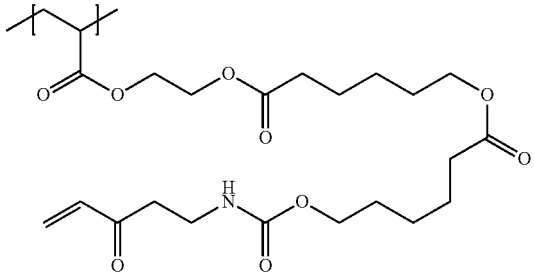

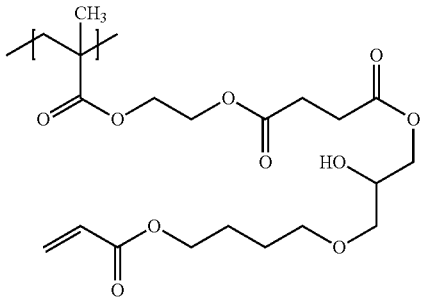

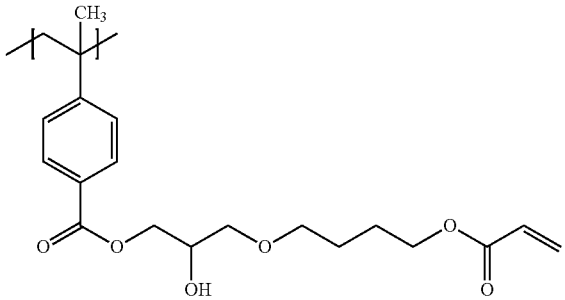

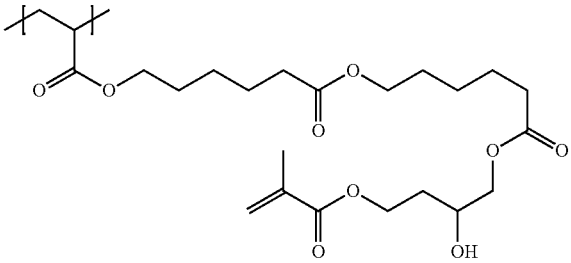

-continued

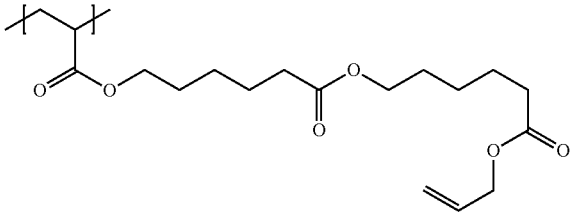

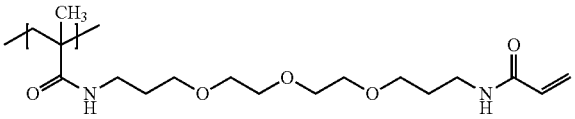

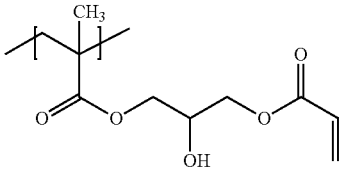

—Content of Constitutional Unit Containing Polymerizable Group—

In a case where the resin B has a constitutional unit containing a polymerizable group, from the viewpoint of the UV printing durability, the content of the constitutional unit containing a polymerizable group is preferably in a range of 10% by mass to 70% by mass, more preferably in a range of 15% by mass to 60% by mass, and still more preferably in a range of 20% by mass to 55% by mass with respect to the total mass of the resin B.

The ethylenically unsaturated bond value of the resin B (the amount of the polymerizable group per 1 g of the resin B) contained in the core-shell particle is preferably in a range of 0.05 mmol/g to 5 mmol/g and more preferably in a range of 0.2 mmol/g to 3 mmol/g. The ethylenically unsaturated bond value is measured by an iodometric titration method.

Further, the resin B may have a constitutional unit such as a constitutional unit formed of an aromatic vinyl compound or a constitutional unit having a crosslinked structure.

<<Constitutional Unit Formed of Aromatic Vinyl Compound>>

The resin B may further have a constitutional unit formed of an aromatic vinyl compound, but it is preferable that the resin B does not have the constitutional unit from the viewpoint of the UV printing durability.

The constitutional unit formed by the aromatic vinyl compound in the resin B has the same definition as that for the constitutional unit formed of the aromatic vinyl compound in the resin A, and the preferred embodiments are also the same as described above.

From the viewpoint of the ink impressing property, the content of the constitutional unit formed of the aromatic vinyl compound in the resin B is preferably 20% by mass or less and more preferably 10% by mass or less with respect to the total mass of the resin B. Further, it is particularly preferable that the resin B does not have the constitutional unit formed of the aromatic vinyl compound.

<<Constitutional Unit Having Crosslinked Structure>>

From the viewpoint of the UV printing durability, the resin B has preferably a crosslinked structure and more preferably a constitutional unit having a crosslinked structure.

The crosslinked structure and the constitutional unit having the crosslinked structure in the resin B each have the same definition as that for the crosslinked structure and the constitutional unit having the crosslinked structure in the resin A, and the preferred embodiments thereof are also the same as described above.

From the viewpoints of the UV printing durability and the on-press developability, the content of the constitutional unit having a crosslinked structure in the resin B is preferably in a range of 0.1% by mass to 20% by mass, more preferably in a range of 0.5% by mass to 15% by mass, and particularly preferably in a range of 1% by mass to 10% by mass with respect to the total mass of the resin B.

<<Constitutional Unit Containing Hydrophobic Group>>

From the viewpoint of the ink impressing property, the resin B contained in the shell portion of each core-shell particle may have a constitutional unit containing a hydrophobic group.

The constitutional unit containing a hydrophobic group in the resin B has the same definition as that for the constitutional unit having a hydrophobic group in the resin A, and the preferred embodiments are also the same as described above.

In the resin B contained in the shell portion of each core-shell particle, the content of the constitutional unit containing a hydrophobic group is preferably in a range of 1% by mass to 50% by mass and more preferably in a range of 5% by mass to 30% by mass with respect to the total mass of the resin B.

The resin B contained in the shell portion of each core-shell particle may have constitutional units other than the above-described constitutional units in the resin A without particular limitation, and examples thereof include constitutional units formed of an acrylamide compound, a vinyl ether compound, and the like.

In a case where the resin B has other constitutional units, the content of other constitutional units is preferably in a range of 1% by mass to 50% by mass and more preferably in a range of 5% by mass to 30% by mass with respect to the total mass of the resin B.

—Content of Resin B—

The content of the resin B with respect to the content of the resin A in the shell portion of each core-shell particle (hereinafter, also referred to as the "coverage") can be appropriately set. From the viewpoint of the UV printing durability, the content thereof is preferably in a range of 1% by mass to 90% by mass, more preferably in a range of 5% by mass to 70% by mass, and particularly preferably in a range of 10% by mass to 50% by mass with respect to the total mass of the core-shell particle.

The content of the resin B contained in the core portion is acquired by infrared absorption spectrum (IR) measurement.

Specifically, the IR measurement is performed by washing the reaction product or the mixture of the resin A and the resin B with a solvent that dissolves the resin B, washing the resin B containing the functional group B that has not reacted or interacted with the functional group A, and drying the precipitate at 40° C. The IR measurement is performed using a paste of the resin A and the resin B mixed at an optional ratio (resin A:resin B=2:8 to 8:2), the peak area of the dispersion group contained in the resin B is calculated to create a calibration curve with the peak that only the resin A has as a reference, and the coverage is acquired based on the peak area thereof.

—Number Average Molecular Weight of Resin B—

The number average molecular weight of the resin B is preferably in a range of 500 to 1000000, more preferably in a range of 5000 to 500000, and still more preferably in a range of 10000 to 200000.

From the viewpoint of the UV printing durability, the arithmetic average particle diameter of the core portion is preferably in a range of 10 nm to 1000 nm, more preferably in a range of 30 nm to 800 nm, and particularly preferably in a range of 50 nm to 600 nm.

From the viewpoint of the UV printing durability, the arithmetic average particle diameter of the core-shell particle is preferably in a range of 10 nm to 1000 nm, more preferably in a range of 50 nm to 800 nm, and particularly preferably in a range of 70 nm to 600 nm.

The arithmetic average particle diameter of the core-shell particle in the present disclosure indicates a value measured by a dynamic light scattering method (DLS) unless otherwise specified.

The arithmetic average particle diameter of the core-shell particle is measured by DLS using a Brookhaven BI-90 (manufactured by Brookhaven Instrument Company) according to the manual of the above-described device.

Further, from the viewpoint of the UV printing durability, the average thickness of the shell portion is preferably in a range of 1 nm to 100 nm, more preferably in a range of 1 nm to 50 nm, and particularly preferably in a range of 2 nm to 20 nm.

The average thickness of the shell portion in the present disclosure is obtained by dyeing the cross sections of particles according to a known method, observing the cross sections with an electron microscope, and calculating the average value of the thicknesses of the shell portions at 10 or more sites in total for 10 or more particles.

—Method of Producing Resin A and Resin B Contained in Core-Shell Particle—

The method of producing the resins contained in the core-shell particle is not particularly limited, and the resins can be produced by a known method.

For example, the resins are obtained by polymerizing at least one compound selected from the group consisting of a compound used for forming a constitutional unit containing the functional group A, a compound used for forming a constitutional unit containing the functional group B, a compound used for forming a constitutional unit containing the acidic group, and a compound used for forming a constitutional unit A other than the constitutional units described above according to a known method.

SPECIFIC EXAMPLES

Specific examples of the resin A and the resin B contained in the core-shell particle are shown below, but the thermoplastic resin used in the present disclosure is not limited thereto.

A-1

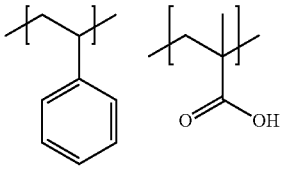

A-2

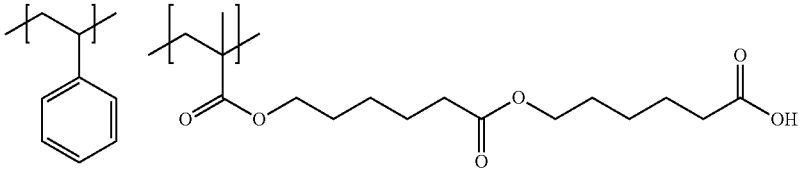

A-3

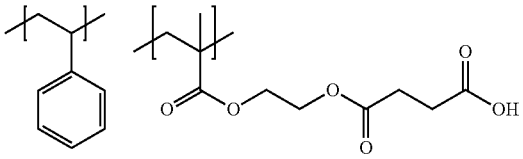

A-4

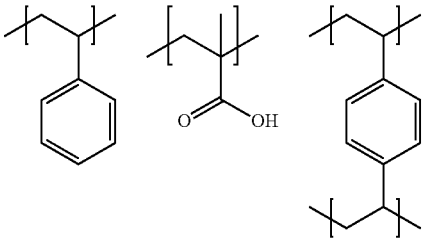

A-5

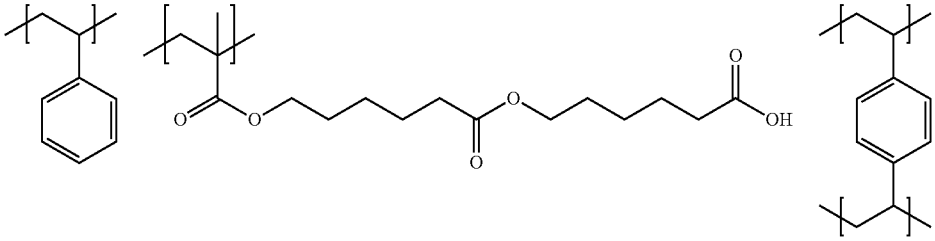

-continued
A-6
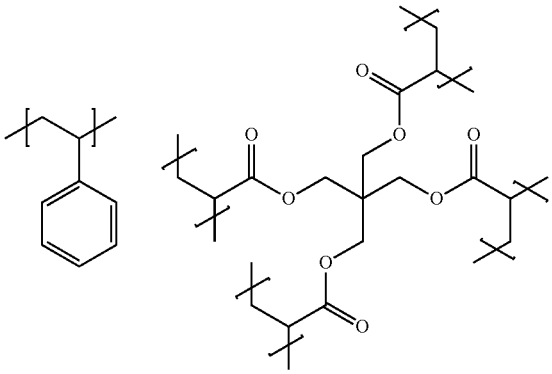
A-7
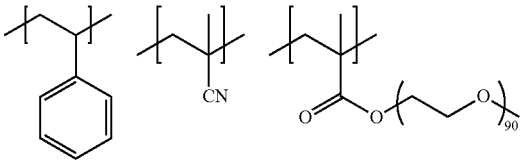
A-8
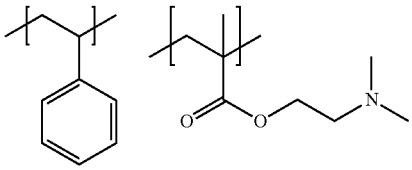
A-9
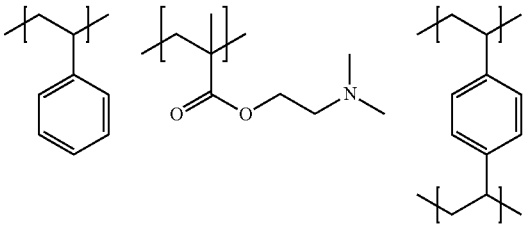
A-10
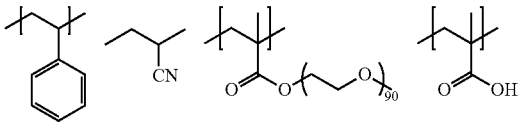
A-11
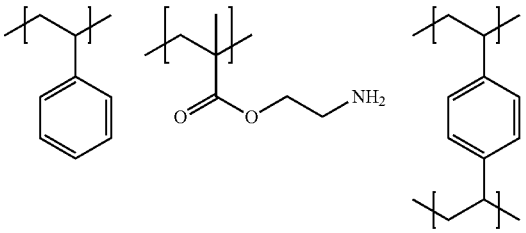
A-12
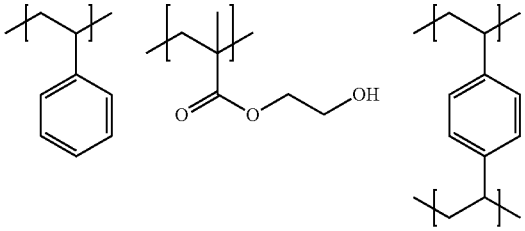
A-13
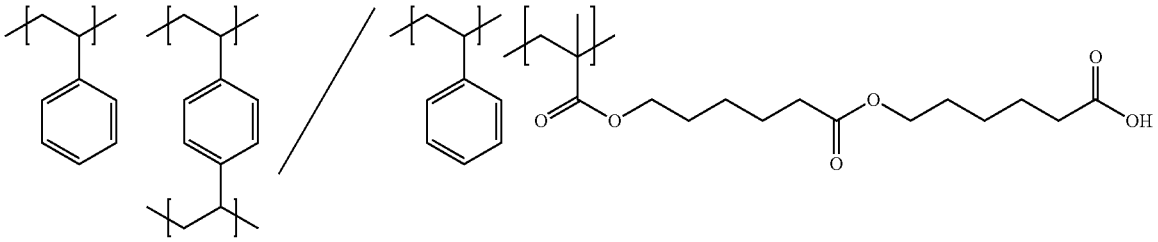
Further, A-13 represents an example of particles in which a large amount of the resin shown on the left side is present inside the core portion and a large amount of the resin A shown on the right side is present toward the outside.

Further, specific examples of the resin B contained in the core-shell particle are shown below, but the resin used in the present disclosure is not limited thereto.
B-1
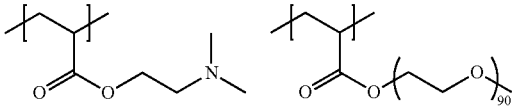
B-2
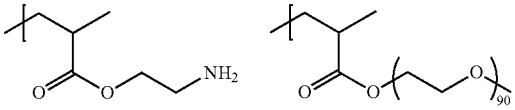
B-3
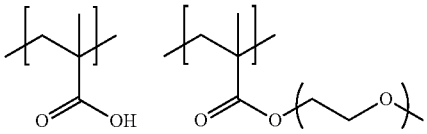
B-4
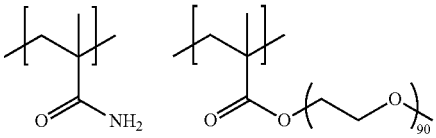
B-5
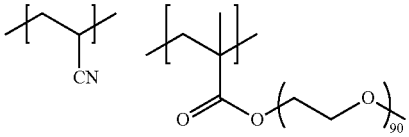
B-6
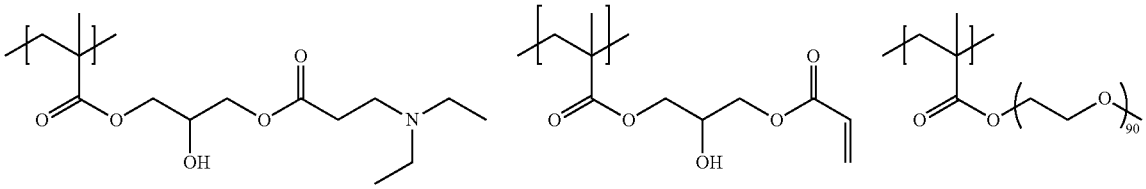
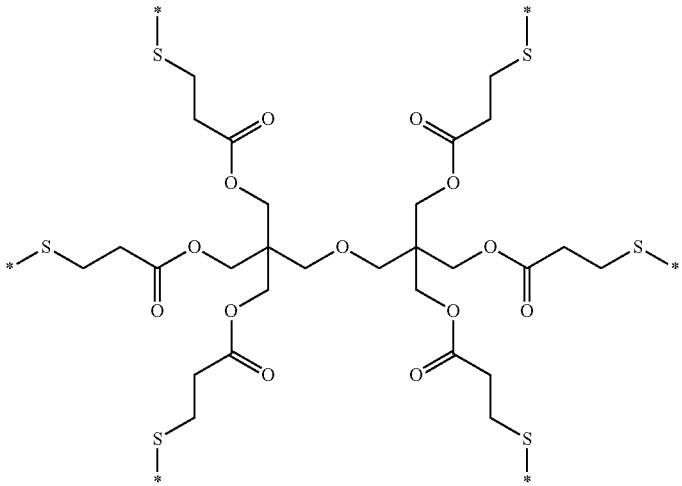
B-7
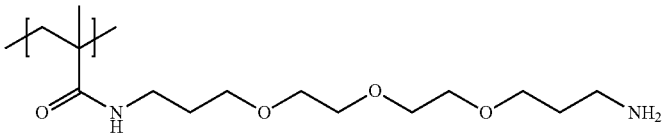
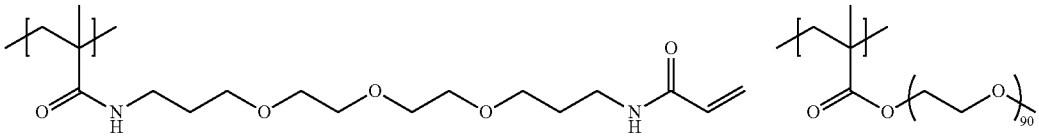

-continued
B-8
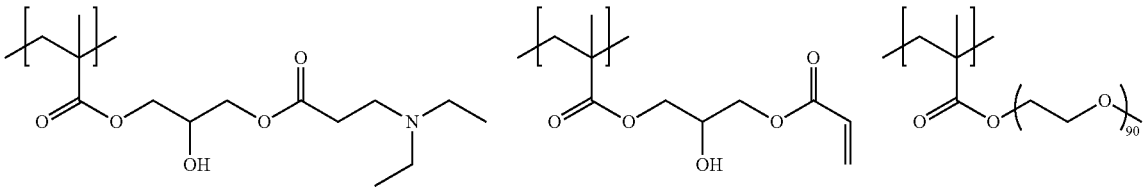
B-9
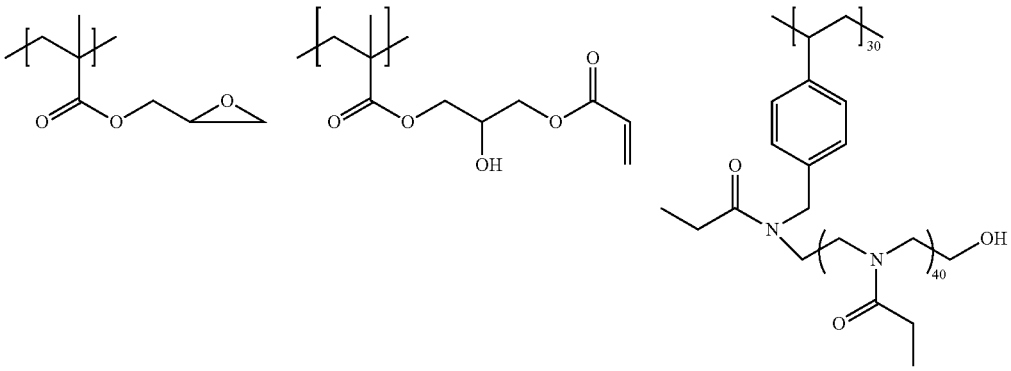
B-8-2
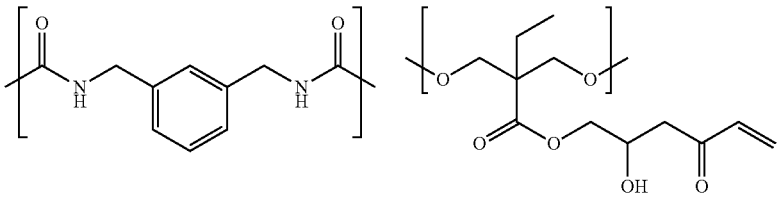
B-10
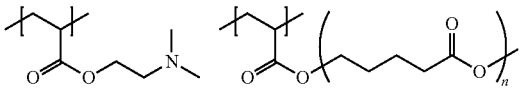
B-11
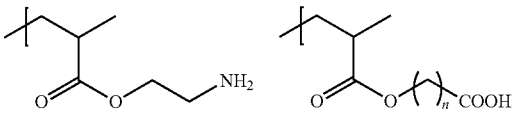
B-14
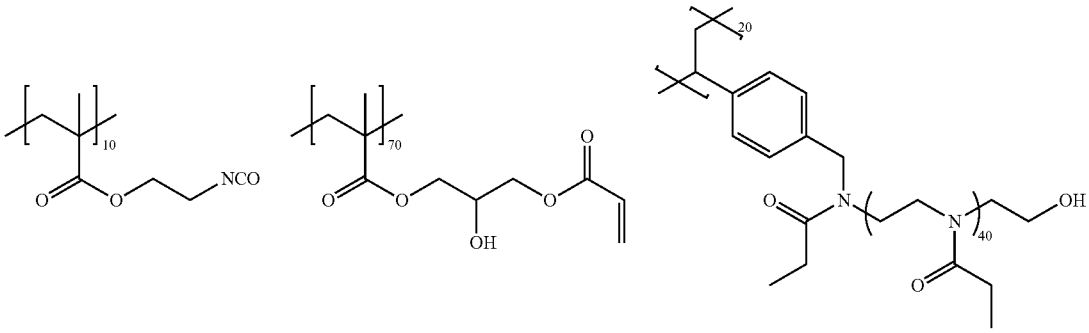
B-17
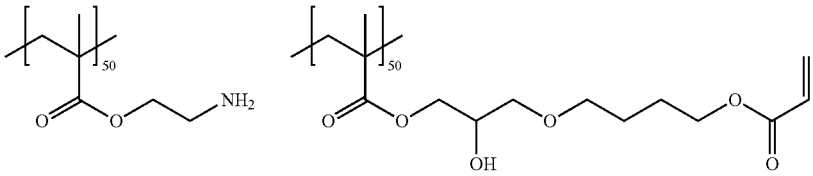

-continued

B-12

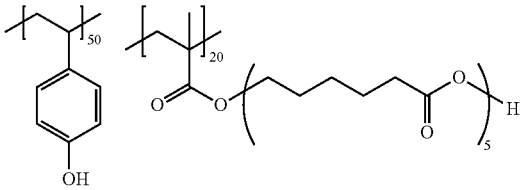

B-13

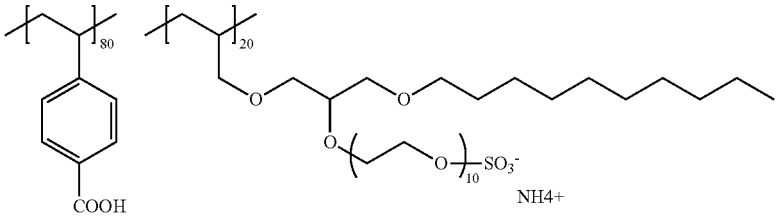

B-14

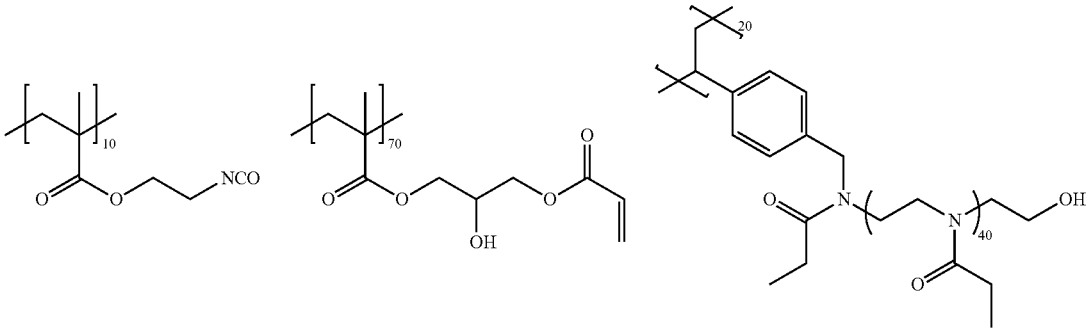

B-15

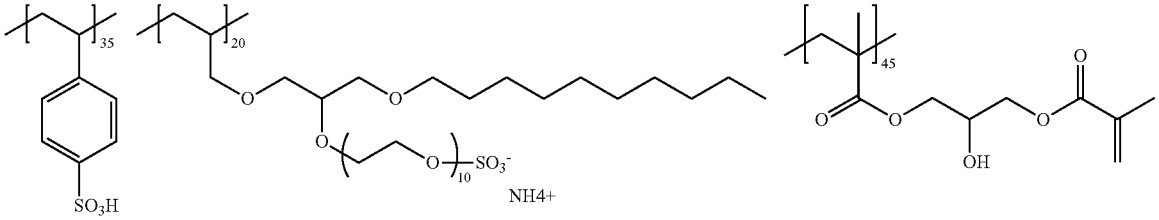

B-6-2

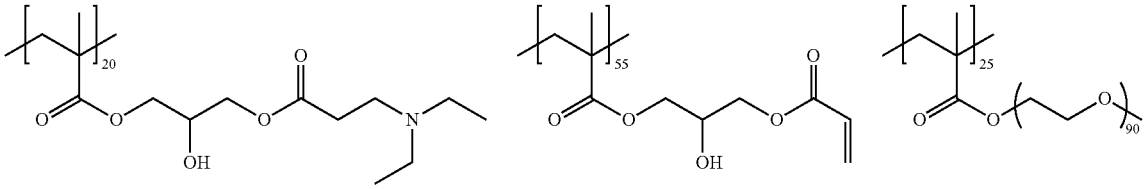

In addition, * in B-8 represents a bonding position with respect to the polymer chain shown on the left side.

Further, in the specific examples, the content of each constitutional unit can be appropriately changed based on the preferable range of the content of each constitutional unit described above.

Further, the weight-average molecular weight of each compound shown in the specific examples above can be appropriately changed based on the preferable range of the weight-average molecular weight of the resin B described above.

—Content of Core-Shell Particle—

The image recording layer may contain only one or a combination of two or more kinds of core-shell particles.

From the viewpoint of the UV printing durability, the content of the core-shell particle is preferably in a range of 5% by mass to 90% by mass, more preferably in a range of 10% by mass to 80% by mass, and still more preferably in a range of 10% by mass to 60% by mass with respect to the total mass of the image recording layer.

[Polymerization Initiator]

The image recording layer used in the present disclosure contains a polymerization initiator.

The polymerizable initiator is not particularly limited, and examples thereof include an electron-accepting polymerization initiator and an electron-donating polymerization initiator.

<<Electron-Accepting Polymerization Initiator>>

From the viewpoint of the UV printing durability, it is preferable that the image recording layer contains an electron-accepting polymerization initiator.

The electron-accepting polymerization initiator used in the present disclosure is a compound that generates polymerization initiating species such as a radical or a cation by light, heat, or the energy of both light and heat and can be appropriately selected from known thermal polymerization initiators, compounds having bonds with small bond dissociation energy, and photopolymerization initiators and then used.

As the electron-accepting polymerization initiator, a radical polymerization initiator is preferable, and an onium compound is more preferable.

Further, an infrared photosensitive polymerization initiator is preferable as the electron-accepting polymerization initiator.

The electron-accepting polymerization initiator may be used alone or in combination of two or more kinds thereof.

Examples of the radical polymerization initiator include an organic halide (a), a carbonyl compound (b), an azo compound (c), an organic peroxide (d), a metallocene compound (e), an azide compound (f), a hexaaryl biimidazole compound (g), a disulfone compound (i), an oxime ester compound (j), and an onium compound (k).

As the organic halide (a), for example, the compounds described in paragraphs 0022 to 0023 of JP2008-195018A are preferable.

As the carbonyl compound (b), for example, the compounds described in paragraph 0024 of JP2008-195018A are preferable.

As the azo compound (c), for example, the azo compounds and the like described in JP1996-108621A (JP-H08-108621A) can be used.

As the organic peroxide (d), for example, the compounds described in paragraph 0025 of JP2008-195018A are preferable.

As the metallocene compound (e), for example, the compounds described in paragraph 0026 of JP2008-195018A are preferable.

Examples of the azide compound (f) include compounds such as 2,6-bis(4-azidobenzylidene)-4-methylcyclohexanone.

As the hexaaryl biimidazole compound (g), for example, the compounds described in paragraph 0027 of JP2008-195018A are preferable.

Examples of the disulfone compound (i) include the compounds described in JP1986-166544A (JP-S61-166544A) and JP2002-328465A.

As the oxime ester compound (j), for example, the compounds described in paragraphs 0028 to 0030 of JP2008-195018A are preferable.

Among the above-described electron-accepting polymerization initiators, an oxime ester compound and an onium compound are preferable from the viewpoint of the curability. Among these, from the viewpoint of the UV printing durability, an iodonium salt compound, a sulfonium salt compound, or an azinium salt compound is preferable, an iodonium salt compound or a sulfonium salt compound is more preferable, and an iodonium salt compound is still more preferable.

Hereinafter, specific examples of these compounds will be described, but the present disclosure is not limited thereto.

As an example of the iodonium salt compound, a diaryl iodonium salt compound is preferable, and particularly a diphenyl iodonium salt compound substituted with an electron-donating group such as an alkyl group or an alkoxyl group is more preferable. Further, an asymmetric diphenyl iodonium salt compound is preferable. Specific examples thereof include diphenyliodonium=hexafluorophosphate, 4-methoxyphenyl-4-(2-methylpropyl)phenyliodonium=hexafluorophosphate, 4-(2-methylpropyl)phenyl-p-tolyliodonium=hexafluorophosphate, 4-hexyloxyphenyl-2,4,6-trimethoxyphenyliodonium=hexafluorophosphate, 4-hexyloxyphenyl-2,4-diethoxyphenyliodonium=tetrafluoroborate, 4-octyloxyphenyl-2,4,6-trimethoxyphenyliodonium=1-perfluorobutane sulfonate, 4-octyloxyphenyl-2,4,6-trimethoxyphenyliodonium=hexafluorophosphate, and bis(4-t-butylphenyl)iodonium=hexafluorophosphate.

As an example of the sulfonium salt compound, a triarylsulfonium salt compound is preferable, a triarylsulfonium salt compound in which at least some groups on an aromatic ring such as electron-withdrawing groups have been substituted with halogen atoms is particularly preferable, and a triarylsulfonium salt compound in which the total number of halogen atoms substituted on an aromatic ring is 4 or greater is still more preferable. Specific examples thereof include triphenylsulfonium=hexafluorophosphate, triphenylsulfonium=benzoylformate, bis(4-chlorophenyl)phenylsulfonium=benzoylformate, bis(4-chlorophenyl)-4-methylphenylsulfonium=tetrafluoroborate, tris(4-chlorophenyl)sulfonium=3,5-bis(methoxycarbonyl)benzene sulfonate, tris(4-chlorophenyl)sulfonium=hexafluorophosphate, and tris(2,4-dichlorophenyl)sulfonium=hexafluorophosphate.

Further, as the counter anion of the iodonium salt compound and the sulfonium salt compound, a sulfonamide anion or a sulfonimide anion is preferable, and a sulfonimide anion is more preferable.

As the sulfonamide anion, an aryl sulfonamide anion is preferable.

Further, as the sulfonimide anion, a bisaryl sulfonimide anion is preferable.

Specific examples of the sulfonamide anion or the sulfonimide anion are shown below, but the present disclosure is not limited thereto. In the specific examples below, Ph represents a phenyl group, Me represents a methyl group, and Et represents an ethyl group.

I-1

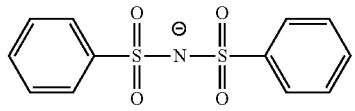

I-2

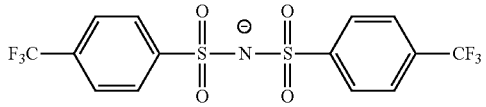

I-3

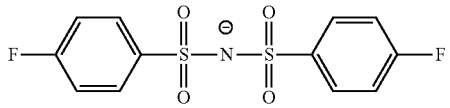

I-4

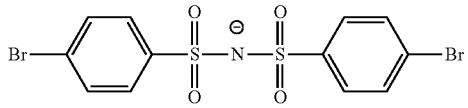

I-5

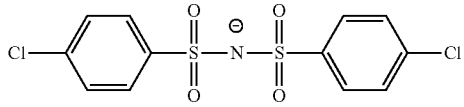

-continued
I-6
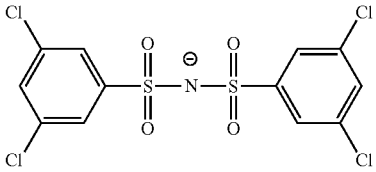
I-7
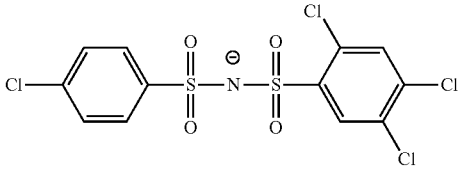
I-8
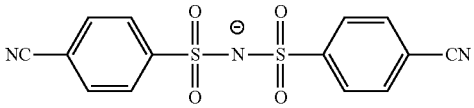
I-9
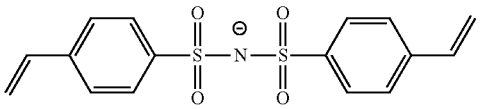
I-10
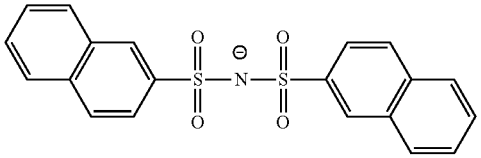
I-11
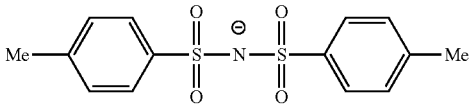
I-12
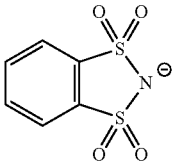
I-13
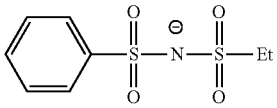
I-14
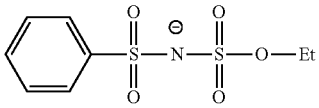
I-15
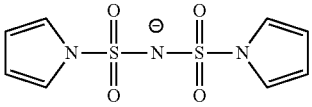
I-16
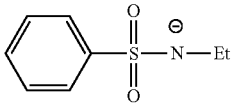
-continued
I-17
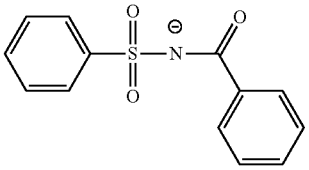
I-18
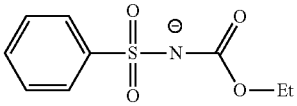
I-19
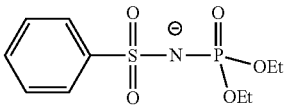
I-20
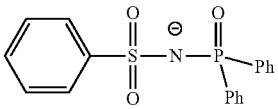
I-21
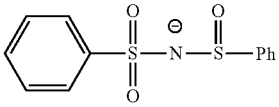
I-22
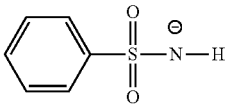
I-23
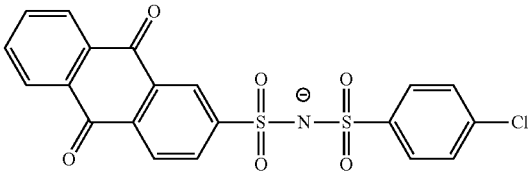
I-24
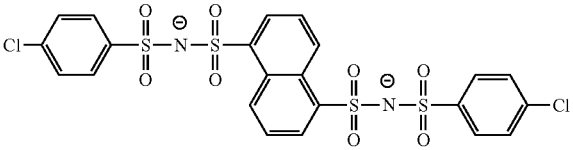
I-25
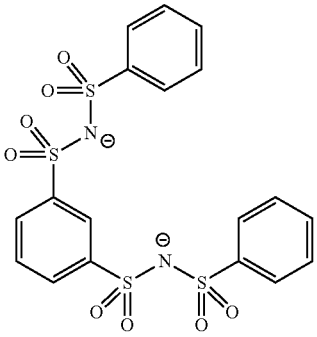

-continued

I-26

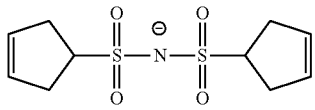

From the viewpoints of the chemical resistance and the UV printing durability, the lowest unoccupied molecular orbital (LUMO) of the electron-accepting polymerization initiator is preferably −3.00 eV or less and more preferably −3.02 eV or less.

Further, the lower limit thereof is preferably −3.80 eV or greater and more preferably −3.60 eV or greater.

The content of the electron-accepting polymerization initiator is preferably in a range of 0.1% by mass to 50% by mass, more preferably in a range of 0.5% by mass to 30% by mass, and particularly preferably in a range of 0.8% by mass to 20% by mass with respect to the total mass of the image recording layer.

<<Electron-Donating Polymerization Initiator>>

From the viewpoint of contributing to improvement of the UV printing durability and the chemical resistance of the planographic printing plate, the polymerization initiator further contains preferably an electron-donating polymerization initiator and more preferably both an electron-donating polymerization initiator and the electron-accepting polymerization initiator described above.

Examples of the electron-donating polymerization initiator include the following 5 kinds of agents.

(i) Alkyl or arylate complex: It is considered that a carbon-hetero bond is cleaved by oxidation to generate an active radical. Specific examples thereof include a borate compound.

(ii) Aminoacetic acid compound: It is considered that a C—X bond on a carbon adjacent to nitrogen is cleaved by oxidation to generate an active radical. It is preferable that X represents a hydrogen atom, a carboxy group, a trimethylsilyl group, or a benzyl group. Specific examples thereof include N-phenylglycines (the phenyl group may have a substituent) and N-phenyliminodiacetic acid (the phenyl group may have a substituent).

(iii) Sulfur-containing compound: The nitrogen atom of the above-described aminoacetic acid compound can be replaced with a sulfur atom to generate an active radical by the same action as described above. Specific examples thereof include phenylthioacetic acid (the phenyl group may have a substituent).

(iv) Tin-containing compound: The nitrogen atom of the above-described aminoacetic acid compound can be replaced with a tin atom to generate an active radical by the same action as described above.

(v) Sulfinates: An active radical can be generated by oxidation. Specific examples thereof include sodium arylsulfinate.

Among these electron-donating polymerization initiators, it is preferable that the image recording layer contains a borate compound. As the borate compound, a tetraaryl borate compound or a monoalkyltriaryl borate compound is preferable. Further, from the viewpoint of the stability of the compound, a tetraaryl borate compound is more preferable, and a tetraphenyl borate compound is particularly preferable.

The counter cation of the borate compound is not particularly limited, and an alkali metal ion or a tetraalkylammonium ion is preferable, and a sodium ion, a potassium ion, or a tetrabutylammonium ion is more preferable.

Specific preferred examples of the borate compound include sodium tetraphenyl borate.

Further, from the viewpoints of the chemical resistance and the UV printing durability, the highest occupied molecular orbital (HOMO) of the electron-donating polymerization initiator used in the present disclosure is preferably −6.00 eV or greater, more preferably −5.95 eV or greater, and still more preferably −5.93 eV or greater.

Further, the upper limit thereof is preferably −5.00 eV or less and more preferably −5.40 eV or less.

In the present disclosure, the highest occupied molecular orbital (HOMO) and the lowest unoccupied molecular orbital (LUMO) are calculated by the following method.

First, the counter anion in the compound to be calculated is ignored.

Quantum chemistry calculation software Gaussian09 is used, and structural optimization is performed by DFT (B3LYP/6-31G (d)).

The molecular orbital (MO) energy calculation is performed by DFT (B3LYP/6-31+G (d, p)/CPCM (solvent=methanol)) using the structure obtained by the structural optimization described above.

The MO energy Ebare (unit: hartree) obtained by the MO energy calculation is converted to Escaled (unit: eV) used as the values of HOMO and LUMO in the present disclosure according to the following equation.

$$E\text{scaled}=0.823168\times 27.2114\times E\text{bare}-1.07634$$

Further, 27.2114 is a coefficient for simply converting hartree to eV, 0.823168 and −1.07634 are adjustment coefficients for determining the calculation of HOMO and LUMO of the compound to be calculated so as to match measured values.

B-1 to B-8 and other compounds are shown below as specific preferred examples of the electron-donating polymerization initiator, but it goes without saying that the present invention is not limited thereto. Further, in the following chemical formulae, Bu represents an n-butyl group, and Z represents a counter cation.

Examples of the counter cation represented by $Z^+$ include $Na^+$, $K^+$, and $N^+(Bu)_4$. Further, Bu represents an n-butyl group.

Further, suitable examples of the counter cation represented by $Z^+$ include an onium ion in the electron-accepting polymerization initiator described above.

B-1

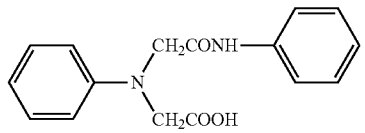

B-2

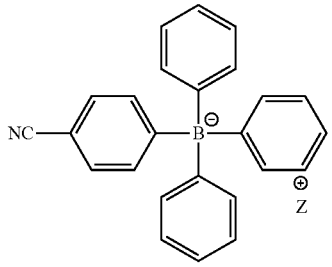

HOMO = -6.052eV

-continued
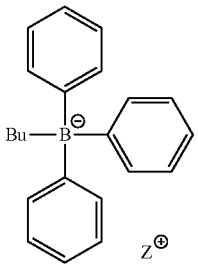
HOMO = -5.772eV
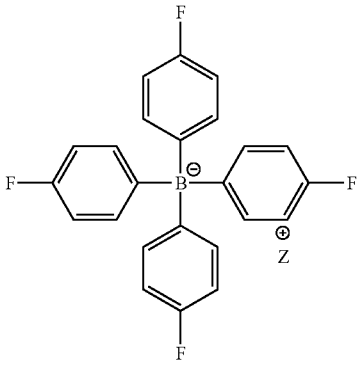
HOMO = -5.957eV
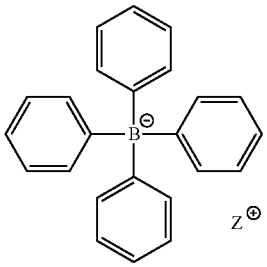
HOMO = -5.905eV
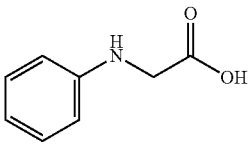
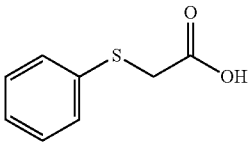
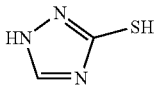
-continued
B-3
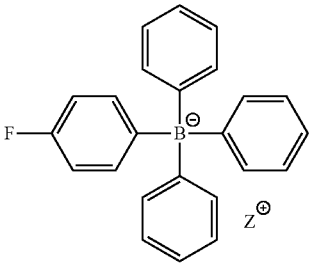
B-4
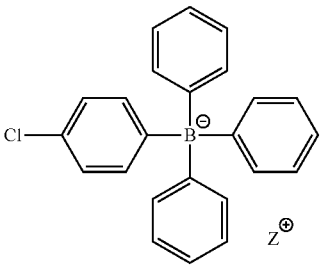
B-5
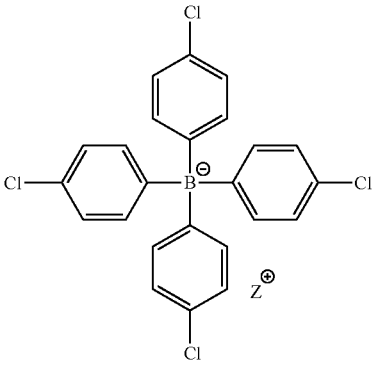
B-6
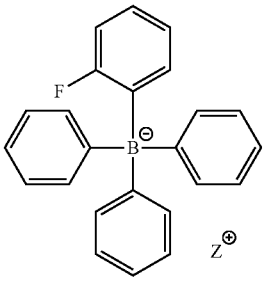
B-7
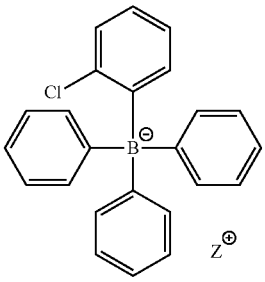
B-8

-continued
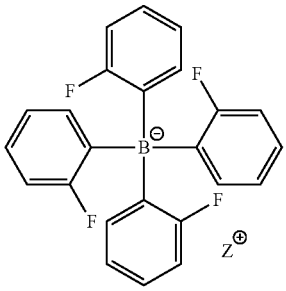
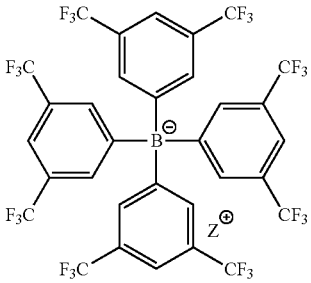
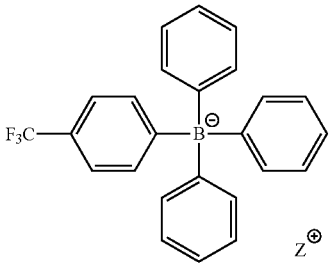
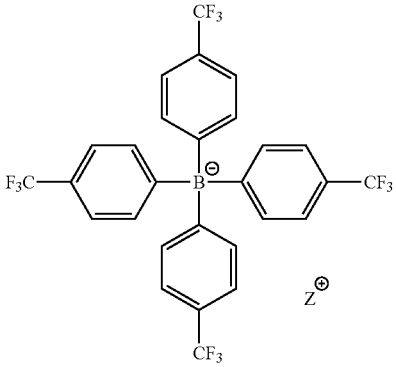
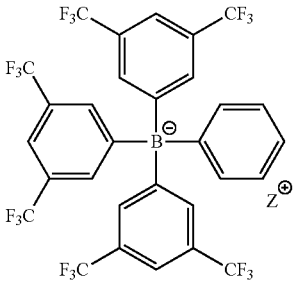
-continued
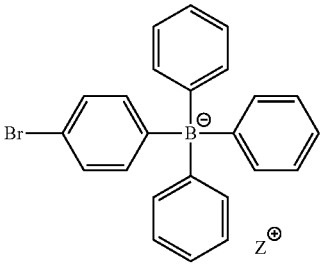
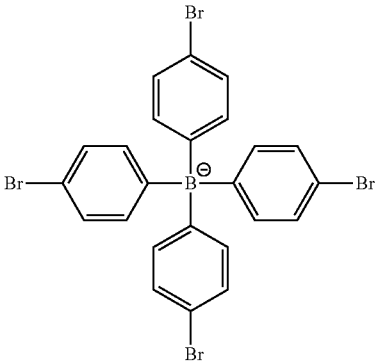
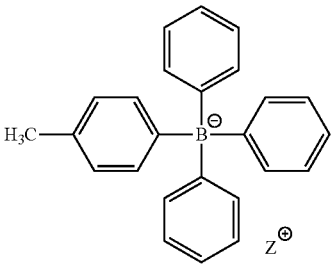
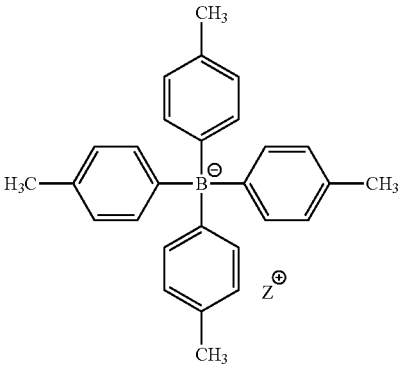
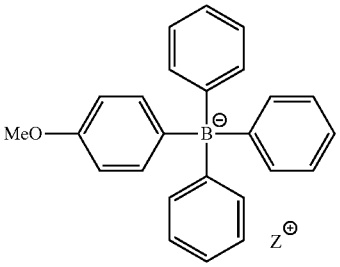
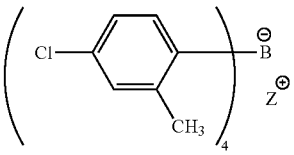

-continued

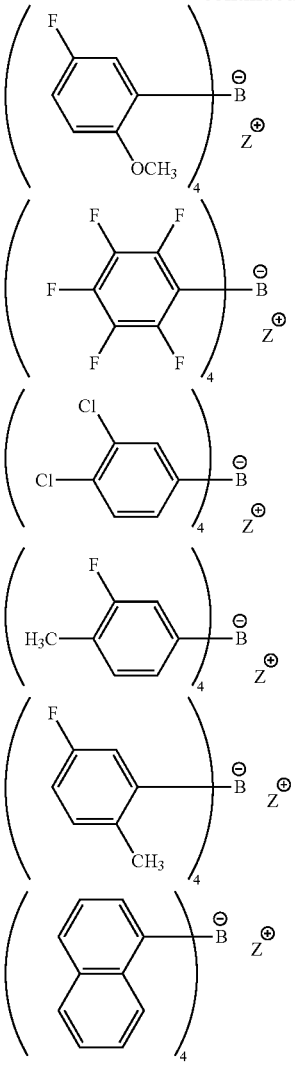

The electron-donating polymerization initiator may be used alone or in combination of two or more kinds thereof.

The content of the electron-donating polymerization initiator is preferably in a range of 0.01% by mass to 30% by mass, more preferably in a range of 0.05% by mass to 25% by mass, and still more preferably in a range of 0.1% by mass to 20% by mass with respect to the total mass of the image recording layer.

Further, one preferred embodiment in the present disclosure is an embodiment in which the electron-accepting polymerization initiator and the electron-donating polymerization initiator form a salt.

Specific examples thereof include an embodiment in which the onium compound is a salt of an onium ion and an anion (for example, a tetraphenylborate anion) in the electron-donating polymerization initiator. Further, more preferred examples thereof include an iodonium borate compound in which an iodonium cation (for example, a di-p-tolyl iodonium cation) in the iodonium salt compound and a borate anion in the electron-donating polymerization initiator form a salt.

Specific examples of the embodiment in which the electron-accepting polymerization initiator and the electron-donating polymerization initiator form a salt are shown below, but the present disclosure is not limited thereto.

(IA-1)

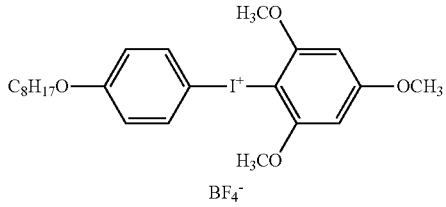

(IA-2)

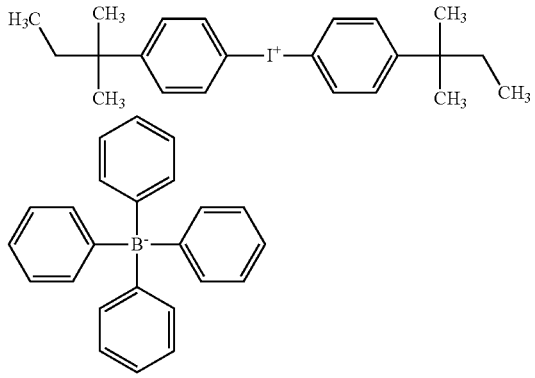

(IA-3)

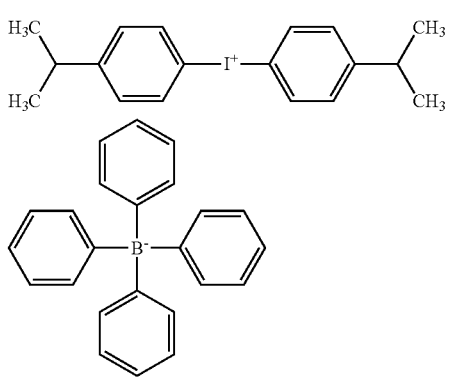

(IA-4)

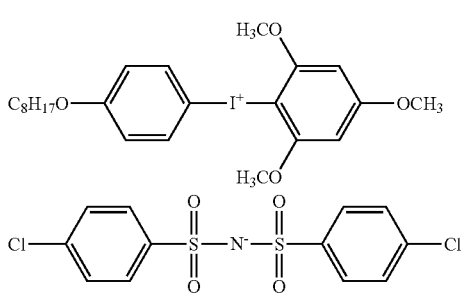

(IA-5)

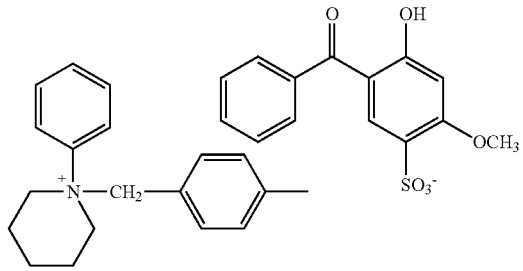

In the present disclosure, in a case where the image recording layer contains an onium ion and an anion in the above-described electron-donating polymerization initiator, the image recording layer is designed to contain an electron-accepting polymerization initiator and an electron-donating polymerization initiator.

[Infrared Absorbing Agent]

The image recording layer contains an infrared absorbing agent.

The infrared absorbing agent is not particularly limited, and examples thereof include pigments and dyes.

As dyes used as infrared absorbing agents, commercially available dyes and known dyes described in the literatures such as "Dye Handbook" (edited by the Society of Synthetic Organic Chemistry, Japan, published in 1970) can be used. Specific examples thereof include dyes such as an azo dye, a metal complex salt azo dye, a pyrazolone azo dye, a naphthoquinone dye, an anthraquinone dye, a phthalocyanine dye, a carbonium dye, a quinone imine dye, a methine dye, a cyanine dye, a squarylium coloring agent, a pyrylium salt, and a metal thiolate complex.

Among the above-described dyes, a cyanine coloring agent, a squarylium coloring agent, a pyrylium salt, a nickel thiolate complex, and an indolenine cyanine coloring agent are particularly preferable. Further, other examples thereof include a cyanine coloring agent and an indolenine cyanine coloring agent. Among these, a cyanine coloring agent is particularly preferable.

As the infrared absorbing agent, a cationic polymethine coloring agent having an oxygen atom or a nitrogen atom at the meso position is preferable. Preferred examples of the cationic polymethine coloring agent include a cyanine coloring agent, a pyrylium coloring agent, a thiopyrylium coloring agent, and an azulenium coloring agent. Among these, from the viewpoints of the availability and the solvent solubility during the introduction reaction, a cyanine coloring agent is preferable.

Specific examples of the cyanine coloring agent include compounds described in paragraphs 0017 to 0019 of JP2001-133969A and compounds described in paragraphs 0016 to 0021 of JP2002-023360A and paragraphs 0012 to 0037 of JP2002-040638A, preferred examples thereof include compounds described in paragraphs 0034 to 0041 of JP2002-278057A and paragraphs 0080 to 0086 of JP2008-195018A, and particularly preferred examples thereof include compounds described in paragraphs 0035 to 0043 of JP2007-90850A and compounds described in paragraphs 0105 to 0113 of JP2012-206495A.

Further, compounds described in paragraphs 0008 and 0009 of JP1993-5005A (JP-HOS-5005A) and paragraphs 0022 to 0025 of JP2001-222101A can be preferably used.

As the pigments, compounds described in paragraphs 0072 to 0076 of JP2008-195018A are preferable.

The infrared absorbing agent may be used alone or in combination of two or more kinds thereof. Further, pigments and dyes may be used in combination as the infrared absorbing agent.

The content of the infrared absorbing agent in the image recording layer is preferably in a range of 0.1% by mass to 10.0% by mass and more preferably in a range of 0.5% by mass to 5.0% by mass with respect to total mass of the image recording layer.

[Relationship Between Electron-Donating Polymerization Initiator, Electron-Accepting Polymerization Initiator, and Infrared Absorbing Agent]

The image recording layer according to the present disclosure contains the electron-donating polymerization initiator, the electron-accepting polymerization initiator, and the infrared absorbing agent, and the HOMO of the electron-donating polymerization initiator is preferably −6.0 eV or greater, and the LUMO of the electron-accepting polymerization initiator is preferably −3.0 eV or less.

More preferable embodiments of the HOMO of the electron-donating polymerization initiator and the LUMO electron-accepting polymerization initiator are the same as described above.

In the image recording layer of the present disclosure, it is assumed that the electron-donating polymerization initiator, the infrared absorbing agent, and the electron-accepting polymerization initiator perform energy delivery as described in the following chemical formula.

Therefore, it is considered that in a case where the HOMO of the electron-donating polymerization initiator is −6.0 eV or greater and the LUMO of the electron-accepting polymerization initiator is −3.0 eV or less, the radical generation efficiency is improved, and thus the chemical resistance and the UV printing durability are more excellent.

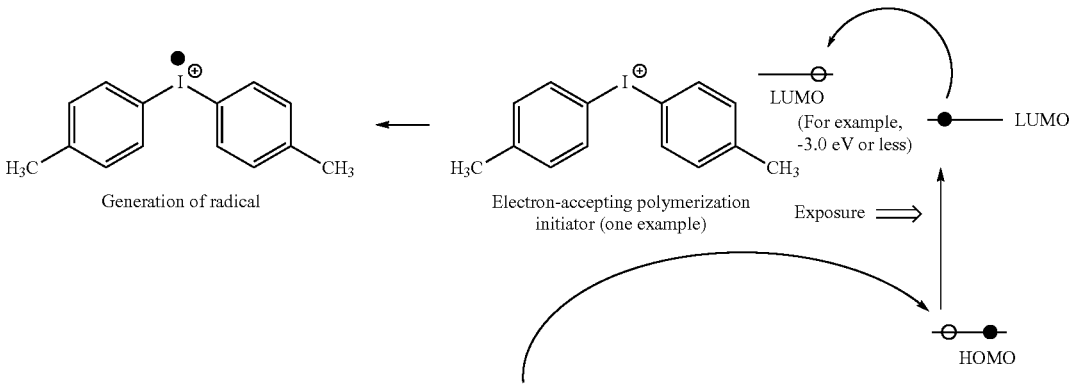

-continued

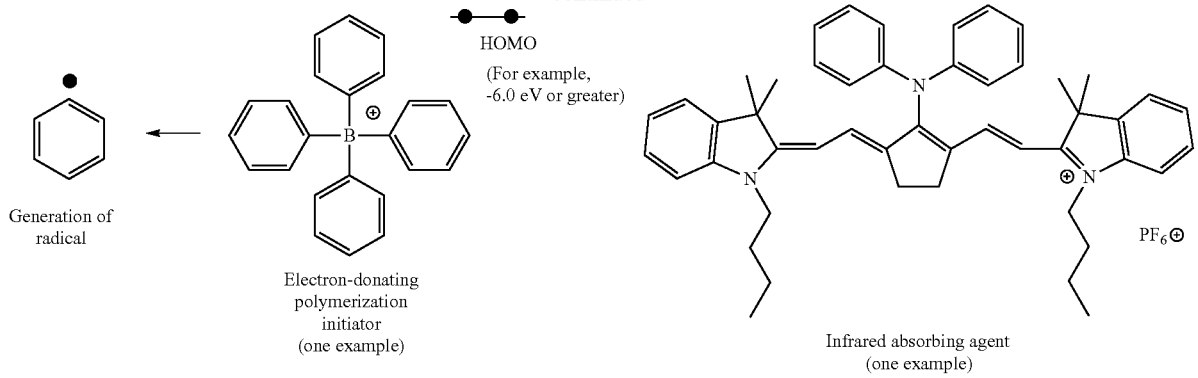

From the viewpoints of the UV printing durability and the chemical resistance, a difference between the HOMO of the electron-donating polymerization initiator and the HOMO of the infrared absorbing agent is preferably 1.00 eV or less and more preferably 0.700 eV or less. Further, from the same viewpoint as described above, the difference between the HOMO of the electron-donating polymerization initiator and the HOMO of the infrared absorbing agent is preferably −0.200 eV or greater and more preferably −0.100 eV or greater.

Further, from the same viewpoint as described above, the difference between the HOMO of the electron-donating polymerization initiator and the HOMO of the infrared absorbing agent is preferably in a range of 1.00 eV to −0.200 eV and more preferably in a range of 0.700 eV to −0.100 eV. Further, the negative values indicate that the HOMO of the electron-donating polymerization initiator is greater than the HOMO of the infrared absorbing agent.

Further, from the viewpoints of the UV printing durability and the chemical resistance, a difference between the LUMO of the infrared absorbing agent and the LUMO of the electron-accepting polymerization initiator is preferably 1.00 eV or less and more preferably 0.700 eV or less. Further, from the same viewpoint as described above, the difference between the LUMO of the infrared absorbing agent and the LUMO of the electron-accepting polymerization initiator is preferably −0.200 eV or greater and more preferably −0.100 eV or greater.

Further, from the same viewpoint as described above, the difference between the LUMO of the infrared absorbing agent and the LUMO of the electron-accepting polymerization initiator is preferably in a range of 1.00 eV to −0.200 eV and more preferably in a range of 0.700 eV to −0.100 eV. Further, the negative values indicate that the LUMO of the infrared absorbing agent is greater than the LUMO of the electron-accepting polymerization initiator.

[Polymerizable Compound]

It is preferable that the image recording layer of the present disclosure contains a polymerizable compound. In the present disclosure, the polymerizable compound indicates a compound containing a polymerizable group.

In the present disclosure, even in a case of compounds having polymerizability, compounds corresponding the resin A and the resin B contained in the above-described core-shell particle, a polymer particle other than the core-shell particle described below, and a binder polymer other than the resin A and the resin B described below are designed not to correspond to polymerizable compounds.

The polymerizable group is not particularly limited as long as a known polymerizable group is used, and an ethylenically unsaturated group is preferable.

Further, the polymerizable group may be a radically polymerizable group or a cationically polymerizable group, but a radically polymerizable group is preferable.

Examples of the radically polymerizable group include a (meth)acryloyl group, an allyl group, a vinylphenyl group, and a vinyl group. Among these, from the viewpoint of the reactivity, a (meth)acryloyl group is preferable.

The molecular weight (the weight-average molecular weight in a case of having a molecular weight distribution) of the polymerizable compound is preferably 50 or greater and less than 2500 and more preferably in a range of 50 to 2000.

The polymerizable compound used in the present disclosure may be, for example, a radically polymerizable compound or a cationically polymerizable compound, but it is preferable that the polymerizable compound is an addition polymerizable compound having at least one ethylenically unsaturated bond (ethylenically unsaturated compound). As the ethylenically unsaturated compound, a compound having at least one terminal ethylenically unsaturated bond is preferable, and a compound having two or more terminal ethylenically unsaturated bonds is more preferable. The polymerizable compound may have a chemical form such as a monomer, a pre-polymer, that is, a dimer, a trimer, or an oligomer, or a mixture thereof —Oligomer—

It is preferable that the polymerizable compound contained in the image recording layer contains an oligomer.

In the present disclosure, the oligomer indicates a polymerizable compound having a molecular weight (a weight-average molecular weight in a case of having a molecular weight distribution) of 600 to 10000 and containing at least one polymerizable group.

From the viewpoints of the chemical resistance, the UV printing durability, and the property of suppressing on-press development scum, the molecular weight of the oligomer is preferably in a range of 1000 to 5000.

Further, from the viewpoint of improving the chemical resistance and the UV printing durability, the number of polymerizable groups in one molecule of the oligomer is preferably 2 or greater, more preferably 3 or greater, still more preferably 6 or greater, and particularly preferably 10 or greater.

Further, the upper limit of the number of polymerizable groups in the oligomer is not particularly limited, but the number of polymerizable groups is preferably 20 or less.

From the viewpoint that the chemical resistance, the UV printing durability, and the property of suppressing on-press development scum are more excellent, an oligomer having 7 or more polymerizable groups and a molecular weight of 1000 to 10000 is preferable, and an oligomer having 7 to 20 polymerizable groups and a molecular weight of 1000 to 5000 is more preferable.

From the viewpoint that the chemical resistance and the UV printing durability are more excellent, the oligomer contains preferably at least one selected from the group consisting of a compound having a urethane bond, a compound having an ester bond, and a compound having an epoxy residue and more preferably a compound having a urethane bond.

The epoxy residue in the present specification indicates a structure formed of an epoxy group and means, for example, the same structure as the structure obtained by the reaction between an acid group (a carboxy group or the like) and an epoxy group.

<<Compound Having Urethane Bond>>

The compound having a urethane bond is not particularly limited, and examples thereof include a compound obtained by reacting a polyisocyanate compound with a compound containing a hydroxy group and a polymerizable group.

Examples of the polyisocyanate compound include bifunctional to pentafunctional polyisocyanate compounds. Among these, a bifunctional or trifunctional polyisocyanate compound is preferable.

Preferred examples of the polyisocyanate compound include 1,3-bis(isocyanatomethyl)cyclohexane, isophorone diisocyanate, trimethylene diisocyanate, tetramethylene diisocyanate, pentamethylene diisocyanate, hexamethylene diisocyanate, 1,3-cyclopentane diisocyanate, 9H-fluorene-2,7-diisocyanate, 9H-fluorene-9-one-2,7-diisocyanate, 4,4'-diphenylmethane diisocyanate, 1,3-phenylene diisocyanate, tolylene-2,4-diisocyanate, tolylene-2,6-diisocyanate, 1,3-bis(isocyanatomethyl)cyclohexane, 2,2-bis(4-isocyanatophenyl)hexafluoropropane, 1,5-diisocyanatonaphthalene, dimers of these polyisocyanates, and trimmers (isocyanurate bond) thereof. Further, a biuret product obtained by reacting the above-described polyisocyanate compound with a known amine compound may be used.

As the compound containing a hydroxy group and a polymerizable group, a compound containing one hydroxy group and one or more polymerizable groups is preferable, and a compound containing one hydroxy group and two or more polymerizable groups is more preferable.

Examples of the compound containing a hydroxy group and a polymerizable group include hydroxyethyl (meth) acrylate, glycerin di(meth)acrylate, trimethylolpropane di(meth)acrylate, pentaerythritol tri(meth)acrylate, and dipentaerythritol penta(meth)acrylate.

As the compound having a urethane bond, for example, a compound containing at least a group represented by Formula (Ac-1) or Formula (Ac-2) is preferable, and a compound containing at least a group represented by Formula (Ac-1) is more preferable.

(Ac-1)

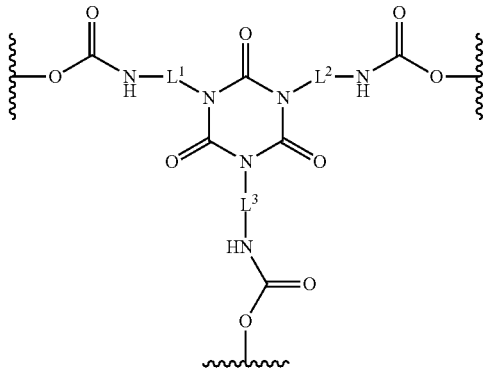

(Ac-2)

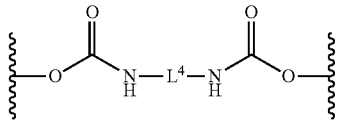

In Formulae (Ac-1) and (Ac-2), $L^1$ to $L^4$ each independently represent a divalent hydrocarbon group having 2 to 20 carbon atoms, and the wavy line represents a bonding position with respect to another structure.

$L^1$ to $L^4$ each independently represent preferably an alkylene group having 2 to 20 carbon atoms, more preferably an alkylene group having 2 to 10 carbon atoms, and still more preferably an alkylene group having 4 to 8 carbon atoms. Further, the alkylene group may have a branched or ring structure, but it is preferable that the alkylene group is a linear alkylene group.

It is preferable that each wavy line in Formula (Ac-1) or Formula (Ac-2) is independently bonded directly to the wavy line in a group represented by Formula (Ae-1) or Formula (Ae-2).

(Ae-1)

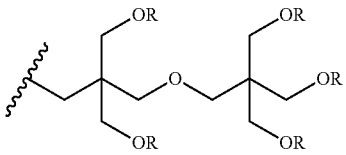

(Ae-2)

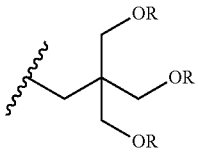

In Formulae (Ae-1) and (Ae-2), R's each independently represent an acryloyloxy group or a methacryloyloxy group, and the wavy line represents a bonding position with respect to the wavy line in Formulae (Ac-1) and (Ac-2).

Further, as the compound having a urethane bond, a compound in which a polymerizable group is introduced to polyurethane obtained by the reaction between a polyisocyanate compound and a polyol compound through a polymer reaction may be used. For example, a compound having a urethane bond may be obtained by reacting a compound that contains an epoxy group and a polymerizable group with a polyurethane oligomer obtained by reacting a polyol compound containing an acid group with a polyisocyanate compound.

<<Compound Having Ester Bond>>

The number of polymerizable groups in the compound having an ester bond is preferably 3 or greater and more preferably 6 or greater.

<<Compound Having Epoxy Residue>>

As the compound having an epoxy residue, a compound containing a hydroxy group in the compound is preferable.

Further, the number of polymerizable groups in the compound having an epoxy residue is preferably in a range of 2 to 6 and more preferably 2 or 3.

The compound having an epoxy residue can be obtained, for example, by reacting acrylic acid with a compound containing an epoxy group.

From the viewpoint of improving the chemical resistance, the UV printing durability, and the property of suppressing on-press development scum, the content of the oligomer is preferably in a range of 30% by mass and 100% by mass, more preferably in a range of 50% by mass to 100% by mass, and still more preferably in a range of 80% by mass to 100% by mass with respect to the total mass of the polymerizable compound in the image recording layer.

The polymerizable compound may further contain a polymerizable compound other than the oligomer described above.

The polymerizable compound other than the oligomer may be, for example, a radically polymerizable compound or a cationically polymerizable compound, but it is preferable that the polymerizable compound is an addition polymerizable compound having at least one ethylenically unsaturated group (ethylenically unsaturated compound). As the ethylenically unsaturated compound, a compound containing at least one ethylenically unsaturated group at the terminal is preferable, and a compound containing two or more ethylenically unsaturated groups at the terminal is more preferable.

From the viewpoint of the chemical resistance, it is preferable that the polymerizable compound other than the oligomer is a low-molecular-weight polymerizable compound. The low-molecular-weight polymerizable compound may have a chemical form such as a monomer, a dimer, a trimer, or a mixture thereof.

Further, from the viewpoint of the chemical resistance, at least one polymerizable compound selected from the group consisting of a polymerizable compound containing three or more ethylenically unsaturated groups and a polymerizable compound having an isocyanuric ring structure is preferable as the low-molecular-weight polymerizable compound.

In the present disclosure, the low-molecular-weight polymerizable compound indicates a polymerizable compound having a molecular weight (a weight-average molecular weight in a case of having a molecular weight distribution) of 50 or greater and less than 600.

From the viewpoint that the chemical resistance, the UV printing durability, and the property of suppressing on-press development scum are excellent, the molecular weight of the low-molecular-weight polymerizable compound is preferably 100 or greater and less than 600, more preferably 300 or greater and less than 600, and still more preferably 400 or greater and less than 600.

In a case where the polymerizable compound includes a low-molecular-weight polymerizable compound as a polymerizable compound other than the oligomer (the total amount in a case where the polymerizable compound includes two or more kinds of low-molecular-weight polymerizable compounds), from the viewpoints of the chemical resistance, the UV printing durability, and the property of suppressing on-press development scum, the ratio of the oligomer to the low-molecular-weight polymerizable compound (oligomer/low-molecular-weight polymerizable compound) is preferably in a range of 10/1 to 1/10, more preferably in a range of 10/1 to 3/7, and still more preferably in a range of 10/1 to 7/3 on a mass basis.

Examples of the polymerizable compound include unsaturated carboxylic acids (for example, acrylic acid, methacrylic acid, itaconic acid, crotonic acid, isocrotonic acid, and maleic acid), esters thereof, and amides thereof. Among these, esters of unsaturated carboxylic acids and polyhydric alcohol compounds, and amides of unsaturated carboxylic acids and polyhydric amine compounds are preferably used. Further, an addition reaction product of unsaturated carboxylic acid esters having a nucleophilic substituent such as a hydroxy group, an amino group, or a mercapto group or amides with monofunctional or polyfunctional isocyanates or epoxies, and a dehydration condensation reaction product with a monofunctional or polyfunctional carboxylic acid are also suitably used. Further, an addition reaction product of unsaturated carboxylic acid esters having an electrophilic substituent such as an isocyanate group or an epoxy group or amides with monofunctional or polyfunctional alcohols, amines, and thiols, and a substitution reaction product of unsaturated carboxylic acid esters having a releasable substituent such as a halogen atom or a tosyloxy group or amides with monofunctional or polyfunctional alcohols, amines, and thiols are also suitable. As another example, a compound group in which the unsaturated carboxylic acid is substituted with unsaturated phosphonic acid, styrene, vinyl ether, or the like can also be used. These compounds are described in JP2006-508380A, JP2002-287344A, JP2008-256850A, JP2001-342222A, JP1997-179296A (JP-H09-179296A), JP1997-179297A (JP-H09-179297A), JP1997-179298A (JP-H09-179298A), JP2004-294935A, JP2006-243493, JP2002-275129A, JP2003-64130A, JP2003-280187A, and JP1998-333321A (JP-H10-333321A).

Specific examples of the monomer of the ester of a polyhydric alcohol compound and an unsaturated carboxylic acid include acrylic acid ester such as ethylene glycol diacrylate, 1,3-butanediol diacrylate, tetramethylene glycol diacrylate, propylene glycol diacrylate, trimethylolpropane triacrylate, hexanediol diacrylate, tetraethylene glycol diacrylate, pentaerythritol tetraacrylate, sorbitol triacrylate, isocyanuric acid ethylene oxide (EO) modified triacrylate, and a polyester acrylate oligomer. Examples of the methacrylic acid ester include tetramethylene glycol dimethacrylate, neopentyl glycol dimethacrylate, trimethylolpropane trimethacrylate, ethylene glycol dimethacrylate, pentaerythritol trimethacrylate, bis[p-(3-methacryloxy-2-hydroxypropoxy)phenyl]dimethylmethane, and bis[p-(methacryloxyethoxy)phenyl]dimethylmethane. Further, specific examples of the monomer of the amide of a polyvalent amine compound and an unsaturated carboxylic acid include methylene bisacrylamide, methylene bismethacrylamide, 1,6-hexamethylene bisacrylamide, 1,6-hexamethylene bismethacrylamide, diethylenetriamine trisacrylamide, xylylene bisacrylamide, and xylylene bismethacrylamide.

Further, a urethane-based addition-polymerizable compound produced by the addition reaction of an isocyanate and a hydroxy group is also suitable, and specific examples thereof include a vinyl urethane compound containing two or more polymerizable vinyl groups in one molecule, which is obtained by adding a vinyl monomer containing a hydroxy group represented by Formula (M) to a polyisocyanate compound containing two or more isocyanate groups in one molecule described in JP1973-41708B (JP-S48-41708B).

$$CH_2{=}C(R^{M4})COOCH_2CH(R^{M5})OH \quad (M)$$

In Formula (M), $R^{M4}$ and $R^{M5}$ each independently represent a hydrogen atom or a methyl group.

Further, suitable examples of the urethane compound include urethane acrylates described in JP1976-37193A (JP-551-37193A), JP1990-32293B (JP-H02-32293B), JP1990-16765B (JP-H02-16765B), JP2003-344997A, and JP2006-65210A, urethane compounds having an ethylene oxide skeleton described in JP1983-49860B (JP-S58-49860B), JP1981-17654B (JP-S56-17654B), JP1987-39417B (JP-S62-39417B), JP1987-39418B (JP-S62-39418B), JP2000-250211A, and JP2007-94138A, and urethane compounds containing a hydrophilic group described in U.S. Pat. No. 7,153,632A, JP1996-505958A (JP-H08-505958A), JP2007-293221A, and JP2007-293223A.

Specific examples of the oligomer are shown below, but the oligomer used in the present disclosure is not limited thereto.

As the oligomer, a commercially available product may be used, and examples thereof include UA510H, UA-306H, UA-306I, and UA-306T (all manufactured by Kyoeisha Chemical Co., Ltd.), UV-1700B, UV-6300B, and UV7620EA (all manufactured by The Nippon Synthetic Chemical Industry Co., Ltd.), U-15HA (manufactured by Shin Nakamura Chemical Industry Co., Ltd.), and EBECRYL450, EBECRYL657, EBECRYL885, EBECRYL800, EBECRYL3416, and EBECRYL860 (all manufactured by Daicel-Allnex Ltd.), and the present disclosure is not limited thereto.

The details of the method of using the polymerizable compound such as the structure of the polymerizable compound, whether the polymerizable compound is used alone or in combination, and the amount of addition can be optionally set.

The content of the polymerizable compound is preferably in a range of 5% by mass to 75% by mass, more preferably in a range of 10% by mass to 70% by mass, and still more preferably in a range of 15% by mass to 60% by mass with respect to the total mass of the image recording layer.

Further, the content of the thermoplastic resin contained in the core-shell particle is preferably greater than 0% by mass and 400% by mass or less, more preferably in a range of 25% by mass to 300% by mass, and still more preferably in a range of 50% by mass to 200% by mass with respect to the total mass of the polymerizable compound in the image recording layer.

In the image recording layer, it is preferable that the resin and the polymerizable compound contained in the core-shell particle have a sea-island structure. For example, a structure in which the polymerizable compound is dispersed in an island shape (discontinuous layer) in the sea (continuous phase) of the thermoplastic resin can be employed. It is considered that the sea-island structure is easily formed by setting the content of the thermoplastic resin contained in the core-shell particle with respect to the total mass of the polymerizable compound to a value in the above-described range.

[Polymer Particle]

The image recording layer may contain a polymer particle. Further, the core-shell particle does not correspond to the polymer particle.

It is preferable that the polymer particle is selected from the group consisting of thermally reactive polymer particles, polymer particles containing a polymerizable group, microcapsules encapsulating a hydrophobic compound, and microgels (crosslinked polymer particles). Among these, polymer particles containing a polymerizable group and a microgel are preferable. According to a particularly preferred embodiment, the polymer particle contains at least one ethylenically unsaturated polymerizable group. Due to the presence of such a polymer particle, the effects of improving the UV printing durability of the exposed portion and the on-press developability of the unexposed portion can be obtained.

Examples of the thermally reactive polymer particles include polymer particles having a thermally reactive group. The thermally reactive polymer particles are crosslinked by a thermal reaction and have hydrophobic regions formed by a change in functional groups during the crosslinking.

As the thermally reactive group in polymer particle having a thermally reactive group, a functional group that performs any reaction may be used as long as a chemical bond is formed, but a polymerizable group is preferable. Preferred examples of the polymerizable group include an ethylenically unsaturated group that performs a radical polymerization reaction (such as an acryloyl group, a methacryloyl group, a vinyl group, or an allyl group); a cationically polymerizable group (such as a vinyl group, a vinyloxy group, an epoxy group, or an oxetanyl group); an isocyanate group that performs an addition reaction or a block body thereof, an epoxy group, a vinyloxy group, and a functional group having active hydrogen atoms as the reaction partners of these (such as an amino group, a hydroxy group, or a carboxy group); a carboxy group that performs a condensation reaction and a hydroxy group or an amino group as a reaction partner thereof; and an acid anhydride that performs a ring opening addition reaction and an amino group or a hydroxy group as a reaction partner thereof.

The microcapsule is a microcapsule in which at least a part of constituent components of the image recording layer is encapsulated as described in JP2001-277740A and JP2001-277742A. Further, the constituent components of the image recording layer may be contained in a portion other than the microcapsule. Moreover, a preferred embodiment of the image recording layer containing the microcapsule is an embodiment in which hydrophobic constituent components are encapsulated by a microcapsule and hydrophilic constituent components are contained by a portion other than the microcapsule.

The microgel (crosslinked polymer particles) may contain a part of the constituent components of the image recording layer in at least one of the surface or the inside thereof. From the viewpoints of the image forming sensitivity and the UV printing durability, a reactive microgel containing a radically polymerizable group on the surface thereof is particularly preferable.

The constituent components of the image recording layer can be made into microcapsules or microgel particles using a known method.

From the viewpoints of the UV printing durability, the stain resistance, and the storage stability, it is preferable that the polymer particle is obtained by reacting a polyvalent isocyanate compound which is an adduct of a polyhydric phenol compound containing two or more hydroxy groups in a molecule and isophorone diisocyanate with a compound having active hydrogen.

As the polyhydric phenol compound, a compound having a plurality of benzene rings containing a phenolic hydroxy group is preferable.

As the compound having active hydrogen, a polyol compound or a polyamine compound is preferable, a polyol compound is more preferable, and at least one compound selected from the group consisting of propylene glycol, glycerin, and trimethylolpropane is still more preferable.

As the resin particles obtained by reacting the compound containing active hydrogen with the polyvalent isocyanate compound which is an adduct of a polyhydric phenol compound containing two or more hydroxy groups in a molecule and isophorone diisocyanate, polymer particles described in paragraphs 0032 to 0095 of JP2012-206495A are preferably exemplified.

Further, from the viewpoints of the UV printing durability and the solvent resistance, it is preferable that the polymer particle has a hydrophobic main chain and both a constitutional unit (i) containing a pendant-cyano group directly bonded to the hydrophobic main chain and a constitutional unit (ii) containing a pendant group having a hydrophilic polyalkylene oxide segment.

As the hydrophobic main chain, an acrylic resin chain is preferably exemplified.

Preferred examples of the pendant-cyano group include —[$CH_2CH(C^{\circ}N)$—] and —[$CH_2C(CH_3)(C{\equiv}N)$—].

Further, the constitutional unit having a pendant-cyano group can be easily derived from an ethylene-based unsaturated monomer such as acrylonitrile or methacrylonitrile or a combination of these.

Further, as the alkylene oxide in the hydrophilic polyalkylene oxide segment, ethylene oxide or propylene oxide is preferable and ethylene oxide is more preferable.

The repetition number of alkylene oxide structures in the hydrophilic polyalkylene oxide segment is preferably in a range of 10 to 100, more preferably in a range of 25 to 75, and still more preferably in a range of 40 to 50.

As the resin particle which has a hydrophobic main chain and both the constitutional unit (i) containing a pendant-cyano group directly bonded to the hydrophobic main chain and the constitutional unit (ii) containing a pendant group having a hydrophilic polyalkylene oxide segment, those described in paragraphs 0039 to 0068 of JP2008-503365A are preferably exemplified.

The average particle diameter of the polymer particle is preferably in a range of 0.01 μm to 3.0 μm, more preferably in a range of 0.03 μm to 2.0 μm, and still more preferably in a range of 0.10 μm to 1.0 μm. In a case where the average particle diameter thereof is in the above-described range, excellent resolution and temporal stability are obtained.

The average primary particle diameter of the particle in the present disclosure is obtained by measuring the diameter of each particle according to a light scattering method or capturing an electron micrograph of the particles and measuring the particle diameters of a total of 5000 particles on the photograph, and calculating the average value thereof. Further, the particle diameter of a spherical particle having the same particle area as the particle area on the photograph is set as the particle diameter of a non-spherical particle.

Further, the average particle diameter in the present disclosure is the volume average particle diameter unless otherwise specified.

The content of other polymer particle is preferably in a range of 5% by mass to 90% by mass with respect to the total mass of the image recording layer.

[Acid Color Former]

It is preferable that the image recording layer used in the present disclosure contains an acid color former.

The "acid color former" used in the present disclosure indicates a compound that exhibits a color-developing property by being heated in a state of accepting an electron-accepting compound (for example, a proton such as an acid). As the acid color former, a colorless compound which has a partial skeleton such as a lactone, a lactam, a sultone, a spiropyran, an ester, or an amide and in which these partial skeletons are rapidly ring-opened or cleaved in a case of being brought into contact with an electron-accepting compound is preferable.

Examples of such an acid color former include phthalides such as 3,3-bis(4-dimethylaminophenyl)-6-dimethylaminophthalide (referred to as "crystal violet lactone"), 3,3-bis(4-dimethylaminophenyl)phthalide, 3-(4-dimethylaminophenyl)-3-(4-diethylamino-2-methylphenyl)-6-dimethylaminophthalide, 3-(4-dimethylaminophenyl)-3-(1,2-dimethylindol-3-yl)phthalide, 3-(4-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, and 3-(4-dimethylaminophenyl)-3-(1-methylpyrrol-3-yl)-6-dimethylaminophthalide, 3,3-bis[1,1-bis(4-dimethylaminophenyl)ethylene-2-yl]-4,5,6,7-tetrachlorophthalide, 3,3-bis[1,1-bis(4-pyrrolidinophenypethyl ene-2-yl]-4,5,6,7-tetrabromophthalide, 3,3-bis[1-(4-dimethylaminophenyl)-1-(4-methoxyphenyl)ethylene-2-yl]-4,5,6,7-tetrachlorophthalide, 3,3-bis[1-(4-pyrrolidinophenyl)-1-(4-methoxyphenyl)ethylene-2-yl]4,5,6,7-tetrachlorophthalide, 3-[1,1-di (1-ethyl-2-methylindol-3-yl)ethylene-2-yl]-3-(4-diethylaminophenyl)phthalide, 3-[1,1-di(1-ethyl-2-methylindol-3-yl)ethylene-2-yl]-3-(4-N-ethyl-N-phenyl aminophenyl)phthalide, 3-(2-ethoxy-4-diethylaminophenyl)-3-(1-n-octyl-2-methylindol-3-yl)-phthalide, 3,3-bis(1-n-octyl-2-methylindol-3-yl)-phthalide, and 3-(2-methyl-4-diethylaminophenyl)-3-(1-n-octyl-2-methylindol-3-yl)-phthalide, 4,4-bis-dimethylaminobenzhydrinbenzylether, N-halophenyl-leucoauramine, N-2,4,5-trichlorophenyl leucoauramine, rhodamine-B-anilinolactam, rhodamine-(4-nitroanilino)lactam, rhodamine-B-(4-chloroanilino)lactam, 3,7-bis(diethylamino)-10-benzoylphenoxazine, benzoyl leucomethylene blue, and 4-nitrobenzoyl methylene blue, fluorans such as 3,6-dimethoxyfluoran, 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-N-cyclohexyl-N-n-butylamino-7-methylfluoran, 3-diethylamino-7-dibenzylaminofluoran, 3-diethylamino-7-octylaminofluoran, 3-diethylamino-7-di-n-hexylaminofluoran, 3-diethylamino-7-anilinofluoran, 3-diethylamino-7-(2'-fluorophenylamino)fluoran, 3-diethylamino-7-(2'-chlorophenylamino)fluoran, 3-diethylamino-7-(3'-chlorophenyl amino)fluoran, 3-diethylamino-7-(2',3'-dichlorophenylamino)fluoran, 3-diethylamino-7-(3'-trifluoromethylphenylamino)fluoran, 3-di-n-butylamino-7-(2'-fluorophenylamino)fluoran, 3-di-n-butylamino-7-(2'chlorophenylamino)fluoran, 3-N-isopentyl-N-ethylamino-7-(2'-chlorophenylamino)fluoran, 3-N-n-hexyl-N-ethylamino-7-(2'-chlorophenylamino)fluoran, 3-diethylamino-6-chloro-7-anilinofluoran, 3-di-n-butylamino-6-chloro-7-anilinofluoran, 3-diethylamino-6-methoxy-7-anilinofluoran, 3-di-n-butylamino-6-ethoxy-7-anilinofluoran, 3-pyrrolidino-6-methyl-7-anilinofluoran, 3-pyrrolidino-6-methyl-7-anilinofluoran, 3-morpholino-6-methyl-7-anilinofluran, 3-dimethylamino-6-methyl-7-anilinofluoran, 3-diethylamino-6-methyl-7-anilinofluoran, 3-di-n-butylamino-6-methyl-7-anilinofluoran, 3-di-n-pentylamino-6-methyl-7-anilinofluoran, 3-N-ethyl-N-methylamino-6-methyl-7-anilinofluoran, 3-N-n-propyl-N-methylamino-6-methyl-7-anilinofluoran, 3-N-n-propyl-N-ethylamino-6-methyl-7-anilinofluoran, 3-N-n-butyl-N-methylamino-6-methyl-7-anilinofluoran, 3-N-n-butyl-N-ethylamino-6-methyl-7-anilinofluoran, 3-N-isobutyl-N-methylamino-6-methyl-7-anilinofluoran, 3-N-isobutyl-N-ethylamino-6-methyl-7-anilinofluoran, 3-N-isopentyl-N-ethylamino-6-methyl-7-anilinofluoran, 3-N-n-hexyl-N-methylamino-6-methyl-7-anilinofluoran, 3-N-cyclohexyl-N-ethylamino-6-methyl-7-anilinofluoran, 3-N-cyclohexyl-N-n-propylamino-6-methyl-7-anilinofluoran, 3-N-cyclohexyl-N-n-butylamino-6-methyl-7-anilinofluoran, 3-N-cyclohexyl-N-n-hexylamino-6-methyl-7-anilinofluoran, 3-N-cyclohexyl-N-n-octylamino-6-methyl-7-anilinofluoran, 3-N-(2'-methoxyethyl)-N-methylamino-6-methyl-7-anilinofluoran, 3-N-(2'-methoxyethyl)-N-ethylamino-6-methyl-7-anilinofluoran, 3-N-(2'-methoxyethyl)-N-isobutylamino-6-methyl-7-anilinofluoran, 3-N-(2'-ethoxyethyl)-N-methylamino-6-methyl-7-anilinofluoran, 3-N-(2'-ethoxyethyl)-N-ethylamino-6-methyl-7-anilinofluoran, 3-N-(3'-methoxypropyl)-N-methylamino-6-methyl-7-anilinofluoran, 3-N-(3'methoxypropyl)-N-ethylamino-6-methyl-7-anilinofluoran, 3-N-(3'-ethoxypropyl)-N-methylamino-6-methyl-7-anilinofluoran, 3-N-(3'ethoxypropyl)-N-ethylamino-6-methyl-7-anilinofluoran, 3-N-(2'-tetrahydrofurfuryl)-N-ethylamino-6-methyl-7-anilinofluoran, 3-N-(4'-methylphenyl)-N-ethylamino-6-methyl-7-anilinofluoran, 3-diethylamino-6-ethyl-7-anilinofluoran, 3-diethylamino-6-methyl-7-(3'-methylphenylamino)fluoran, 3-diethylamino-6-methyl-7-(2',6'-dimethylphenylamino)fluoran, 3-di-n-butylamino-6-methyl-7-(2',6'-dimethylphenylamino)fluoran, 3-di-n-butylamino-7-(2',6'-dimethylphenylamino)fluoran, 2,2-bis[4'-(3-N-cyclohexyl-N-methylamino-6-methylfluoran)-7-ylaminophenyl]propane, 3-[4'-(4-phenylaminophenyl)aminophenyl]amino-6-methyl-7-chlorofluoran, and 3-[4'(dimethylaminophenyl)]amino-5,7-dimethylfluoran, phthalides such as 3-(2-methyl-4-diethylaminophenyl)-3-(1-ethyl-2-methylindol-3-yl)-4-azaphthalide, 3-(2-n-propoxycarbonylamino-4-di-n-propylaminophenyl)-3-(1-ethyl-2-methylindol-3-yl)-4-azaphthalide, 3-(2-methylamino-4-di-n-propylaminophenyl)-3-(1-ethyl-2-methylindol-3-yl)-4-azaphthalide, 3-(2-methyl-4-di-n-hexylaminophenyl)-3-(1-n-octyl-2-methylindol-3-yl)-4,7-diazaphthalide, 3,3-bis(2-ethoxy-4-diethylaminophenyl)-4-azaphthalide, 3,3-bis(1-n-octyl-2-methylindol-3-yl)-4-azaphthalide, 3-(2-ethoxy-4-diethylaminophenyl)-3-(1-ethyl-2-methylindol-3-yl)-4-azaphthalide, 3-(2-ethoxy-4-diethylaminophenyl)-3-(1-octyl-2-methylindol-3-yl)-4-azaphthalide, 3-(2-ethoxy-4-diethylaminophenyl)-3-(1-octyl-2-methylindol-3-yl)-7-azaphthalide, 3-(2-ethoxy-4-diethylaminophenyl)-3-(1-ethyl-2-methylindol-3-yl)-4-azaphthalide, 3-(2-ethoxy-4-diethylaminophenyl)-3-(1-ethyl-2-methylindol-3-yl)-7-azaphthalide, 3-(2-hexyloxy-4-diethylaminophenyl)-3-(1-ethyl-2-methylindol-3-yl)-4-azaphthalide, 3-(2-hexyloxy-4-diethylaminophenyl)-3-(1-ethyl-2-methylindol-3-yl)-7-azaphthalide, 3-(2-ethoxy-4-diethylaminophenyl)-3-(1-ethyl-2-phenylindol-3-yl)-4-azaphthalide, 3-(2-ethoxy-4-diethylaminophenyl)-3-(1-ethyl-2-phenylindol-3-yl)-7-azaphthalide, 3-(2-butoxy-4-diethylaminophenyl)-3-(1-ethyl-2-phenylindol-3-yl)-4-azaphthalide, 3-(2-butoxy-4-diethylaminophenyl)-3-(1-ethyl-2-phenylindol-3-yl)-7-azaphthalide, 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(3-methoxybenzo)spiropyran, 3-propyl-spiro-dibenzopyran-3,6-bis(dimethylamino)fluorene-9-spiro-3'-(6'-dimethylamino)phthalide, and 3,6-bis(diethylamino)fluorene-9-spiro-3'-(6'-dimethylamino)phthalide.

Further, other examples thereof include 2-anilino-6'-(N-ethyl-N-isopentyl)amino-3'-methyl spiro[isobenzofuran-1(3H),9'-(9H)xanthene]-3-one, 2'-anilino-6'-(N-ethyl-N-(4-methylphenyl))amino-3'-methylspiro[isobenzofuran-1 (3H),9'-(9H)xanthene]-3-one, 3'-N,N-dibenzylamino-6'-N,N-diethylaminospiro[isobenzofuran-1(3H),9'-(9H)xanthene]-3-one, and 2'-(N-methyl-N-phenyl)amino-6'-(N-ethyl-N-(4-methylphenyl))aminospiro[isobenzofuran-1 (3H),9'-(9H)xanthene]-3-one.

Among these, from the viewpoint of the color developability, it is preferable that the acid color former used in the present disclosure is at least one compound selected from the group consisting of a spiropyran compound, a spirooxazine compound, a spirolactone compound, and a spirolactam compound.

From the viewpoint of the visibility, it is preferable that the color tone of the coloring agent after color development is green, blue, or black.

As the acid color former, a commercially available product can be used, and examples thereof include ETAC, RED500, RED520, CVL, S-205, BLACK305, BLACK400, BLACK100, BLACK500, H-7001, GREEN300, NIRBLACK78, BLUE220, H-3035, BLUE203, ATP, H-1046, and H-2114 (all manufactured by Fukui Yamada Chemical Co., Ltd.), ORANGE-DCF, Vermilion-DCF, PINK-DCF, RED-DCF, BLMB, CVL, GREEN-DCF, and TH-107 (all manufactured by Hodogaya Chemical Co., Ltd.), ODB, ODB-2, ODB-4, ODB-250, ODB-BlackXV, Blue-63, Blue-502, GN-169, GN-2, Green-118, Red-40, and Red-8 (all manufactured by Yamamoto Chemicals Inc.), and Crystal Violet Lactone (manufactured by Tokyo Chemical Industry Co., Ltd.). Among these commercially available products, ETAC, S-205, BLACK305, BLACK400, BLACK100, BLACK500, H-7001, GREEN300, NIRBLACK78, H-3035, ATP, H-1046, H-2114, GREEN-DCF, Blue-63, GN-169, and Crystal Violet Lactone are preferable from the viewpoint that the visible light absorbance of a film to be formed is satisfactory.

These acid color formers may be used alone or in combination of two or more kinds thereof.

The content of the acid color former is preferably in a range of 0.5% by mass to 10% by mass and more preferably in a range of 1% by mass to 5% by mass with respect to the total mass of the image recording layer.

[Binder Polymer Other than Core-Shell Particle]

The image recording layer may contain a binder polymer other than the core-shell particle (hereinafter, also referred to as "other binder polymer").

The core-shell particle and the polymer particle do not correspond to other binder polymer described above. That is, other binder polymer is a polymer that is not in the form of a particle.

As other binder polymer, a (meth)acrylic resin, a polyvinyl acetal resin, and a polyurethane resin are preferable.

Among these, as other binder polymer, known binder polymers used in the image recording layer of the planographic printing plate precursor can be suitably used. As an example, the binder polymer used in the on-press development type planographic printing plate precursor (hereinafter, also referred to as a binder polymer for on-press development) will be described in detail.

As the binder polymer for on-press development, a binder polymer having an alkylene oxide chain is preferable. The binder polymer having an alkylene oxide chain may have a poly(alkylene oxide) moiety in the main chain or in a side chain. Further, the binder polymer may be a graft polymer having poly(alkylene oxide) in a side chain or a block copolymer of a block formed of a poly(alkylene oxide)-containing repeating unit and a block formed of an (alkylene oxide)-free repeating unit.

A polyurethane resin is preferable in a case where the binder polymer has a poly(alkylene oxide) moiety in the main chain. Examples of the polymer of the main chain in a case of having a poly(alkylene oxide) moiety in a side chain include a (meth)acrylic resin, a polyvinyl acetal resin, a polyurethane resin, a polyurea resin, a polyimide resin, a polyamide resin, an epoxy resin, a polystyrene resin, a novolak type phenol resin, a polyester resin, synthetic rubber, and natural rubber. Among these, a (meth)acrylic resin is particularly preferable.

Other preferred examples of other binder polymer include a polymer compound (hereinafter, also referred to as a "star type polymer compound") which has a polymer chain bonded to a nucleus through a sulfide bond by using a hexa- to decafunctional polyfunctional thiol as the nucleus and in which the polymer chain contains a polymerizable group. As the star type polymer compound, for example, compounds described in JP2012-148555A can be preferably used.

Examples of the star type polymer compound include compounds having a polymerizable group such as an ethylenically unsaturated bond in the main chain or in a side chain and preferably in a side chain for improving coated-film hardness of an image area as described in JP2008-195018A. Crosslinking occurs between polymer molecules by a polymerizable group so that curing is promoted.

As the polymerizable group, an ethylenically unsaturated group such as a (meth)acryl group, a vinyl group, an allyl group, or a vinylphenyl group (styryl group) or an epoxy group is preferable, a (meth)acryl group, a vinyl group, or a vinylphenyl group (styryl group) is more preferable from the viewpoint of the polymerization reactivity, and a (meth) acryl group is particularly preferable. These groups can be introduced to a polymer by a polymer reaction or copolymerization. For example, a reaction between a polymer having a carboxy group in a side chain thereof and glycidyl methacrylate or a reaction between a polymer having an epoxy group and ethylenically unsaturated group-containing carboxylic acid such as methacrylic acid can be used. These groups may be used in combination.

In the molecular weight of other binder polymer, the weight-average molecular weight (Mw) of other binder polymer in terms of polystyrene that is measured according to the GPC method is preferably 2000 or greater, more preferably 5000 or greater, and still more preferably in a range of 10000 to 300000.

As necessary, hydrophilic polymers such as polyvinyl alcohol and polyacrylic acid described in JP2008-195018A can be used in combination. Further, a lipophilic polymer and a hydrophilic polymer can be used in combination.

In the image recording layer used in the present disclosure, other binder polymer may be used alone or in combination of two or more kinds thereof.

The image recording layer may contain an optional amount of other binder polymer, and the content of the binder polymer is preferably in a range of 1% by mass to 90% by mass and more preferably in a range of 5% by mass to 80% by mass with respect to the total mass of the image recording layer.

Further, in a case where the image recording layer of the present disclosure contains other binder polymer, the content of other binder polymer is preferably greater than 0% by mass and 99% by mass or less, more preferably in a range of 20% by mass to 95% by mass, and still more preferably in a range of 40% by mass to 90% by mass with respect to the total mass of the core-shell particle and other binder polymer.

[Chain Transfer Agent]

The image recording layer used in the present disclosure may contain a chain transfer agent. The chain transfer agent contributes to improvement of the UV printing durability of the planographic printing plate.

As the chain transfer agent, a thiol compound is preferable, a thiol compound having 7 or more carbon atoms is more preferable from the viewpoint of the boiling point (difficulty in volatilization), and a compound containing a mercapto group on an aromatic ring (aromatic thiol compound) is still more preferable. It is preferable that the thiol compound is a monofunctional thiol compound.

Specific examples of the chain transfer agent include the following compounds.

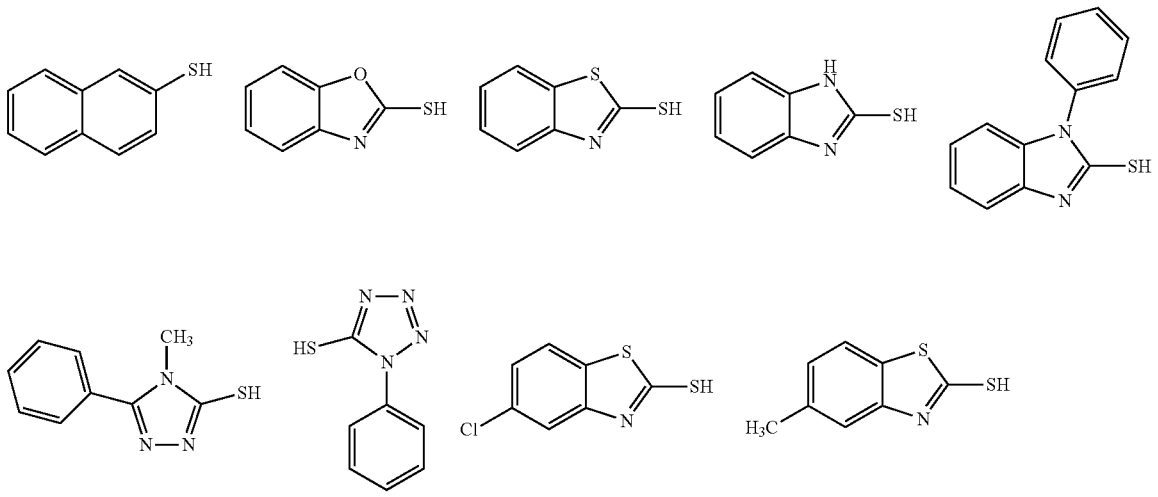

-continued
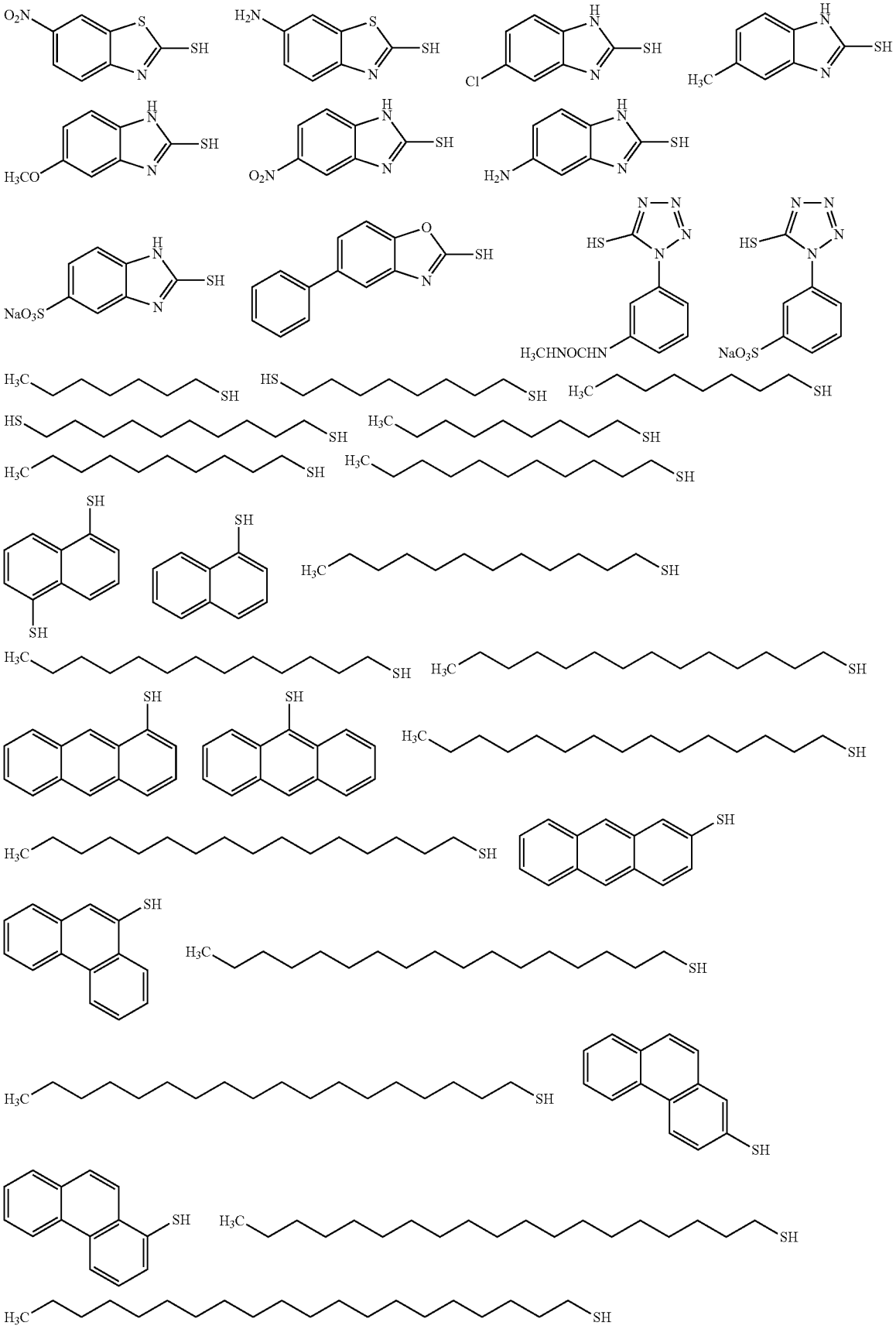

-continued

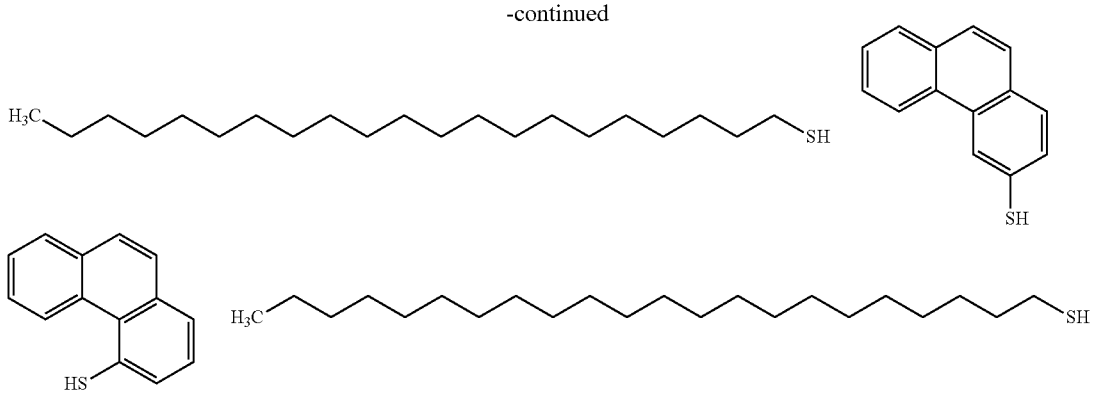

The chain transfer agent may be used alone or in combination of two or more kinds thereof.

The content of the chain transfer agent is preferably in a range of 0.01% by mass to 50% by mass, more preferably in a range of 0.05% by mass to 40% by mass, and still more preferably in a range of 0.1% by mass to 30% by mass with respect to total mass of the image recording layer.

[Sensitizing Agent]

It is preferable that the image recording layer further contains a sensitizing agent in order to improve the ink impressing property.

The SP value of the sensitizing agent is preferably less than 18.0, more preferably 14 or greater and less than 18, still more preferably in a range of 15 to 17, and particularly preferably in a range of 16 to 16.9.

Further, the sensitizing agent may be a compound having a molecular weight (a weight-average molecular weight in a case of having a molecular weight distribution) of 2000 or greater or a compound having a molecular weight of less than 2000.

The SP value (the solubility parameter, unit: $(MPa)^{1/2}$)) in the present disclosure is obtained by using the Hansen solubility parameter.

The Hansen solubility parameter is a parameter obtained by dividing the solubility parameter introduced by Hildebrand into three components of a dispersion element δd, a polarization element δp, and a hydrogen bond element δh so as to be shown in a three-dimensional space. In the present disclosure, the SP value is represented by δ (unit: $(MPa)^{1/2}$), and the value calculated using the following equation is used.

$$\delta(MPa)^{1/2}=(\delta d^2+\delta p^2+\delta h^2)^{1/2}$$

Further, the dispersion element δd, the polarization element δp, and the hydrogen bond element δh have been sought by Hansen and his successors of the research and are described in detail in Polymer Handbook (fourth edition), VII-698 to 711.

Further, in the present disclosure, the SP value of the polymer is calculated from the molecular structure of the polymer according to the Hoy method described in Polymer Handbook fourth edition.

Examples of the sensitizing agent include an onium compound, a nitrogen-containing low-molecular-weight compound, and an ammonium compound such as an ammonium group-containing polymer.

Particularly, in a case where an overcoat layer contains an inorganic layered compound, these compounds can function as a surface coating agent of the inorganic layered compound and suppress degradation of the impressing property due to the inorganic layered compound during the printing.

Further, from the viewpoint of the impressing property, it is preferable that the sensitizing agent is an onium compound.

Examples of the onium compound include a phosphonium compound, an ammonium compound, and a sulfonium compound. From the above-described viewpoint, at least one selected from the group consisting of a phosphonium compound and an ammonium compound is preferable as the onium compound.

Further, the onium compound in the development accelerator or the electron-accepting polymerization initiator described below is a compound having an SP value of greater than 18 and is not included in the sensitizing agent.

Examples of the phosphonium compound include phosphonium compounds described in JP2006-297907A and JP2007-50660A. Specific examples thereof include 1,4-bis(triphenylphosphonio)butane=di(hexafluorophosphate), 1,7-bis(triphenylphosphonio)heptane=sulfate, and 1,9-bis(triphenylphosphonio)nonane=naphthalene-2,7-disulfonate.

Preferred examples of the ammonium compound include a nitrogen-containing low-molecular-weight compound and an ammonium group-containing polymer.

Examples of the nitrogen-containing low-molecular-weight compound include amine salts and quaternary ammonium salts. Further, examples thereof include imidazolinium salts, benzimidazolinium salts, pyridinium salts, and quinolinium salts.

Among these, quaternary ammonium salts and pyridinium salts are preferable.

Specific examples thereof include tetramethyl ammonium=hexafluorophosphate, tetrabutylammonium=hexafluorophosphate, dodecyltrimethylammonium=p-toluene sulfonate, benzyltriethylammonium=hexafluorophosphate, benzyldimethyloctylammonium=hexafluorophosphate, benzyldimethyldodecylammonium=hexafluorophosphate, and compounds described in paragraphs 0021 to 0037 of JP2008-284858A and paragraphs 0030 to 0057 of JP2009-90645A.

The ammonium group-containing polymer may contain an ammonium group in the structure thereof, and a polymer that contains, as a copolymerization component, 5% by mole to 80% by mole of (meth)acrylate containing an ammonium group in a side chain is preferable. Specific examples thereof include polymers described in paragraphs 0089 to 0105 of JP2009-208458A.

The reduced specific viscosity (unit: ml/g) of the ammonium salt-containing polymer which is acquired by the measuring method described in JP2009-208458A is preferably in a range of 5 to 120, more preferably in a range of 10 to 110, and particularly preferably in a range of 15 to 100. In a case where the reduced specific viscosity is converted to the weight-average molecular weight (Mw), the value thereof is preferably in a range of 10000 to 1500000, more preferably in a range of 17000 to 140000, and particularly preferably in a range of 20000 to 130000.

Hereinafter, specific examples of the ammonium group-containing polymer will be described.

(1) A 2-(trimethylammonio)ethylmethacrylate=p-toluenesulfonate/3,6-dioxaheptylmethacrylate copolymer (molar ratio of 10/90, Mw of 45000);

(2) A 2-(trimethylammonio)ethylmethacrylate=hexafluorophosphate/3,6-dioxaheptylmethacrylate copolymer (molar ratio of 20/80, Mw of 60000);

(3) A 2-(ethyldimethylammonio)ethylmethacrylate=p-toluenesulfonate/hexylmethacrylate copolymer (molar ratio of 30/70, Mw of 45000);

(4) A 2-(trimethylammonio)ethylmethacrylate=hexafluorophosphate/2-ethylhexylmethacrylate copolymer (molar ratio of 20/80, Mw of 60000);

(5) A 2-(trimethylammonio)ethylmethacrylate=methylsulfate/hexylmethacrylate copolymer (molar ratio of 40/60, Mw of 70000);

(6) A 2-(butyldimethylammonio)ethylmethacrylate=hexafluorophosphate/3,6-dioxaheptylmethacrylate copolymer (molar ratio of 25/75, Mw of 65000);

(7) A 2-(butyldimethylammonio)ethylacrylate=hexafluorophosphate/3,6-dioxaheptylmethacrylate copolymer (molar ratio of 20/80, Mw of 65000); and (8) A 2-(butyldimethylammonio)ethylmethacrylate=13-ethyl-5,8,11-trioxa-1-heptadecanesulfonate/3,6-dioxaheptylmethacrylate copolymer (molar ratio of 20/80, Mw of 75000).

The content of the sensitizing agent is preferably in a range of 1% by mass to 40.0% by mass, more preferably in a range of 2% by mass to 25.0% by mass, and still more preferably in a range of 3% by mass to 20.0% by mass with respect to the total mass of the image recording layer.

The image recording layer may contain only one or a combination of two or more kinds of sensitizing agents.

One of the preferred embodiments of the image recording layer used in the present disclosure is an embodiment in which the image recording layer contains two or more compounds as the sensitizing agents.

Specifically, from the viewpoint of achieving both the on-press developability and the impressing property, the image recording layer used in the present disclosure contains preferably a combination of a phosphonium compound, a nitrogen-containing low-molecular-weight compound, and an ammonium group-containing polymer and more preferably a combination of a phosphonium compound, quaternary ammonium salts, and an ammonium group-containing polymer, as the sensitizing agent.

[Development Accelerator]

It is preferable that the image recording layer used in the present disclosure further contains a development accelerator.

The value of the polarization element of the SP value of the development accelerator is preferably in a range of 6.0 to 26.0, more preferably in a range of 6.2 to 24.0, still more preferably in a range of 6.3 to 23.5, and particularly preferably in a range of 6.4 to 22.0.

As the value of the polarization element of the SP value (the solubility parameter, unit: $(cal/cm^3)^{1/2}$) in the present disclosure, the value of the polarization element δp in the Hansen solubility parameter is used. The Hansen solubility parameter is a parameter obtained by dividing the solubility parameter introduced by Hildebrand into three components of a dispersion element δd, a polarization element δp, and a hydrogen bond element δh so as to be shown in a three-dimensional space. In the present disclosure, the polarization element δp is used.

δp [$cal/cm^3$] represents the Hansen solubility parameter dipole interaction force element, V [$cal/cm^3$] represents the molar volume, and μ [D] represents the dipole moment. The following equation simplified by Hansen and Beerbower is typically used as 4.

$$\delta_p = \frac{37.4\mu}{V^{1/2}}$$ [Mathematical Formula 1]

As the development accelerator, a hydrophilic macromolecular compound or a hydrophilic low-molecular-weight compound is preferable.

In the present disclosure, the hydrophilicity indicates that the value of the polarization element of the SP value is in a range of 6.0 to 26.0, the hydrophilic macromolecular compound indicates a compound having a molecular weight (a weight-average molecular weight in a case of having a molecular weight distribution) of 3000 or greater, and the hydrophilic low-molecular-weight compound indicates a compound having a molecular weight (a weight-average molecular weight in a case of having a molecular weight distribution) of less than 3000.

Examples of the hydrophilic macromolecular compound include a cellulose compound. Among the examples, a cellulose compound is preferable.

Examples of the cellulose compound include cellulose and a compound in which at least a part of cellulose is modified (modified cellulose compound). Among these, a modified cellulose compound is preferable.

Preferred examples of the modified cellulose compound include a compound in which at least a part of the hydroxy group of cellulose is substituted with at least one group selected from the group consisting of an alkyl group and a hydroxyalkyl group.

The degree of substitution of the compound in which at least a part of the hydroxy group of cellulose is substituted with at least one group selected from the group consisting of an alkyl group and a hydroxyalkyl group is preferably in a range of 0.1 to 6.0 and more preferably in a range of 1 to 4.

As the modified cellulose compound, an alkyl cellulose compound or a hydroxyalkyl cellulose compound is preferable, and a hydroxyalkyl cellulose compound is more preferable.

Preferred examples of the alkyl cellulose compound include methyl cellulose.

Preferred examples of the hydroxyalkyl cellulose compound include hydroxypropyl cellulose.

The molecular weight (the weight-average molecular weight in a case of having a molecular weight distribution) of the hydrophilic macromolecular compound is preferably in a range of 3000 to 5000000 and more preferably in a range of 5000 to 200000.

Examples of the hydrophilic low-molecular-weight compound include a glycol compound, a polyol compound, an organic amine compound, an organic sulfonic acid compound, an organic sulfamine compound, an organic sulfuric acid compound, an organic phosphonic acid compound, an organic carboxylic acid compound, and a betaine compound. Among these, a polyol compound, an organic sulfonic acid compound, or a betaine compound is preferable.

Examples of the glycol compound include glycols such as ethylene glycol, diethylene glycol, triethylene glycol, propylene glycol, dipropylene glycol, and tripropylene glycol, and ether or ester derivatives of these compounds.

Examples of the polyol compound include glycerin, pentaerythritol, and tris(2-hydroxyethyl)isocyanurate.

Examples of the organic amine compound include triethanolamine, diethanolamine, monoethanolamine, and salts thereof.

Examples of the organic sulfonic acid compound include alkyl sulfonic acid, toluene sulfonic acid, benzene sulfonic acid, and salts thereof, and preferred examples thereof include alkyl sulfonic acid having an alkyl group with 1 to 10 carbon atoms.

Examples of the organic sulfamine compound include alkyl sulfamic acid and salts thereof.

Examples of the organic sulfuric acid compound include alkyl sulfuric acid, alkyl ether sulfuric acid, and salts thereof.

Examples of the organic phosphonic acid compound include phenyl phosphonic acid and salts thereof.

Examples of the organic carboxylic acid compound include tartaric acid, oxalic acid, citric acid, malic acid, lactic acid, gluconic acid, and salts thereof.

Examples of the betaine compound include a phosphobetaine compound, a sulfobetaine compound, and a carboxybetaine compound, and preferred examples thereof include trimethylglycine.

The molecular weight (the weight-average molecular weight in a case of having a molecular weight distribution) of the hydrophilic low-molecular-weight compound is preferably 100 or greater and less than 3000 and more preferably in a range of 300 to 2500.

It is preferable that the development accelerator is a compound having a cyclic structure.

The cyclic structure is not particularly limited, and examples thereof include a glucose ring in which at least a part of the hydroxy group may be substituted, an isocyanuric ring, an aromatic ring which may have a hetero atom, and an aliphatic ring which may have a hetero atom. Among these, a glucose ring or an isocyanuric ring is preferable.

Examples of the compound having a glucose ring include the cellulose compounds described above.

Examples of the compound having an isocyanuric ring include tris(2-hydroxyethyl) isocyanurate described above.

Examples of the compound having an aromatic ring include toluene sulfonic acid and benzene sulfonic acid described above.

Examples of the compound having an aliphatic ring include the compound which is alkyl sulfuric acid and in which an alkyl group having a ring structure described above.

Further, it is preferable that the compound having a cyclic structure contains a hydroxy group.

Preferred examples of the compound having a hydroxy group and a cyclic structure include the above-described cellulose compound and the above-described tris(2-hydroxyethyl) isocyanurate.

Further, an onium compound is preferable as the development accelerator.

Examples of the onium compound include an ammonium compound and a sulfonium compound. Among these, an ammonium compound is preferable.

Examples of the development accelerator which is an onium compound include trimethylglycine.

Further, the onium compound in the electron-accepting polymerization initiator is a compound in which the polarization element of the SP value is not in the range of 6.0 to 26.0 and is not included in the development accelerator.

The image recording layer may contain only one or a combination of two or more kinds of development accelerators.

One of the preferred embodiments of the image recording layer used in the present disclosure is an embodiment in which the image recording layer contains two or more compounds as the development accelerators.

Specifically, from the viewpoints of the on-press developability and the impressing property, it is preferable that the image recording layer used in the present disclosure contains a combination of the polyol compound and the betaine compound described above, a combination of the betaine compound and the organic sulfonic acid compound described above, or a combination of the polyol compound and the organic sulfonic acid compound described above as the development accelerators.

The content of the development accelerator is preferably in a range of 0.1% by mass to 20% by mass, more preferably in a range of 0.5% by mass to 15% by mass, and still more preferably in a range of 1% by mass to 10% by mass with respect to the total mass of the image recording layer.

[Other Components]

The image recording layer may contain, as other components, a surfactant, a polymerization inhibitor, a higher fatty acid derivative, a plasticizer, an inorganic particle, an inorganic layered compound, and the like. Specifically, the description in paragraphs 0114 to 0159 of JP2008-284817A can be referred to.

[Formation of Image Recording Layer]

The image recording layer of the planographic printing plate precursor according to the embodiment of the present disclosure can be formed by dispersing or dissolving each of the above-described required components in a known solvent to prepare a coating solution, coating a support with the coating solution using a known method such as a bar coater coating method, and drying the coating solution, as described in paragraphs 0142 and 0143 of JP2008-195018A. The coating amount (solid content) of the image recording layer after the coating and the drying varies depending on the applications thereof, but is preferably in a range of 0.3 $g/m^2$ to 3.0 $g/m^2$. In a case where the coating amount thereof is in the above-described range, excellent sensitivity and excellent film-coating characteristics of the image recording layer are obtained.

As the solvent, a known solvent can be used. Specific examples thereof include water, acetone, methyl ethyl ketone (2-butanone), cyclohexane, ethyl acetate, ethylene dichloride, tetrahydrofuran, toluene, ethylene glycol monomethyl ether, ethylene glycol monoethyl ether, ethylene glycol dimethyl ether, propylene glycol monomethyl ether, propylene glycol monoethyl ether, acetylacetone, cyclohexanone, diacetone alcohol, ethylene glycol monomethyl ether acetate, ethylene glycol ethyl ether acetate, ethylene glycol monoisopropyl ether, ethylene glycol monobutyl ether acetate, 1-methoxy-2-propanol, 3-methoxy-1-propanol, methoxy methoxy ethanol, diethylene glycol monomethyl ether, diethylene glycol monoethyl ether, diethylene glycol dimethyl ether, diethylene glycol diethyl ether, propylene glycol monomethyl ether acetate, propylene glycol monoethyl ether acetate, 3-methoxypropyl acetate, N,N-dimethylformamide, dimethylsulfoxide, y-butyrolactone, methyl lactate, and ethyl lactate. The solvent may be used alone or in combination of two or more kinds thereof. The concentration of solid contents in the coating solution is preferably in a range of 1% by mass to 50% by mass.

The coating amount (solid content) of the image recording layer after the coating and the drying varies depending on the applications thereof, but from the viewpoints of satisfactory sensitivity and satisfactory film characteristics of the image recording layer, the coating amount thereof is preferably in a range of 0.3 $g/m^2$ to 3.0 $g/m^2$.

Further, the film thickness of the image recording layer in the planographic printing plate precursor according to the embodiment of the present disclosure is preferably in a range of 0.1 μm to 3.0 μm and more preferably in a range of 0.3 μm to 2.0 μm.

In the present disclosure, the film thickness of each layer in the planographic printing plate precursor is confirmed by preparing a section cut in a direction perpendicular to the surface of the planographic printing plate precursor and observing the cross section of the section with a scanning electron microscope (SEM).

<Overcoat Layer>

The planographic printing plate precursor according to the embodiment of the present disclosure may have an overcoat layer (also referred to as a protective layer) on a surface of the image recording layer on a side opposite to the side of the support.

It is preferable that the film thickness of the overcoat layer is larger than the film thickness of the image recording layer.

The overcoat layer has a function of suppressing a reaction of inhibiting image formation through oxygen blocking, a function of preventing generation of damage to the image recording layer, and a function of preventing ablation in a case of exposure to a high illuminance laser.

Such an overcoat layer having the above-described characteristics is described in U.S. Pat. No. 3,458,311A and JP1980-49729B (JP-S55-49729B). As a polymer with low oxygen permeability which is used for the overcoat layer, any of a water-soluble polymer or a water-insoluble polymer can be appropriately selected and used, and two or more kinds thereof can be mixed and used as necessary. Further, from the viewpoint of the on-press developability, it is preferable that the overcoat layer contains a water-soluble polymer.

In the present disclosure, the water-soluble polymer indicates a polymer in which 1 g or greater of the polymer is dissolved in 100 g of pure water at 70° C. and is not deposited even in a case where the solution obtained by dissolving 1 g of the polymer in 100 g of pure water at 70° C. is cooled to 25° C.

Examples of the water-soluble polymer used in the overcoat layer include polyvinyl alcohol, modified polyvinyl alcohol, polyvinylpyrrolidone, a water-soluble cellulose derivative, polyethylene glycol, and poly(meth)acrylonitrile.

As the modified polyvinyl alcohol, acid-modified polyvinyl alcohol containing a carboxy group or a sulfo group is preferably used. Specific examples thereof include modified polyvinyl alcohol described in JP2005-250216A and JP2006-259137A.

Among the examples of the water-soluble polymer, it is preferable that the overcoat layer contains polyvinyl alcohol and more preferably polyvinyl alcohol having a saponification degree of 50% or greater.

The saponification degree of polyvinyl alcohol is preferably 60% or greater, more preferably 70% or greater, and still more preferably 85% or greater. The upper limit of the saponification degree is not particularly limited and may be 100% or less.

The saponification degree can be measured according to the method described in JIS K 6726:1994.

Further, as an embodiment of the overcoat layer, an embodiment in which the overcoat layer contains polyvinyl alcohol and polyethylene glycol is also preferable.

In a case where the overcoat layer of the present disclosure contains a water-soluble polymer, the content of the water-soluble polymer is preferably in a range of 1% by mass to 99% by mass, more preferably in a range of 3% by mass to 97% by mass, and still more preferably in a range of 5% by mass to 95% by mass with respect to the total mass of the overcoat layer.

The overcoat layer may contain an inorganic layered compound in order to enhance the oxygen-blocking property. The inorganic layered compound indicates a particle having a thin tabular shape, and examples thereof include a mica group such as natural mica and synthetic mica, talc represented by Formula: $3MgO.4SiO.H_2O$, teniolite, montmorillonite, saponite, hectorite, and zirconium phosphate.

An inorganic layered compound which has been preferably used is a mica compound. Examples of the mica compound include a mica group such as synthetic mica and natural mica represented by Formula: $A(B,C)_{2-5}D_4O_{10}(OH,F,O)_2$ [here, A represents any of K, Na, or Ca, B and C represent any of Fe (II), Fe (III), Mn, Al, Mg, or V, and D represents Si or Al].

In the mica group, examples of the natural mica include muscovite, soda mica, phlogopite, biotite, and lepidolite. Examples of the synthetic mica include non-swellable mica such as fluorophogopite $KMg_3(AlSi_3O_{10})F_2$ or potassium tetrasilicic mica $KMg_{2.5}Si_4O_{10})F_2$; and swellable mica such as Na tetrasilicic mica $NaMg_{2.5}(Si_4O_{10})F_2$, Na or Li teniolite $(Na,Li)Mg_2Li(Si_4O_{10})F_2$, or montmorillonite-based Na or Li hectorite $(Na,Li)_{1/8}Mg_{2/5}Li_{1/8}(Si_4O_{10})F_2$. Further, synthetic smectite is also useful.

Among the above-described mica compounds, fluorine-based swellable mica is particularly useful. In other words, swellable synthetic mica has a laminated structure formed of unit crystal lattice layers having a thickness of 10 Å to 15 Å (1 Å=0.1 nm), and substitution of metal atoms in the lattice is significantly larger than that in other clay minerals. As the result, the lattice layers causes shortage of a positive charge. In order to compensate for this, cations such as $Li^+$, $Na^+$, $Ca^{2+}$, and $Mg^{2+}$ are adsorbed between layers. Cations interposed between layers are referred to as exchangeable cations and can be exchanged for various cations. Particularly, in a case where interlayer cations are $Li^+$ and $Na^+$, since the ion radii thereof is small, bonds between layered crystal lattices are weak and largely swollen due to water. In a case where shearing is applied in this state, cleavage easily occurs so that a sol stabilized in water is formed. The swellable synthetic mica has such a strong tendency and is particularly preferably used.

As the shape of the mica compound, from the viewpoint of controlling diffusion, it is preferable that the thickness thereof is as small as possible and the plane size thereof is as large as possible within a range where the smoothness of the coating surface or the permeability of actinic rays is not inhibited. Therefore, the aspect ratio thereof is preferably 20 or greater, more preferably 100 or greater, and particularly preferably 200 or greater. The aspect ratio is a ratio of the major diameter to the thickness of a particle and can be measured using, for example, a projection drawing obtained from a microphotograph of particles. The effects to be obtained increase as the aspect ratio increases.

In the particle diameter of the mica compound, the average major diameter thereof is preferably in a range of 0.3 μm to 20 μm, more preferably in a range of 0.5 μm to 10 μm, and particularly preferably in a range of 1 μm to 5 μm. The average thickness of the particle is preferably 0.1 μm or less, more preferably 0.05 μm or less, and particularly preferably 0.01 μm or less. Specifically, for example, as a preferable embodiment of swellable synthetic mica which is a representative compound, the thickness thereof is in a range of 1 nm to 50 nm and the surface size (major diameter) is in a range of 1 μm to 20 μm.

The content of the inorganic layered compound is preferably in a range of 1% by mass to 60% by mass and more preferably in a range of 3% by mass to 50% by mass with respect to the total mass of the overcoat layer. In a case where a plurality of kinds of inorganic layered compounds are used in combination, it is preferable that the total amount of the inorganic layered compounds is the content described above. In a case where the content thereof is in the above-described range, the oxygen-blocking property is improved and satisfactory sensitivity is obtained. Further, degradation of the impressing property can be prevented.

The overcoat layer may contain known additives such as a plasticizer for imparting flexibility, a surfactant for improving the coating properties, and an inorganic particle for controlling the slipperiness of the surface. Further, the overcoat layer may contain a sensitizing agent described in the section of the image recording layer.

The overcoat layer is applied by a known method. The coating amount (solid content) of the overcoat layer is preferably in a range of 0.01 $g/m^2$ to 10 $g/m^2$, more preferably in a range of 0.02 $g/m^2$ to 3 $g/m^2$, and particularly preferably in a range of 0.02 $g/m^2$ to 1 $g/m^2$.

The film thickness of the overcoat layer in the planographic printing plate precursor according to the embodiment of the present disclosure is preferably in a range of 0.1 μm to 5.0 μm and more preferably in a range of 0.3 μm to 4.0 μm.

The film thickness of the overcoat layer in the planographic printing plate precursor according to the embodiment of the present disclosure is preferably in a range of 1.1 times to 5.0 times and more preferably in a range of 1.5 times to 3.0 times with respect to the film thickness of the image recording layer.

<Support>

The planographic printing plate precursor according to the embodiment of the present disclosure includes a support.

As the support, a support having a hydrophilic surface (also referred to as a "hydrophilic support") is preferable. As the hydrophilic surface, a surface whose contact angle with water is less than 10° is preferable, and a surface whose contact angle with water is less than 5° is more preferable.

The water contact angle in the present disclosure is measured as a contact angle (after 0.2 seconds) of water droplets on the surface at 25° C. using DM-501 (manufactured by Kyowa Interface Science Co., Ltd.).

The support of the planographic printing plate precursor according to the embodiment of the present disclosure can be appropriately selected from known supports for planographic printing plate precursors. As the support, an aluminum plate which has been subjected to a roughening treatment and an anodization treatment according to known methods is preferable.

Hereinafter, the support used in the planographic printing plate precursor according to the embodiment of the present disclosure will be described with reference to the accompanying drawings, but the reference numerals may not be provided in the description of the drawings.

The thickness of the anodized film is preferably 200 nm to 2000 nm.

Figure 2A:
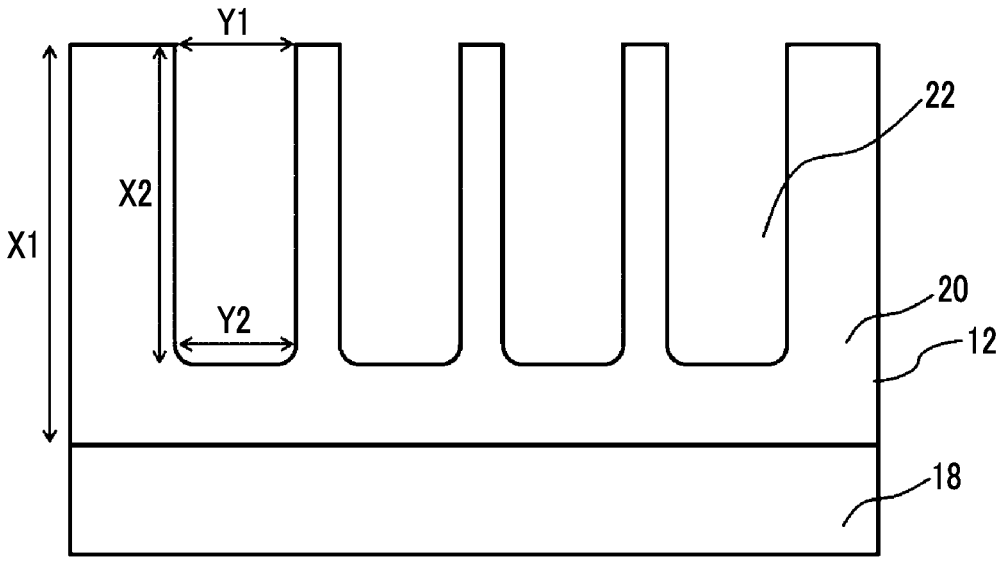
FIG. 2A is a schematic cross-sectional view illustrating an embodiment of an aluminum support having an anodized film.

FIG. 2A is a schematic cross-sectional view illustrating an embodiment of an aluminum support having an anodized film. In FIG. 2A, an aluminum support 12 having an anodized film includes an aluminum plate 18 and an anodized aluminum film 20 (hereinafter, also simply referred to as an "anodized film 20") in order. The anodized film 20 in the aluminum support 12 is positioned on an image recording layer 16 side of a planographic printing plate precursor 10 in FIG. 1. That is, the planographic printing plate precursor 10 includes the aluminum plate 18, the anodized film 20, an undercoat layer 14, and the image recording layer 16.

[Aluminum Plate]

The aluminum plate 18 (that is, the aluminum support) is formed of a metal containing dimensionally stable aluminum as a main component, that is, aluminum or an aluminum alloy. The aluminum plate 18 is formed of a pure aluminum plate or an alloy plate containing aluminum as a main component and a trace amount of foreign elements.

Examples of the foreign elements contained in the aluminum alloy include silicon, iron, manganese, copper, magnesium, chromium, zinc, bismuth, nickel, and titanium. The content of the foreign elements in the alloy is preferably 10% by mass or less. A pure aluminum plate is suitable as the aluminum plate 18, but from the viewpoint of the smelting technology, the aluminum plate 18 may be formed of aluminum containing a trace amount of foreign elements. The composition of the aluminum plate 18 is not limited, and known materials of the related art (for example, JIS A 1050, JIS A 1100, JIS A 3103, and JIS A 3005) can be used as appropriate.

The width of the aluminum plate 18 is preferably in a range of 400 mm to 2000 mm, and the thickness thereof is preferably in a range of 0.1 mm to 0.6 mm. The width or thickness of the aluminum plate 18 can be appropriately changed depending on the size of the printing press, the size of the printing plate, and the user's desire.

[Anodized Film]

The anodized film 20 indicates an anodized aluminum film that is typically prepared on a surface of the aluminum plate 18 by performing an anodization treatment and has extremely fine micropores 22 substantially perpendicular to the surface of the film and uniformly distributed. The micropores 22 extend along the thickness direction (that is, the side of the aluminum plate 18) from the surface of the anodized film.

A thickness X1 of the anodized film is preferably in a range of 200 nm to 2000 nm, more preferably in a range of 500 nm to 1800 nm, and still more preferably in a range of 750 nm to 1500 nm.

It is preferable that the aluminum support used in the present disclosure corresponds to any of the following aspects 1 to 3.

In the present disclosure, the term "micropores" is a general term used to indicate pores in the anodized film and does not specify the size of the pore.

(Aspect 1)

The micropores extend to a position at a depth of greater than 10 nm from the surface of the anodized film, and the ratio of the average diameter of the micropores at the bottom portions to the average diameter of the micropores at the surface of the anodized film is in a range of 0.8 times 1.2 times.

(Aspect 2)

The micropores are formed of large-diameter pores extending to a position at a depth of greater than 10 nm from the surface of the anodized film and small-diameter pores communicating with the bottom portions of the large-diameter pores and further extending along the depth direction from the communication positions, and the average diameter of the small-diameter pores at the communication positions is smaller than the average diameter of the large-diameter pores at the surface of the anodized film.

(Aspect 3)

The average diameter of the micropores at the surface of the anodized film is in a range of 10 nm to 30 nm, the average value of the maximum internal diameter is in a range of 20 nm to 300 nm, and the average value of the maximum internal diameter is larger than the average diameter of the micropores at the surface of the anodized film.

Hereinafter, each aspect will be described with reference to the accompanying drawings.

[Regarding Aspect 1]

FIG. 2A is a schematic cross-sectional view illustrating an embodiment of the aspect 1.

In FIG. 2A, the micropores 22 extend to a position at a depth of greater than 10 nm from the surface of the anodized film 20, and the ratio of the average diameter of the micropores at the bottom portions to the average diameter of the micropores at the surface of the anodized film is in a range of 0.8 times 1.2 times.

A depth X2 of the micropores 22 is greater than 10 nm, preferably 50 nm or greater, and more preferably 75 nm or greater.

The depth X2 of the micropores 22 is acquired by observing the cross section of the anodized film 20 with a field emission scanning electron microscope (FE-SEM) (magnification: 150000 times), measuring the depths of 25 micropores in the obtained image, and calculating the arithmetic average value thereof.

An average diameter Y1 of the micropores 22 at the surface of the anodized film is preferably in a range of 10 nm to 100 nm, more preferably in a range of 15 nm to 75 nm, and still more preferably in a range of 20 nm to 50 nm.

The ratio (X2/Y1) of the average diameter Y1 of the micropores 22 to the depth X2 of the micropores 22 at the surface of the anodized film is preferably in a range of 2 times to 10 times, more preferably in a range of 2.5 times to 7 times, and still more preferably in a range of 3 times to 6 times.

Further, the average diameter Y2 of the micropores 22 at the bottom portions is preferably in a range of 10 nm to 100 nm, more preferably in a range of 15 nm to 75 nm, and still more preferably in a range of 20 nm to 50 nm.

The ratio of the average diameter Y2 of the micropores 22 at the bottom portions to the average diameter Y1 of the micropores 22 at the surface of the anodized film is preferably in a range of 0.8 times to 1.2 times, more preferably in a range of 0.85 times to 1.15 times, and still more preferably in a range of 0.9 times to 1.1 times.

The ratio of the average diameter Y2 of the micropores 22 at the bottom portions to the average diameter Y1 of the micropores 22 at the surface of the anodized film is a value acquired by Expression 1A.

Expression 1A: (average diameter Y2 of micropores 22 at bottom portions)/(average diameter Y1 of micropores 22 at surface of anodized film)

The average diameter Y1 of micropores at the surface of the anodized film is acquired by observing 4 sheets (N=4) of the surfaces of the anodized film 20 using a field emission scanning electron microscope (FE-SEM) at a magnification of 150000 times, measuring the diameters of micropores present in a range of 400 nm×600 nm in the obtained four sheets of images, and calculating the arithmetic average value thereof.

In a case where the shape of the micropores at the surface of the anodized film (that is, the shape of the opening portions) is not circular, the equivalent circle diameter thereof is used.

The average diameter Y2 of the micropores 22 at the bottom portions is acquired by observing 4 sheets (N=4) of the surfaces of the anodized film 20 using a FE-SEM at a magnification of 150000 times, measuring the diameters of the micropores 22 at the bottom portions present in a range of 400 nm×600 nm in the obtained four sheets of images, and calculating the arithmetic average value thereof. Further, in a case where the depth of the micropores 22 is large, the average diameter Y2 of the micropores 22 at the bottom portions may be acquired by cutting the upper portion of the anodized film 20 to be parallel to the anodized film (for example, cutting the portion by argon gas) as necessary and observing the surface of the anodized film 20 using the above-described FE-SEM.

Further, in a case where the shape of the micropores at the bottom portions is not circular, an equivalent circle diameter thereof is used.

Figure 2B:
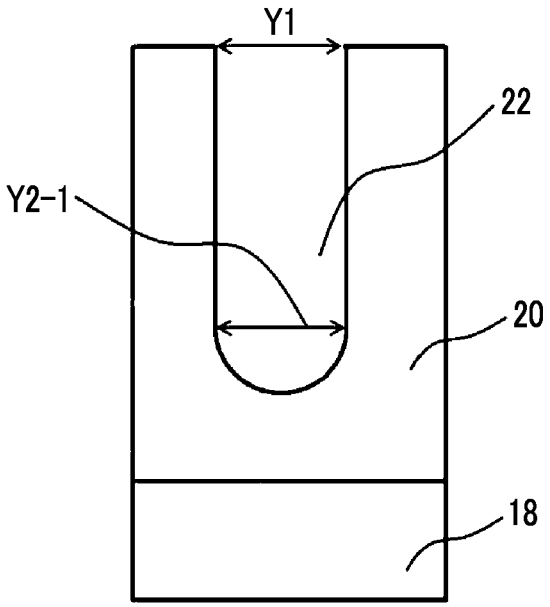
FIG. 2B is an enlarged schematic cross-sectional view illustrating one micropore in FIG. 2A.

Further, in a case where the shape thereof at the bottom portions is not planar, for example, Y2-1 shown in FIG. 2B is measured as the average diameter thereof at the bottom portions.

FIG. 2B is an enlarged schematic cross-sectional view illustrating one micropore in FIG. 2A.

The shape of the micropores 22 in the aspect 1 is not particularly limited, and examples thereof include a substantially straight tubular shape, a substantially columnar shape, a conical shape whose diameter decreases toward the depth direction (that is, the thickness direction), an inverse conical shape whose diameter increases toward the depth direction (that is, the thickness direction), a columnar shape having a central portion with a large diameter, and a columnar shape having a central portion with a small diameter. Among these, a substantially straight tubular shape is preferable. Further, the shape of the micropores 22 at the bottom portions is not particularly limited and may be a curved (for example, recessed) shape or a planar shape.

The ratio of the average diameter Y1A of the micropores 22 at the central portion to the average diameter Y1 of the micropores 22 at the surface of the anodized film (Y1A/Y1) is preferably in a range of 0.8 times to 1.2 times.

The average diameter Y1A of the micropores 22 at the central portions is acquired by observing 4 sheets (N=4) of the surfaces of the anodized film 20 using a FE-SEM at a magnification of 150000 times, measuring the diameters of the micropores 22 at the central portions present in a range of 400 nm×600 nm in the obtained four sheets of images, and calculating the arithmetic average value thereof. Further, in a case where the depth of the micropores 22 is large, the average diameter Y1A of the micropores 22 at the central portions may be acquired by cutting the upper portion of the anodized film 20 to be parallel to the anodized film (for example, cutting the portion by argon gas) as necessary and observing the surface of the anodized film 20 using the above-described FE-SEM.

—Other Characteristics—

The density of the micropores 22 at the surface of the anodized film 20 is not particularly limited, but is preferably in a range of 200 pores/$\mu m^2$ to 2000 pores/$\mu m^2$ and more preferably in a range of 200 pores/$\mu m^2$ to 1000 pores/$\mu m^2$ per unit area of the anodized film.

The density of micropores 22*a* is obtained by observing 4 sheets (N=4) of the surfaces of the anodized film 20 using a field emission scanning electron microscope (FE-SEM) at a magnification of 150000 times, measuring the number of micropores present in a range of 400 nm×600 nm in the obtained four sheets of images, and calculating the arithmetic average value of the measured values.

In the anodized film 20, the micropores 22 may be distributed over the entire surface of the anodized film or may be distributed in at least a portion thereof, but it is preferable that the micropores 22 are distributed over the entire surface thereof.

It is preferable that the micropores 22 are substantially perpendicular to the surface of the anodized film.

Further, it is preferable that the micropores 22 are individually distributed in a nearly uniform state.

[Regarding Aspect 2]

Figure 3A:
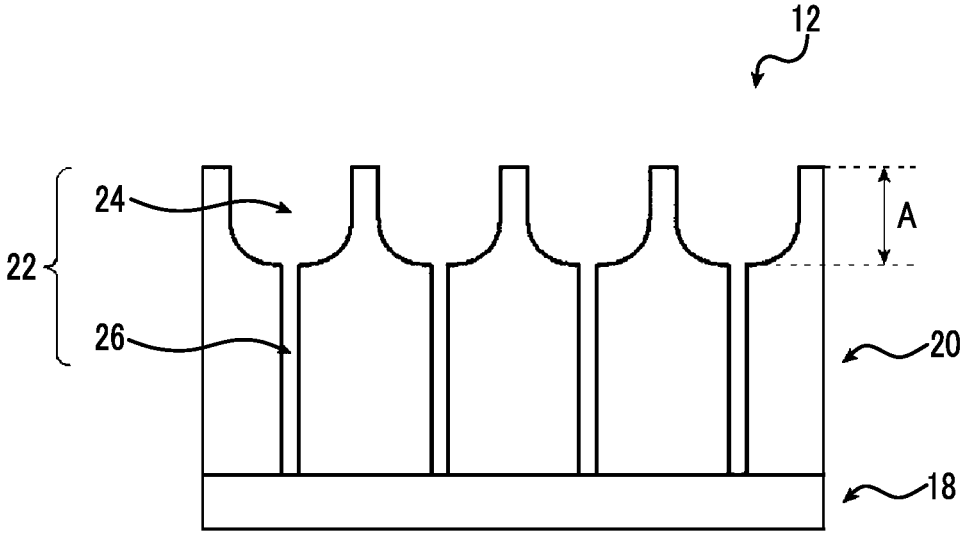
FIG. 3A is a schematic cross-sectional view illustrating another embodiment of an aluminum support having an anodized film.

FIG. 3A is a schematic cross-sectional view illustrating an embodiment of the aspect 2.

The micropores 22 in the anodized film 20 are formed of large-diameter pores 24 extending to a position at a depth (depth A: see FIG. 3A) of greater than 10 nm from the surface of the anodized film and small-diameter pores 26 communicating with the bottom portions of the large-diameter pores 24 and further extending along the depth direction from the communication positions.

Hereinafter, the large-diameter pores 24 and the small-diameter pores 26 will be described in detail.

—Large-Diameter Pore—

It is assumed that in a case where a positive type image recording layer in the present disclosure which is in contact with the support partially enters the large-diameter pores at the surface of the anodized film, the anchor effect is exerted to enhance the adhesiveness between the image area and the support, and thus the printing durability of the image area during the printing is improved.

The average diameter (that is, the average opening diameter) of the large-diameter pores 24 at the surface of the anodized film is preferably greater than 10 nm and 100 nm or less. From the viewpoint that the effects of the present disclosure are more excellent, the average diameter thereof is more preferably in a range of 15 nm to 60 nm and still more preferably in a range of 18 nm to 40 nm.

In a case where the average diameter thereof is greater than 10 nm, a planographic printing plate having excellent small dot printing durability, excellent small dot development latitude, and a solid image area with excellent printing durability is likely to be obtained. Further, in a case where the average diameter thereof is 100 nm or less, a planographic printing plate having excellent deinking capability after being left to stand is likely to be obtained.

The average diameter of the large-diameter pores 24 is acquired by observing 4 sheets (N=4) of the surfaces of the anodized film 20 using a field emission scanning electron microscope (FE-SEM) at a magnification of 150000 times, measuring the diameters of the micropores (large-diameter pores) present in a range of 400 nm×600 nm in the obtained four sheets of images, and calculating the arithmetic average value thereof.

Further, in a case where the shape of the large-diameter pores 24 is not circular, an equivalent circle diameter thereof is used.

The bottom portions of the large-diameter pores 24 are positioned at a depth of greater than 10 nm (hereinafter, also referred to as a "depth A") from the surface of the anodized film. That is, the large-diameter pores 24 are pores extending from the surface of the anodized film to a position at a depth of greater than 10 nm in the depth direction (that is, the thickness direction). Here, from the viewpoint that the effects of the present disclosure are more excellent, the depth A is preferably greater than 10 nm and 1000 nm or less, more preferably in a range of 25 nm to 200 nm, and still more preferably in a range of 70 nm to 100 nm.

In a case where the depth A is 25 nm or greater, a planographic printing plate having excellent small dot printing durability, excellent small dot development latitude, and a solid image area with excellent printing durability is likely to be obtained. Further, in a case where the depth A is 200 nm or less, a planographic printing plate having particularly excellent deinking capability after being left to stand is likely to be obtained.

The depth from the surface of the anodized film is acquired by observing the cross section of the anodized film 20 using an FE-SEM (at a magnification of 150000 times), measuring the depths of 25 large-diameter pores in the obtained image, and calculating the arithmetic average value thereof.

The shape of the large-diameter pores 24 is not particularly limited, and examples thereof include a substantially straight tubular shape, a substantially columnar shape, a conical shape whose diameter decreases toward the depth direction (that is, the thickness direction), and an inverse conical shape whose diameter increases toward the depth direction (that is, the thickness direction). Among these, a substantially straight tubular shape is preferable. Typically, the diameter of the large-diameter pore at the bottom portion may be different from the diameter of an opening portion by 1 nm to 10 nm. The shape of the large-diameter pores 24 at the bottom portions is not particularly limited and may be a curved (for example, recessed) shape or a planar shape.

—Small-Diameter Pore—

As illustrated in FIG. 3A, it is preferable that the micropores 22 in the anodized film 20 include small-diameter pores 26 which are pores communicating with the bottom portions of the large-diameter pores 24 and further extending along the depth direction (that is, the thickness direction) from the communication positions. One small-diameter pore 26 typically communicates with one large-diameter pore 24, but two or more small-diameter pores 26 may communicate with the bottom portion of one large-diameter pore 24.

The average diameter of the small-diameter pores 26 at the communication positions is not particularly limited, but the average diameter of the small-diameter pores 26 at the communication positions with the bottom portions of the large-diameter pores 24 is smaller than the average diameter of the large-diameter pores 24 and is preferably less than 20 nm, more preferably 15 nm or less, still more preferably 13 nm or less, and particularly preferably 10 nm or less. The average diameter thereof is preferably 5 nm or greater. In a case where the average diameter thereof is less than 20 nm, a planographic printing plate having excellent deinking capability after being left to stand is likely to be obtained.

The average diameter of small-diameter pores 26 is acquired by observing 4 sheets (N=4) of the surfaces of the anodized film 20 using a FE-SEM at a magnification of 150000 times, measuring the diameters of micropores (that is, small-diameter pores) present in a range of 400 nm×600 nm in the obtained four sheets of images, and calculating the arithmetic average value thereof. Further, in a case where the depth of the large-diameter pores is large, the average diameter of the small-diameter pores may be acquired by cutting the upper portion (that is, a region where large-diameter pores are present) of the anodized film 20 (for example, cutting the portion by argon gas) as necessary and observing the surface of the anodized film 20 using the above-described FE-SEM.

Further, in a case where the shape of the small-diameter pores 26 is not circular, an equivalent circle diameter is used.

It is preferable that the bottom portions of the small-diameter pores 26 are positioned at a position extending from the communication positions (corresponding to the depth A described above) with the large-diameter pores 24 to a position at a depth of 100 nm to 1940 nm in the depth direction. That is, the depth of the small-diameter pores 26 is preferably 100 nm or greater and less than 1940 nm. Here, from the viewpoint that the effects of the present disclosure are more excellent, it is preferable that the small-diameter pores 26 extend to a position at a depth of 300 nm to 1600 from the communication positions and more preferable that the small-diameter pores 26 extend to a position at a depth of 900 nm to 1300 from the communication positions.

In a case where the depth thereof is 100 nm or greater, a planographic printing plate precursor having excellent scratch resistance is likely to be obtained. In a case where the depth thereof is 1940 nm or less, the treatment time is shortened, and productivity and economic efficiency are likely to be excellent.

The depth of the small-diameter pores is acquired by observing the cross section of the anodized film 20 using an FE-SEM (at a magnification of 50000 times), measuring the depths of 25 small-diameter pores in the obtained image, and calculating the arithmetic average value thereof.

The shape of the small-diameter pores 26 is not particularly limited, and examples thereof include a substantially straight tubular shape (that is, a substantially columnar shape), a conical shape whose diameter decreases toward the depth direction, and a dendritic shape that branches toward the depth direction. Among these, a substantially straight tubular shape is preferable. Typically, the diameter of the small-diameter pore 26 at the bottom portion may be different from the diameter thereof at the communication position by 1 nm to 5 nm. Further, the shape of the small-diameter pores 26 at the bottom portions is not particularly limited, but may be a curved (for example, recessed) shape or a planar shape.

In the aluminum support having an anodized film, it is important that the average diameter of the small-diameter pores at the communication positions is smaller than the average diameter of the large-diameter pores at the surface of the anodized film. Since the average diameter of the small-diameter pores is smaller than the average diameter of the large-diameter pores, a planographic printing plate having excellent stain resistance (that is, the deinking capability after being left to stand) is likely to be obtained.

In regard to the average diameter of the large-diameter pores and the average diameter of the small-diameter pores, the ratio of the average diameter of the large-diameter pores to the average diameter of the small-diameter pores (average diameter of large-diameter pores/average diameter of small-diameter pores) is preferably in a range of 1.1 to 12.5 and more preferably in a range of 1.5 to 10.

Figure 3B:
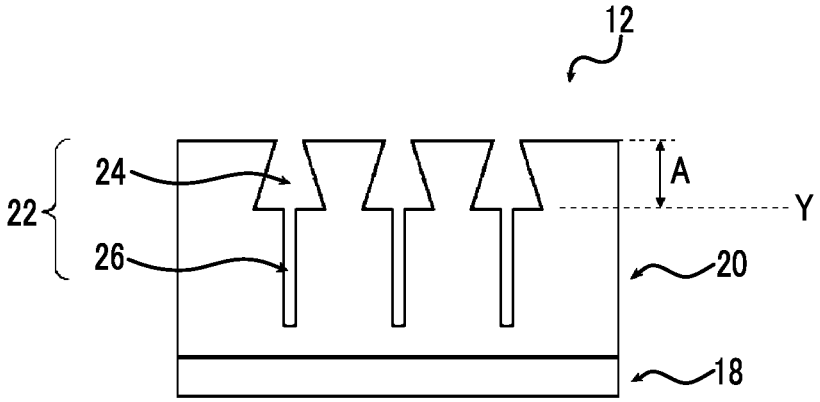
FIG. 3B is a schematic cross-sectional view illustrating another embodiment of an aluminum support having an anodized film.

As illustrated in FIG. 3B, the micropores may have a shape, in which the average diameter of the large-diameter pores at the bottom portions Y is larger than the average diameter thereof at the surface of the anodized film, and have small-diameter pores communicating with the bottom portions Y of the large-diameter pores. In a case where the average diameter of the large-diameter pores at the bottom portions Y is larger than the average diameter thereof at the surface of the anodized film, the average diameter thereof at the surface of the anodized film is preferably in a range of 10 nm to 100 nm, and the average diameter thereof at the bottom portions Y is preferably in a range of 20 nm to 300 nm.

The average diameter thereof at surface of the anodized film is preferably in a range of 10 nm to 100 nm, and more preferably in a range of 10 nm to 30 nm from the viewpoint of the stain resistance (that is, the deinking capability after being left to stand). The average diameter thereof at the bottom portions Y may be in a range of 20 nm to 300 nm and is preferably in a range of 40 nm to 200 nm.

Further, the thickness thereof at a depth of 10 nm to 100 nm from the surface of the anodized film is preferably in a range of 10 nm to 500 nm, and more preferably in a range of 50 nm to 300 nm from the viewpoint of the scratch resistance.

—Other Characteristics—

The density of the micropores 22 at the surface of the anodized film 20 is not particularly limited, but is preferably in a range of 200 pores/$\mu m^2$ to 2000 pores/$\mu m^2$ and more preferably in a range of 200 pores/$\mu m^2$ to 1000 pores/$\mu m^2$ per unit area of the anodized film.

The density of micropores 22*a* is obtained by observing 4 sheets (N=4) of the surfaces of the anodized film 20 using a field emission scanning electron microscope (FE-SEM) at a magnification of 150000 times, measuring the number of micropores present in a range of 400 nm×600 nm in the obtained four sheets of images, and calculating the arithmetic average value of the measured values.

In the anodized film 20, the micropores 22 may be distributed over the entire surface of the anodized film or may be distributed in at least a portion thereof, but it is preferable that the micropores 22 are distributed over the entire surface thereof.

It is preferable that the micropores 22 are substantially perpendicular to the surface of the anodized film.

Further, it is preferable that the micropores 22 are individually distributed in a nearly uniform state.

[Regarding Aspect 3]

Figure 4A:
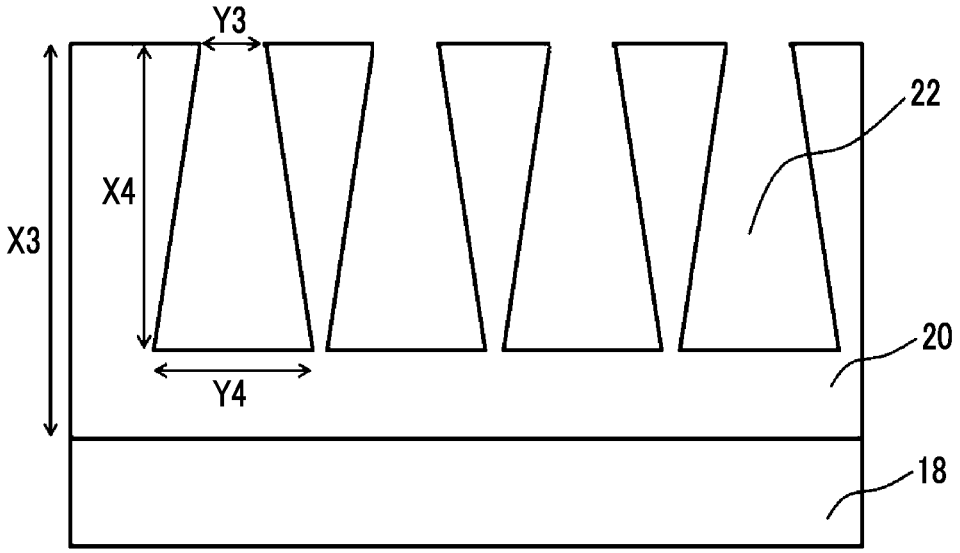
FIG. 4A is a schematic cross-sectional view illustrating still another embodiment of an aluminum support having an anodized film.

FIG. 4A is a schematic cross-sectional view illustrating an embodiment of the aspect 3.

In FIG. 4A, an average diameter Y3 of the micropores 22 at the surface of the anodized film 20 (thickness: X3) is in a range of 10 nm to 30 nm, an average value Y4 of the maximum internal diameters of the micropores 22 is in a range of 20 nm to 300 nm, and the average value Y4 of the maximum internal diameters of the micropores is larger than the average diameter Y3 of the micropores at the surface of the anodized film.

A depth X4 of the micropores 22 is greater than 10 nm, preferably 30 nm or greater, and more preferably 75 nm or greater.

The depth X4 of the micropores 22 is acquired by observing the cross section of the anodized film 20 with an FE-SEM (the magnification: 150000 times), measuring the depths of 25 micropores in the obtained image, and calculating the arithmetic average value thereof.

The average diameter Y3 of the micropores 22 at the surface of the anodized film is preferably in a range of 10 nm to 30 nm, more preferably in a range of 11 nm to 25 nm, and still more preferably in a range of 12 nm to 20 nm.

Further, the average value Y4 of the maximum internal diameters of the micropores is preferably in a range of 10 nm to 300 nm, more preferably in a range of 15 nm to 200 nm, and still more preferably in a range of 20 nm to 100 nm.

The ratio of the average value Y4 of the maximum internal diameters of the micropores 22 to the average diameter Y3 of the micropores at the surface of the anodized film is preferably in a range of 1.2 times to 10 times, more preferably in a range of 1.5 times to 8 times, and still more preferably in a range of 2 times to 5 times.

The ratio of the average value Y4 of the maximum internal diameters of the micropores 22 to the average diameter Y3 of the micropores 22 is a value acquired by Expression 1B.

(average value *Y*4 of maximum internal diameters of micropores 22)/(average diameter *Y*3 of micropores 22 at surface of anodized film) Expression 1B:

The average diameter Y3 of the micropores at the surface of the anodized film is acquired according to the same method as that for the average diameter Y1 in the aspect 1 described above.

The average value Y4 of the maximum internal diameters of the micropores 22 is acquired by observing 4 sheets (N=4) of the surfaces of the anodized film 20 using an FE-SEM at a magnification of 150000 times, measuring the maximum values of the diameters of the micropores 22 present in a range of 400 nm×600 nm in the obtained four sheets of images, and calculating the arithmetic average value thereof. Further, in a case where the depth of the micropores 22 is large, the average diameter Y4 of the micropores 22 at the bottom portions may be acquired by cutting the upper portion of the anodized film 20 (for example, cutting the portion by argon gas) to be parallel to the anodized film as necessary and observing the surface of the anodized film 20 using the above-described FE-SEM.

Further, in a case where the shape of the micropores 22 is not circular, an equivalent circle diameter is used.

The shape of the micropores 22 in the aspect 3 is not particularly limited, and examples thereof include a substantially straight tubular shape, a substantially columnar shape, a conical shape whose diameter decreases toward the depth direction (that is, the thickness direction), an inverse conical shape whose diameter increases toward the depth direction (that is, the thickness direction), a columnar shape having a central portion with a large diameter, and a columnar shape having a central portion with a small diameter. Among these, a substantially straight tubular shape is preferable. Further, the shape of the micropores 22 at the bottom portions is not particularly limited and may be a curved (for example, recessed) shape or a planar shape.

Figure 4B:
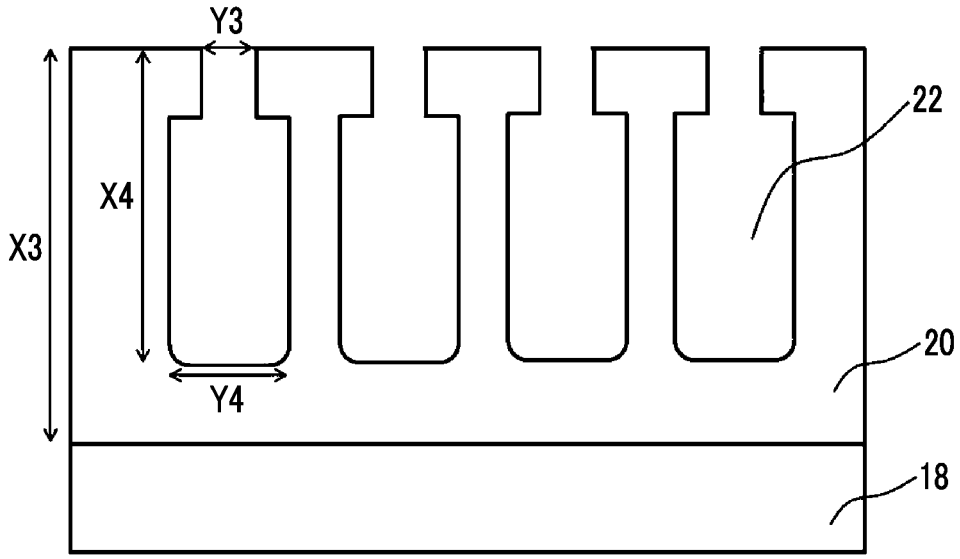
FIG. 4B is a schematic cross-sectional view illustrating even still another embodiment of an aluminum support having an anodized film.

Further, as illustrated in FIG. 4B (references 18, 20, 22, X3, X4, Y3, and Y4 in FIG. 4B have the same definitions as those for references 18, 20, 22, X3, X4, Y3, and Y4 in FIG. 4A, respectively), the shape of the micropores 22 may be a shape obtained by combining a column having a small diameter and a column having a large diameter. The shape of these columns is also not particularly limited and may be a substantially straight tubular shape, a conical shape, an inverse conical shape, a columnar shape having a central portion with a large diameter, or a columnar shape having a central portion with a small diameter. Among these, a substantially straight tubular shape is preferable. Even in the shape illustrated in FIGS. 4A and 4B, the shape of the micropores 22 at the bottom portions is not particularly limited and may be a curved (for example, recessed) shape or a planar shape.

—Other Characteristics—

The density of the micropores 22 at the surface of the anodized film 20 is not particularly limited, but is preferably in a range of 200 pores/$\mu m^2$ to 2000 pores/$\mu m^2$ and more preferably in a range of 200 pores/$\mu m^2$ to 1000 pores/$\mu m^2$ per unit area of the anodized film.

The density of micropores 22*a* is obtained by observing 4 sheets (N=4) of the surfaces of the anodized film 20 using a field emission scanning electron microscope (FE-SEM) at a magnification of 150000 times, measuring the number of micropores present in a range of 400 nm×600 nm in the obtained four sheets of images, and calculating the arithmetic average value of the measured values.

In the anodized film 20, the micropores 22 may be distributed over the entire surface of the anodized film or may be distributed in at least a portion thereof, but it is preferable that the micropores 22 are distributed over the entire surface thereof.

It is preferable that the micropores 22 are substantially perpendicular to the surface of the anodized film.

Further, it is preferable that the micropores 22 are individually distributed in a nearly uniform state.

<Method of Producing Aluminum Support Having Anodized Film>

Hereinafter, a method of producing an aluminum support having an anodized film in the planographic printing plate precursor according to the embodiment of the present disclosure will be described.

Further, the method of producing the aluminum support having an anodized film is not particularly limited, but a production method of sequentially performing the following steps is preferable.

Roughening treatment step: a step of performing a roughening treatment on an aluminum plate (First anodization treatment step) a step of anodizing the aluminum plate which has been subjected to the roughening treatment Pore widening treatment step: a step of widening the diameters of micropores in the anodized film by bringing the aluminum plate having the anodized film obtained in the first anodization treatment step into contact with an acid aqueous solution or an alkaline aqueous solution Second anodization treatment step: a step of anodizing the aluminum plate obtained by the pore widening treatment step Hydrophilization treatment step: a step of performing the hydrophilization treatment on the aluminum plate obtained in the second anodization treatment step Hereinafter, each of the above-described steps will be described in detail. Further, the roughening treatment step and the hydrophilization treatment step may not be performed in a case where the steps are not necessary.

According to the production method described above, the aluminum support according to the aspect 2 described above is obtained.

Figure 5A:
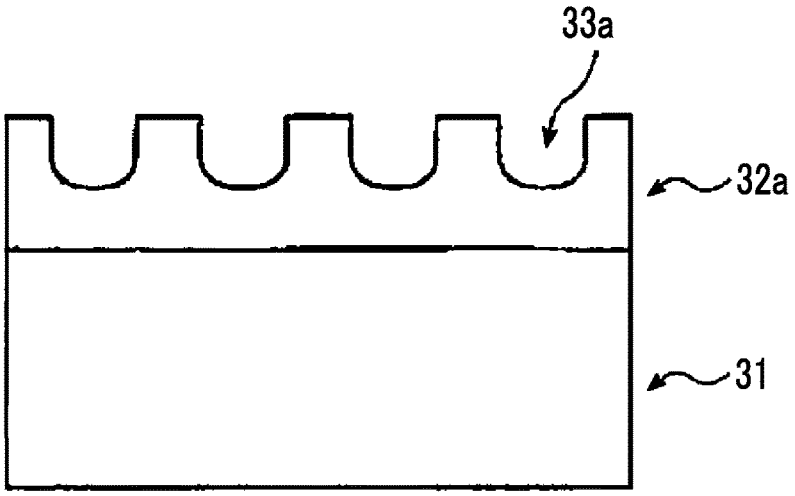
FIGS. 5A to 5C are schematic cross-sectional views illustrating an aluminum support having an anodized film by sequentially showing steps from a first anodization treatment step to a second anodization treatment step.
Figure 5B:
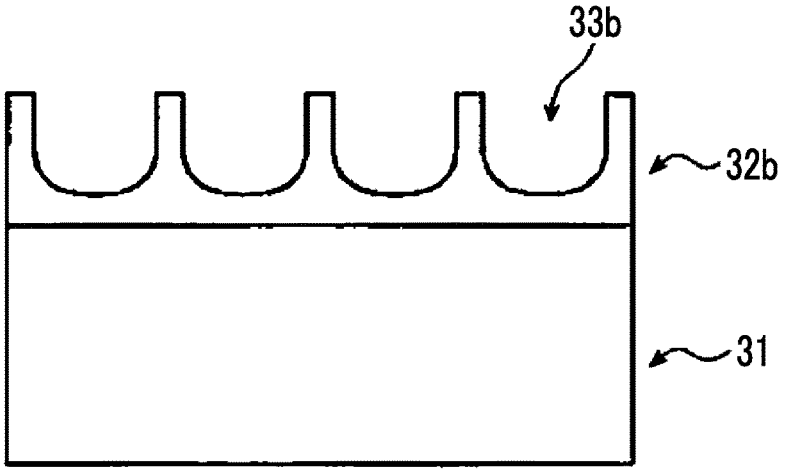
Figure 5C:
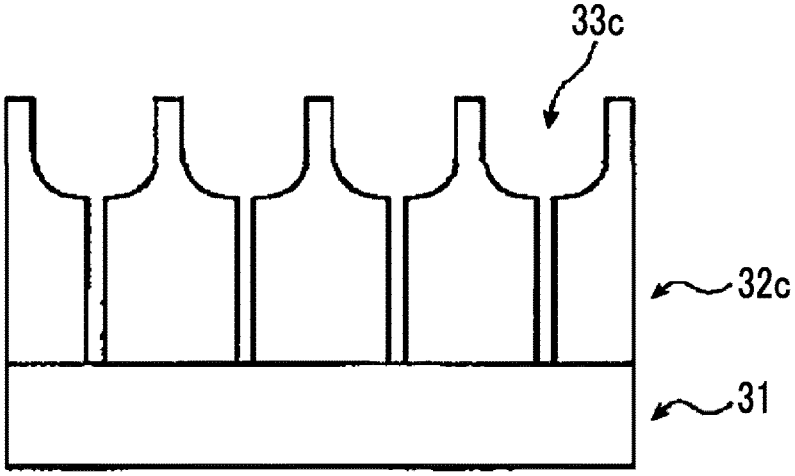

FIGS. 5A to 5C are schematic cross-sectional views illustrating an aluminum support having an anodized film by sequentially showing steps from the first anodization treatment step to the second anodization treatment step.

[Roughening Treatment Step]

The roughening treatment step is a step of performing a roughening treatment including an electrochemical roughening treatment on a surface of an aluminum plate. It is preferable that the roughening treatment step is performed before the first anodization treatment step described below, but may not be performed in a case where the surface of the aluminum plate already has a preferable surface shape.

The roughening treatment may be carried out by performing only an electrochemical roughening treatment, but may be carried out by combining an electrochemical roughening treatment and a mechanical roughening treatment and/or a chemical roughening treatment.

In a case where the mechanical roughening treatment and the electrochemical roughening treatment are used in combination, it is preferable that the electrochemical roughening treatment is performed after the mechanical roughening treatment.

Figure 8:
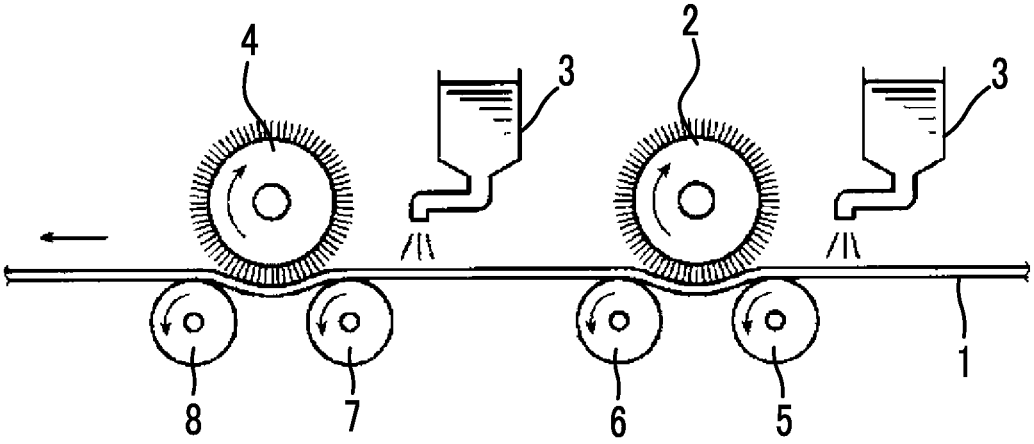
FIG. 8 is a side view illustrating the concept of a brush graining step used for a mechanical roughening treatment according to the method of producing an aluminum support having an anodized film.
Figure 9:
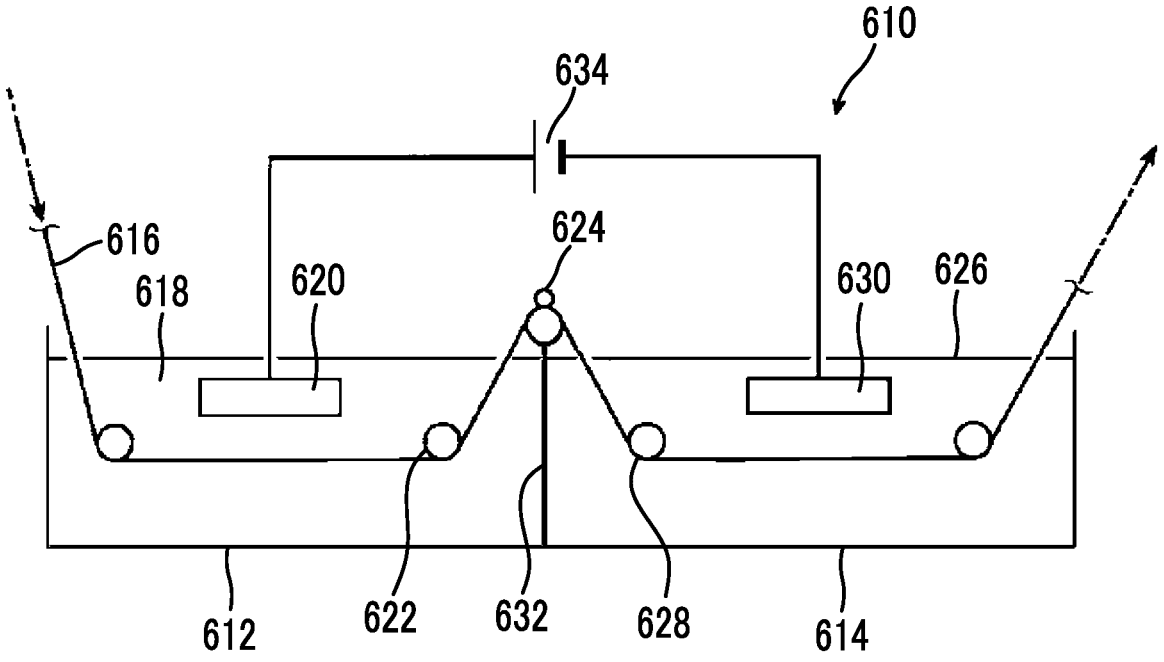
FIG. 9 is a schematic view illustrating an anodization treatment device used for an anodization treatment according to the method of producing an aluminum support having an anodized film.

The mechanical roughening treatment is performed using, for example, a device illustrated in FIG. 8. Specifically, while supplying a suspension of a polishing agent (pumice) with a specific gravity of 1.1 g/cm$^3$ and water to the surface of the aluminum plate as a polishing slurry liquid, a mechanical roughening treatment was performed using rotating bundle bristle brushes. In FIG. 8, the reference numeral 1 represents an aluminum plate, the reference numerals 2 and 4 represent roller-like brushes (for example, bundle bristle brushes), the reference numeral 3 represents a polishing slurry liquid, and the reference numerals 5, 6, 7, and 8 represent a support roller.

It is preferable that the electrochemical roughening treatment is performed in an aqueous solution of nitric acid or hydrochloric acid.

The mechanical roughening treatment is typically performed for the purpose of setting the surface of the aluminum plate to have a surface roughness Ra of 0.35 μm to 1.0 pin.

The conditions for the mechanical roughening treatment are not particularly limited, but the treatment can be performed, for example, according to the method described in JP1975-40047B (JP-S50-40047B). Examples of the mechanical roughening treatment include a brush grain treatment using a pumice stone suspension and a treatment carried out using a transfer method.

The chemical roughening treatment is also not particularly limited, and can be performed according to a known method.

It is preferable that a chemical etching treatment described below is performed after the mechanical roughening treatment.

The chemical etching treatment to be performed after the mechanical roughening treatment is performed in order to smooth an edge portion of the uneven shape of the surface of the aluminum plate, prevent the ink from being caught during printing, improve the stain resistance (that is, the deinking capability after being left to stand) of the planographic printing plate, and remove unnecessary matter such as polishing material particles remaining on the surface.

As the chemical etching treatment, etching carried out using an acid and etching carried out using an alkali are known, and a chemical etching treatment (hereinafter, also referred to as an "alkali etching treatment") carried out using an alkaline solution is exemplified as a particularly excellent method in terms of etching efficiency.

An alkali agent used for the alkaline solution is not particularly limited, and suitable examples thereof include caustic soda, caustic potash, sodium metasilicate, soda carbonate, soda aluminate, and soda gluconate.

The alkali agent may contain aluminum ions. The concentration of the alkaline solution is preferably 0.01% by mass or greater and more preferably 3% by mass or greater. Further, the concentration thereof is preferably 30% by mass or less and more preferably 25% by mass or less.

The temperature of the alkaline solution is preferably room temperature (25° C.) or higher and more preferably 30° C. or higher. Further, the temperature thereof is preferably 80° C. or lower and more preferably 75° C. or lower.

The etching amount is preferably 0.1 g/m$^2$ or greater and more preferably 1 g/m$^2$ or greater. Further, the etching amount thereof is preferably 20 g/m$^2$ or less and more preferably 10 g/m$^2$ or less.

The treatment time is preferably in a range of 2 seconds to 5 minutes depending on the etching amount, and more preferably 2 to 10 seconds from the viewpoint of improving the productivity.

In a case where the alkali etching treatment is performed after the mechanical roughening treatment, it is preferable that the chemical etching treatment (hereinafter, also referred to as a "desmutting treatment") is performed using an acidic solution at a low temperature in order to remove a product generated due to the alkali etching treatment.

The acid used for the acidic solution is not particularly limited, and examples thereof include sulfuric acid, nitric acid, and hydrochloric acid. The concentration of the acidic solution is preferably in a range of 1% by mass to 50% by mass. Further, the temperature of the acidic solution is preferably in a range of 20° C. to 80° C. In a case where the concentration and temperature of the acidic solution are respectively in the above-described range, the stain resistance (that is, the deinking capability after being left to stand) of the planographic printing plate is further improved.

The roughening treatment is a treatment for performing a electrochemical roughening treatment after the mechanical roughening treatment and the chemical etching treatment as desired, and even in a case where the electrochemical roughening treatment is performed without carrying out the mechanical roughening treatment, a chemical etching treatment can be performed using an alkaline aqueous solution such as caustic soda (that is, sodium hydroxide) before the electrochemical roughening treatment. In this manner, impurities and the like present in the vicinity of the surface of the aluminum plate can be removed.

Since fine unevenness (that is, pits) can be easily imparted to the surface of the aluminum plate by the electrochemical roughening treatment, it is suitable for preparing a planographic printing plate with excellent printability.

It is preferable that the electrochemical roughening treatment is performed in an aqueous solution mainly containing nitric acid or hydrochloric acid using a direct current or an alternating current.

It is preferable that a chemical etching treatment described below is performed after the electrochemical roughening treatment. A smut or an intermetallic compound mainly containing aluminum hydroxide generated by the electrochemical roughening treatment is present on the surface of the aluminum plate after the electrochemical roughening treatment. In the chemical etching treatment performed after the electrochemical roughening treatment, it is preferable that the chemical etching treatment is initially performed using an alkaline solution (that is, the alkali etching treatment) in order to efficiently remove the smut. It is preferable that the chemical etching treatment using an alkaline solution is performed under the conditions of a treatment temperature of 20° C. to 80° C. and a treatment time of 1 second to 60 seconds. It is preferable that the alkaline solution contains aluminum ions.

After the chemical etching treatment is performed using an alkaline solution after the electrochemical roughening treatment, it is preferable that a chemical etching treatment (that is, a desmutting treatment) is performed using an acidic solution at a low temperature in order to remove the product generated due to the chemical etching treatment.

Even in a case where the alkali etching treatment is not performed after the electrochemical roughening treatment, it is preferable that the desmutting treatment is performed in order to efficiently remove the smut.

The above-described chemical etching treatment can be performed by an immersion method, a shower method, a coating method, or the like, and the method is not particularly limited.

[First Anodization Treatment Step]

A first anodization treatment step is a step of forming an aluminum oxide film having micropores extending along the depth direction (that is, the thickness direction) from the surface of the aluminum plate by performing an anodization treatment on the aluminum plate which has been subjected to the above-described roughening treatment. By performing the first anodization treatment, an anodized aluminum film 32*a* having micropores 33*a* is formed on the surface of the aluminum plate 31 as illustrated in FIG. 5A.

The first anodization treatment can be carried out by a method of the related art which has been performed in this field, but the production conditions are appropriately set such that the above-described micropores can be finally formed.

Specifically, the average diameter (that is, the average opening diameter) of the micropores 33*a* formed in the first anodization treatment step is preferably approximately 4 nm to 14 nm and more preferably in a range of 5 nm to 10 nm. In a case where the average diameter is in the above-described range, the micropores having a predetermined shape can be easily formed, and the performance of the planographic printing plate precursor to be obtained is also more excellent.

Further, the depth of the micropores 33*a* is preferably approximately 60 nm to less than 200 nm and more preferably in a range of 70 nm to 100 nm. In a case where the average diameter is in the above-described range, the micropores having a predetermined shape can be easily formed, and the performance of the planographic printing plate precursor to be obtained is also more excellent.

The pore density of the micropores 33*a* is not particularly limited, but the pore density is preferably in a range of 50 pores/$\mu m^2$ to 4000 pores/$\mu m^2$ and more preferably in a range of 100 pores/$\mu m^2$ to 3000 pores/$\mu m^2$. In a case where the density thereof is in the above-described range, the printing durability and the deinking capability after being left to stand of the planographic printing plate to be obtained and the developability of the planographic printing plate precursor are excellent.

The film thickness of the anodized film obtained by the first anodization treatment step is preferably in a range of 70 nm to 300 nm and more preferably in a range of 80 nm to 150 nm. In a case where the film thickness thereof is in the above-described range, the printing durability and the stain resistance (that is, the deinking capability after being left to stand) of the planographic printing plate to be obtained and the developability of the planographic printing plate precursor are excellent.

The coating amount of the anodized film obtained by the first anodization treatment step is preferably in a range of 0.1 g/$m^2$ to 0.3 g/$m^2$ and more preferably in a range of 0.12 g/$m^2$ to 0.25 g/$m^2$. In a case where the film thickness thereof is in the above-described range, the printing durability and the stain resistance (that is, the deinking capability after being left to stand) of the planographic printing plate to be obtained and the developability of the planographic printing plate precursor are excellent.

In the first anodization treatment step, an aqueous solution such as sulfuric acid, oxalic acid, or phosphoric acid can be used as an electrolytic cell. An aqueous solution or a non-aqueous solution obtained by using one or two or more of chromic acid, sulfamic acid, benzenesulfonic acid, and the like in a combination can also be used in some cases. In a case where a direct current or an alternating current is allowed to pass through the aluminum plate in the electrolytic cell described above, an anodized film can be formed on the surface of the aluminum plate. It is known that a change in kind of the electrolytic solution changes the pore diameter significantly. The size of the pore diameter can be roughly arranged in an ascending order of "the pore diameter in a sulfuric acid electrolytic solution<the pore diameter in an oxalic acid electrolytic solution<the pore diameter of a phosphoric acid electrolytic solution".

Therefore, the treatment can be performed twice by replacing the electrolytic solution or the treatment can be performed by connecting two or three treatment devices in a series at two stages or three stages continuously to obtain an anodized film structure.

For example, a film having large pores at the bottom portions can be obtained using a phosphoric acid electrolytic solution while the pore diameter of the opening portion at the surface of the anodized film is maintained, according to the method described in JP2002-365791A.

The electrolytic bath may contain aluminum ions. The content of the aluminum ions is not particularly limited, but is preferably in a range of 1 g/L to 10 g/L.

The conditions for the anodization treatment are appropriately set depending on the electrolytic solution to be used. As the appropriate conditions, typically, the concentration of the electrolytic solution is in a range of 1% by mass to 80% by mass (preferably in a range of 5% by mass to 20% by mass), the liquid temperature is in a range of 5° C. to 70° C. (preferably in a range of 10° C. to 60° C.), the current density is in a range of 0.5 A/$dm^2$ to 60 A/$dm^2$ (preferably in a range of 5 A/$dm^2$ to 50 A/$dm^2$), the voltage is in a range of 1 V to 100 V (preferably in a range of 5 V to 50 V), and the electrolysis time is in a range of 1 second to 100 seconds (preferably in a range of 5 seconds to 60 seconds).

Among the methods for the anodization treatment described above, the method of performing anodization in sulfuric acid at a high current density, which is described in UK Patent No. 1421768 is particularly preferable.

[Pore Widening Treatment Step]

The pore widening treatment step is a treatment (that is, the pore diameter widening treatment) of expanding the diameter (that is, the pore diameter) of micropores present in the anodized film formed by the above-described first anodization treatment step. By performing the pore widening treatment, the diameter of the micropores 33*a* is expanded, and thus an anodized film 32*b* having micropores 33*b* with a larger average diameter is formed as illustrated in FIG. 5B.

By performing the pore widening treatment, the average diameter of the micropores 33*b* is expanded to a range of 10 nm to 100 nm (preferably a range of 15 nm to 60 nm and more preferably a range of 18 nm to 40 nm). The micropores 33*b* are portions corresponding to the large-diameter pores 24 (FIG. 5A) described above.

It is preferable that the depth of the micropores 33*b* from the surface of the anodized film is adjusted to be the same as the above-described depth A (FIG. 3A) by performing the pore widening treatment.

The pore widening treatment is performed by bringing the aluminum plate obtained by the first anodization treatment step described above into contact with an acid aqueous solution or an alkaline aqueous solution. The method of bringing the aluminum plate into contact with the solution is not particularly limited, and examples thereof include an immersion method and a spray method. Among these, an immersion method is preferable.

In a case where an alkaline aqueous solution is used in the pore widening treatment step, it is preferable to use at least one alkaline aqueous solution selected from the group consisting of sodium hydroxide, potassium hydroxide, and lithium hydroxide. The concentration of the alkaline aqueous solution is preferably in a range of 0.1% by mass to 5% by mass.

After the pH of the alkaline aqueous solution is adjusted to be in a range of 11 to 13, it is appropriate that the aluminum plate is brought into contact with the alkaline aqueous solution for 1 second to 300 seconds (preferably in a range of 1 second to 50 seconds) under a temperature condition of 10° C. to 70° C. (preferably in a range of 20° C. to 50° C.).

The alkaline treatment liquid may contain a polyvalent metal salt of a weak acid such as a carbonate, a borate, or a phosphate.

In a case where an acid aqueous solution is used in the pore widening treatment step, it is preferable to use an aqueous solution of an inorganic acid such as sulfuric acid, phosphoric acid, nitric acid, or hydrochloric acid or a mixture thereof. The concentration of the acid aqueous solution is preferably in a range of 1% by mass to 80% by mass and more preferably in a range of 5% by mass to 50% by mass.

It is appropriate that the aluminum plate is brought into contact with the acid aqueous solution for 1 second to 300 seconds (preferably in a range of 1 second to 150 seconds) under the condition that the liquid temperature of the acid aqueous solution is set to be in a range of 5° C. to 70° C. (preferably in a range of 10° C. to 60° C.).

The alkaline aqueous solution or the acid aqueous solution may contain aluminum ions. The content of the aluminum ions is not particularly limited, but is preferably in a range of 1 g/L to 10 g/L.

[Second Anodization Treatment Step]

The second anodization treatment step is a step of forming micropores extending along the depth direction (that is, the thickness direction) by performing the anodization treatment on the aluminum plate which has been subjected to the above-described pore widening treatment. By performing the second anodization treatment step, an anodized film 32*c* having micropores 33*c* extending along the depth direction is formed as illustrated in FIG. 5C.

By the second anodization treatment step, new pores that communicate the bottom portions of the micropores 33*b* with expanded average diameter, have an average diameter smaller than the average diameter of the micropores 33*b* (that is, corresponding to the large-diameter pores 24), and extend along the depth direction from the communication positions are formed. The pores correspond to the small-diameter pores 26 described above.

In the second anodization treatment step, the treatment is performed such that the average diameter of pores to be newly formed is greater than 0 nm and less than 20 nm and the depth thereof from the communication positions with the large-diameter pores 20 is in the above-described predetermined range. The electrolytic bath used for the treatment is the same as that in the above-described first anodization treatment step, and the treatment conditions are appropriately set according to the material to be used.

The conditions for the anodization treatment are appropriately set depending on the electrolytic solution to be used. As the appropriate conditions, typically, the concentration of the electrolytic solution is in a range of 1% by mass to 80% by mass (preferably in a range of 5% by mass to 20% by mass), the liquid temperature is in a range of 5° C. to 70° C. (preferably in a range of 10° C. to 60° C.), the current density is in a range of 0.5 $A/dm^2$ to 60 $A/dm^2$ (preferably in a range of 1 $A/dm^2$ to 30 $A/dm^2$), the voltage is in a range of 1 V to 100 V (preferably in a range of 5 V to 50 V), and the electrolysis time is in a range of 1 second to 100 seconds (preferably in a range of 5 seconds to 60 seconds).

The film thickness of the anodized film obtained by the second anodization treatment step is preferably in a range of 200 nm to 2000 nm and more preferably in a range of 750 nm to 1500 nm. In a case where the film thickness is in the above-described range, the printing durability and the deinking capability after being left to stand of the planographic printing plate to be obtained are excellent.

The coating amount of the anodized film obtained by the second anodization treatment step is preferably in a range of 2.2 $g/m^2$ to 5.4 $g/m^2$ and more preferably in a range of 2.2 $g/m^2$ to 4.0 $g/m^2$. In a case where the coating amount thereof is in the above-described range, the printing durability and the deinking capability after being left to stand of the planographic printing plate to be obtained and the developability and the scratch resistance of the planographic printing plate precursor are excellent.

The ratio of the thickness of the anodized film obtained by the first anodization treatment step (that is, a film thickness 1) to the thickness of the anodized film obtained by the second anodization treatment step (that is, a film thickness 2) (that is, film thickness 1/film thickness 2) is preferably in a range of 0.01 to 0.15 and more preferably in a range of 0.02 to 0.10. In a case where the ratio thereof is in the above-described range, the scratch resistance of the support for a planographic printing plate is excellent.

In order to produce the shape of the small-diameter pores 26 (see FIG. 3A) described above, the voltage to be applied in the treatment of the second anodization treatment step may be increased stepwisely or continuously. By increasing the voltage to be applied, the diameter of the pores to be formed increases, and as a result, the shape of the small-diameter pores 26 described above can be obtained.

[Third Anodization Treatment Step]

The second anodization treatment step may be followed by a third anodization treatment step.

The anodization treatment in the third anodization treatment step may be performed by appropriately setting the liquid component, the current density, the time, and the like according to the surface state of the support to be acquired according to the same method as that for the second anodization treatment step.

[Hydrophilization Treatment Step]

The method of producing the aluminum support having an anodized film may include a hydrophilization treatment step of performing a hydrophilization treatment after the anodization treatment step described above. As the hydrophilization treatment, known methods described in paragraphs 0109 to 0114 of JP2005-254638A can be used.

It is preferable that the hydrophilization treatment is performed by a method of carrying out immersion in an aqueous solution of an alkali metal silicate such as sodium silicate or potassium silicate.

The hydrophilization treatment using an aqueous solution of an alkali metal silicate such as sodium silicate or potassium silicate can be performed according to the procedures and the methods described in UP2714066A and U.S. Pat. No. 3,181,461A.

As the aluminum support having the anodized film of the present disclosure, a support obtained by sequentially performing the following treatments described in the following aspects A to D on the above-described aluminum plate is preferable. From the viewpoint of the printing durability, the aspect A is particularly preferable. It is desirable that the aluminum plate is washed with water between the treatments described below. Here, in a case where liquids having the same composition are used in two steps (that is, treatments) performed continuously, the washing of the plate with water may not be performed.

[Aspect A]

(2) Chemical etching treatment carried out in alkaline aqueous solution (first alkali etching treatment)

(3) Chemical etching treatment carried out in acidic aqueous solution (first desmutting treatment)

(4) Electrochemical roughening treatment carried out in aqueous solution that mainly contains hydrochloric acid or nitric acid (first electrochemical roughening treatment)

(5) Chemical etching treatment carried out in alkaline aqueous solution (second alkali etching treatment)

(6) Chemical etching treatment carried out in acidic aqueous solution (second desmutting treatment)

(7) Electrochemical roughening treatment carried out in aqueous solution mainly containing hydrochloric acid (second electrochemical roughening treatment)

(8) Chemical etching treatment carried out in alkaline aqueous solution (third alkali etching treatment)

(9) Chemical etching treatment carried out in acidic aqueous solution (third desmutting treatment)

(10) Anodization treatment (first anodization treatment (sulfuric acid), pore widening treatment, and second anodization treatment (sulfuric acid))

(11) Hydrophilization treatment According to the aspect A, the aluminum support according to the aspect 2 described above can be obtained.

[Aspect B]

(2) Chemical etching treatment carried out in alkaline aqueous solution (first alkali etching treatment)

(3) Chemical etching treatment carried out in acidic aqueous solution (first desmutting treatment)

(12) Electrochemical roughening treatment carried out in aqueous solution mainly containing hydrochloric acid or nitric acid (5) Chemical etching treatment carried out in alkaline aqueous solution (second alkali etching treatment)

(6) Chemical etching treatment carried out in acidic aqueous solution (second desmutting treatment)

(10) Anodization treatment (first anodization treatment (sulfuric acid) and pore widening treatment)

(11) Hydrophilization treatment

According to the aspect B, the aluminum support according to the aspect 1 described above can be obtained.

[Aspect C]

(2) Chemical etching treatment carried out in alkaline aqueous solution (first alkali etching treatment)

(3) Chemical etching treatment carried out in acidic aqueous solution (first desmutting treatment)

(12) Electrochemical roughening treatment carried out in aqueous solution mainly containing hydrochloric acid or nitric acid (5) Chemical etching treatment carried out in alkaline aqueous solution (second alkali etching treatment)

(6) Chemical etching treatment carried out in acidic aqueous solution (second desmutting treatment)

(10) Anodization treatment (first anodization treatment (phosphoric acid) and second anodization treatment (sulfuric acid))

(11) Hydrophilization treatment

According to the aspect C, the aluminum support according to the aspect 2 described above can be obtained.

[Aspect D]

(2) Chemical etching treatment carried out in alkaline aqueous solution (first alkali etching treatment)

(3) Chemical etching treatment carried out in acidic aqueous solution (first desmutting treatment)

(12) Electrochemical roughening treatment carried out in aqueous solution mainly containing hydrochloric acid or nitric acid (5) Chemical etching treatment carried out in alkaline aqueous solution (second alkali etching treatment)

(6) Chemical etching treatment carried out in acidic aqueous solution (second desmutting treatment)

(10) Anodization treatment (first anodization treatment (phosphoric acid))

(11) Hydrophilization treatment

According to the aspect D, the aluminum support according to the aspect 3 described above can be obtained.

A mechanical roughening treatment (1) may be performed before the treatment (2) of each of the aspects A to D. From the viewpoints of the printing durability and the like, it is preferable that each aspect does not include the treatment (1).

Here, the mechanical roughening treatment, the electrochemical roughening treatment, the chemical etching treatment, the anodization treatment, and the hydrophilization treatment in the items (1) to (12) can be performed under the same conditions as described above according to the same treatment method as described above, but it is preferable that the treatments are performed under the conditions described below according to the following treatment method.

It is preferable that the mechanical roughening treatment is carried out by mechanically performing a roughening treatment with a rotating nylon brush roll having a hair diameter of 0.2 mm to 1.61 mm and a slurry liquid to be supplied to the surface of the aluminum plate. A known material can be used as a polishing agent, but silica sand, quartz, aluminum hydroxide, or a mixture thereof is preferable. The specific gravity ($g/cm^3$) of the slurry liquid is preferably in a range of 1.05 $g/cm^3$ to 1.3 $g/cm^3$. Further, a method of spraying a slurry liquid, a method of using a wire brush, a method of transferring the surface shape of a rolling roll with unevenness to an aluminum plate, or the like may be used.

The concentration of the alkaline aqueous solution used for the chemical etching treatments carried out in the alkaline aqueous solution (that is, the first alkali etching treatment, the second alkali etching treatment, and the third alkali etching treatment) is preferably in a range of 1% by mass to 30% by mass, and the content of the alloy component contained in aluminum and the aluminum alloy may be in a range of 0% by mass to 10% by mass.

As the alkaline aqueous solution, an aqueous solution mainly containing caustic soda is particularly preferable. It is preferable that the treatment is carried out at a liquid temperature of room temperature (25° C.) to 95° C. for 1 second to 120 seconds.

After completion of the etching treatment, it is preferable to perform liquid draining using a nip roller and washing with water using a spray so that the treatment liquid is not brought into the next step.

The amount of the aluminum plate to be dissolved in the first alkali etching treatment is preferably in a range of 0.5 $g/m^2$ to 30 $g/m^2$, more preferably in a range of 1.0 $g/m^2$ to 20 $g/m^2$, and still more preferably in a range of 3.0 $g/m^2$ to 15 $g/m^2$.

The amount of the aluminum plate to be dissolved in the second alkali etching treatment is preferably in a range of 0.001 $g/m^2$ to 30 $g/m^2$, more preferably in a range of 0.1 $g/m^2$ to 4 $g/m^2$, and still more preferably in a range of 0.2 $g/m^2$ to 1.5 $g/m^2$.

The amount of the aluminum plate to be dissolved in the third alkali etching treatment is preferably in a range of 0.001 $g/m^2$ to 30 $g/m^2$, more preferably in a range of 0.01 $g/m^2$ to 0.8 $g/m^2$, and still more preferably in a range of 0.02 $g/m^2$ to 0.3 $g/m^2$.

In the chemical etching treatments carried out in an acidic aqueous solution (that is, the first alkali etching treatment, the second alkali etching treatment, and the third desmutting treatment), phosphoric acid, nitric acid, sulfuric acid, chromium acid, hydrochloric acid, or mixed acids including two or more of these acids are suitably used. The concentration of the acidic aqueous solution is preferably in a range of 0.5% by mass to 60% by mass. The alloy component contained in aluminum and the aluminum alloy may be dissolved in the acidic aqueous solution by 0% by mass to 5% by mass.

It is preferable that the treatment is carried out at a liquid temperature of room temperature to 95° C. for a treatment time of 1 second to 120 seconds. After completion of the desmutting treatment, it is preferable to perform liquid draining using a nip roller and washing with water using a spray so that the treatment liquid is not brought into the next step.

The aqueous solution used for the electrochemical roughening treatment will be described.

As the aqueous solution mainly containing nitric acid used for the first electrochemical roughening treatment, an aqueous solution used for the electrochemical roughening treatment using a typical direct current or alternating current can be used, and one or more of hydrochloric acid or nitric acid compounds having nitrate ions such as aluminum nitrate, sodium nitrate, and ammonium nitrate; and hydrochloric acid ions such as aluminum chloride, sodium chloride, and ammonium chloride can be added to a 1 g/L to 100 g/L nitric acid aqueous solution at a concentration of 1 g/L to a saturation concentration and then used.

A metal contained in an aluminum alloy such as iron, copper, manganese, nickel, titanium, magnesium, and silica may be dissolved in an aqueous solution mainly containing nitric acid.

Specifically, it is preferable to use a liquid obtained by adding aluminum chloride and aluminum nitrate to a 0.5 to 2 mass % nitric acid aqueous solution such that the amount of aluminum ions therein is in a range of 3 g/L to 50 g/L.

The liquid temperature is preferably in a range of 10° C. to 90° C. and more preferably in a range of 40° C. to 80° C.

As the aqueous solution mainly containing hydrochloric acid used for the second electrochemical roughening treatment, an aqueous solution used for the electrochemical roughening treatment using a typical direct current or alternating current can be used, and one or more of hydrochloric acid or nitric acid compounds having nitrate ions such as aluminum nitrate, sodium nitrate, and ammonium nitrate; and hydrochloric acid ions such as aluminum chloride, sodium chloride, and ammonium chloride can be added to a 1 g/L to 100 g/L hydrochloric acid aqueous solution at a concentration of 1 g/L to a saturation concentration and then used.

A metal contained in an aluminum alloy such as iron, copper, manganese, nickel, titanium, magnesium, and silica may be dissolved in an aqueous solution mainly containing hydrochloric acid.

Specifically, it is preferable to use a liquid obtained by adding aluminum chloride and aluminum nitrate to a 0.5 to 2 mass % hydrochloric acid aqueous solution such that the amount of aluminum ions therein is in a range of 3 g/L to 50 g/L.

The liquid temperature is preferably in a range of 10° C. to 60° C. and more preferably in a range of 20° C. to 50° C. Further, hypochlorous acid may be added thereto.

In addition, as the aqueous solution mainly containing hydrochloric acid used for the electrochemical roughening treatment in the hydrochloric acid aqueous solution in the aspect B, an aqueous solution used for the electrochemical roughening treatment carried out using a typical direct current or alternating current can be used, and 0 g/L to 30 g/L of sulfuric acid can be added to a 1 g/L to 100 g/L hydrochloric acid aqueous solution and then used. One or more of hydrochloric acid or nitric acid compounds having nitrate ions such as aluminum nitrate, sodium nitrate, and ammonium nitrate; and hydrochloric acid ions such as aluminum chloride, sodium chloride, and ammonium chloride can be added to the aqueous solution at a concentration of 1 g/L to a saturation concentration and then used.

A metal contained in an aluminum alloy such as iron, copper, manganese, nickel, titanium, magnesium, and silica may be dissolved in an aqueous solution mainly containing hydrochloric acid.

Specifically, it is preferable to use a liquid obtained by adding aluminum chloride, aluminum nitrate, or the like to a 0.5 to 2 mass % nitric acid aqueous solution such that the amount of the aluminum ions is in a range of 3 g/L to 50 g/L.

The liquid temperature is preferably in a range of 10° C. to 60° C. and more preferably in a range of 20° C. to 50° C. Further, hypochlorous acid may be added thereto.

As the AC power source waveform of the electrochemical roughening treatment, a sine wave, a square wave, a trapezoidal wave, or a triangular wave can be used. The frequency is preferably in a range of 0.1 Hz to 250 Hz.

Figure 6:
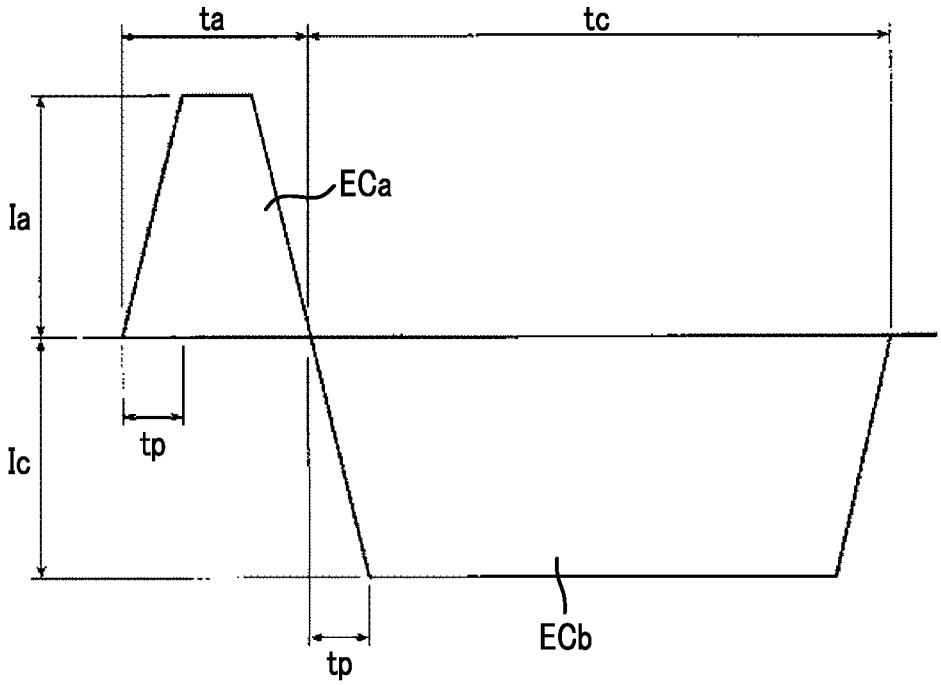
FIG. 6 is a graph showing an example of an alternating waveform current waveform diagram used for an electrochemical roughening treatment according to a method of producing an aluminum support having an anodized film.

FIG. 6 is a graph showing an example of an alternating waveform current waveform diagram used for an electrochemical roughening treatment according to a method of producing the aluminum support having an anodized film.

In FIG. 6, ta represents an anodic reaction time, tc represents a cathodic reaction time, tp represents a time taken for the current to reach the peak from 0, Ia represents the peak current on an anode cycle side, and Ic represents the peak current on a cathode cycle side. In the trapezoidal wave, the time tp taken for the current to reach the peak from 0 is preferably in a range of 1 ms to 10 ms.

From the viewpoint of the equipment cost of the power supply, it is preferable that the time tp is 1 or longer because the power supply voltage required in a case of the rise of the current waveform decreases due to the influence of the impedance of a power supply circuit. In a case where the time tp is 10 ms or shorter, the treatment is unlikely to be affected by a trace amount of the components in the electrolytic solution, and thus uniform roughening is easily performed.

As the preferable conditions for one cycle of the alternating current used for the electrochemical roughening, a ratio tc/ta of the cathodic reaction time tc to the anodic reaction time ta of the aluminum plate is in a range of 1 to 20, a ratio Qc/Qa of an electric quantity Qc in a case of the aluminum plate serving as a cathode to an electric quantity Qa in a case of the aluminum plate serving as an anode is in a range of 0.3 to 20, and the anodic reaction time ta is in a range of 5 msec to 1000 msec. The ratio tk/ta is more preferably in a range of 2.5 to 15. The ratio Qc/Qa is more preferably in a range of 2.5 to 15. The current density is preferably in a range of 10 $A/dm^2$ to 200 $A/dm^2$ in both an anode cycle side Ia and a cathode cycle side Ic of the current in terms of the peak value of the trapezoidal wave. The ratio Ic/Ia is preferably in a range of 0.3 to 20. The total electric quantity of the aluminum plate used for the anodic reaction in a case where the electrochemical roughening is completed is preferably in a range of 25 $C/dm^2$ to 1000 $C/dm^2$.

As the electrolytic cell used for electrochemical roughening carried out using the alternating current, an electrolytic cell used for a known surface treatment such as vertical type surface treatment, a flat type surface treatment, or a radial type surface treatment can be used, and a radial type electrolytic cell as described in JP1993-195300A (JP-HOS-195300A) is particularly preferable.

Figure 7:
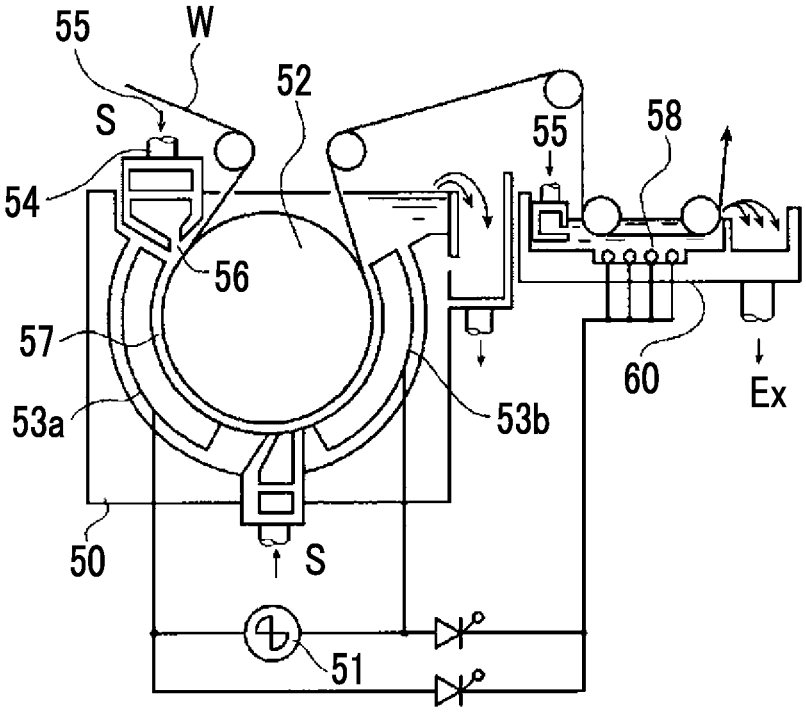
FIG. 7 is a side view illustrating an example of a radial type cell in the electrochemical roughening treatment carried out using the alternating current according to the method of producing an aluminum support having an anodized film.

A device illustrated in FIG. 7 can be used for the electrochemical roughening carried out using the alternating current. FIG. 7 is a side view illustrating an example of a radial type cell in the electrochemical roughening treatment carried out using the alternating current according to the method of producing the aluminum support having an anodized film.

In FIG. 7, the reference numeral 50 represents a main electrolytic cell, the reference numeral 51 represents an AC power source, the reference numeral 52 represents a radial drum roller, the reference numerals 53*a* and 53*b* represent a main pole, the reference numeral 54 represents an electrolytic solution supply port, the reference numeral 55 represents an electrolytic solution, the reference numeral 56 represents a slit, the reference numeral 57 represents an electrolytic solution passage, the reference numeral 58 represents an auxiliary anode, the reference numeral 60 represents an auxiliary anode cell, and the symbol W represents an aluminum plate. In a case where two or more electrolytic cells are used, the electrolysis conditions may be the same as or different from each other.

The aluminum plate W is wound around the radial drum roller 52 disposed by being immersed in the main electrolytic cell 50 and is electrolyzed by the main poles 53*a* and 53*b* connected to the AC power source 51 in the transport process. The electrolytic solution 55 is supplied to the electrolytic solution passage 57 disposed between the radial drum roller 52 and the main pole 53*a* and between the radial drum roller 52 and the main pole 53*b* through the slit 56 from the electrolytic solution supply port 54. The aluminum plate W which has been treated in the main electrolytic cell 50 is subjected to an electrolytic treatment in the auxiliary anode cell 60. The auxiliary anode 58 is disposed in the auxiliary anode cell 60 so as to face the aluminum plate W and the electrolytic solution 55 is supplied so as to flow through the space between the auxiliary anode 58 and the aluminum plate W.

The support may have a back coat layer containing an organic polymer compound described in JP1993-45885A (JP-HOS-45885A)) or an alkoxy compound of silicon described in JP1994-35174A (JP-H06-35174A) on the surface opposite to a side where the image recording layer is provided, as necessary.

<Undercoat Layer>

It is preferable that the planographic printing plate precursor according to the embodiment of the present disclosure includes an undercoat layer (also referred to as an interlayer) between the image recording layer and the support. Since the undercoat layer strengthens adhesion between the support and the image recording layer in the exposed portion and allows the image recording layer to be easily peeled off from the support in the unexposed portion, the undercoat layer contributes to improvement of the developability while suppressing degradation of the printing durability. Further, in a case of infrared laser exposure, since the undercoat layer functions as a heat insulating layer, the undercoat layer also has an effect of preventing heat generated by exposure from being diffused in the support, and thus the sensitivity is not degraded.

Examples of the compound used for the undercoat layer include a polymer containing an adsorptive group which can be adsorbed on the surface of the support and a hydrophilic group. A polymer which contains an adsorptive group and a hydrophilic group for the purpose of improving the adhesiveness to the image recording layer and further contains a crosslinkable group is preferable. The compound used for the undercoat layer may be a low-molecular-weight compound or a polymer. The compound used for the undercoat layer may be used in the form of a mixture of two or more kinds thereof as necessary.

In a case where the compound used for the undercoat layer is a polymer, a copolymer of a monomer containing an adsorptive group, a monomer containing a hydrophilic group, and a monomer containing a crosslinkable group is preferable.

Preferred examples of the adsorptive group that can be adsorbed on the surface of the support include a phenolic hydroxy group, a carboxy group, $—PO_3H_2$, $—OPO_3H_2$, $—CONHSO_2—$, $—SO_2NHSO_2—$, and $—COCH_2COCH_3$. As the hydrophilic group, a sulfo group or a salt thereof, or a salt of a carboxy group is preferable. As the crosslinkable group, an acrylic group, a methacrylic group, an acrylamide group, a methacrylamide group, or an allyl group is preferable.

The polymer may contain a crosslinkable group introduced by forming salts between a polar substituent of the polymer and a compound that has a substituent having the opposite charge to the polar substituent and an ethylenically unsaturated bond or may be formed by further copolymerization of monomers other than the monomers described above and preferably hydrophilic monomers.

Specifically, a silane coupling agent having an ethylenic double bond reactive group, which can be addition-polymerized, described in JP1998-282679A (JP-H10-282679A); and a phosphorous compound having an ethylenic double bond reactive group described in JP1990-304441A (JP-H02-304441A) are suitably exemplified. Further, crosslinkable groups (preferably ethylenically unsaturated bond groups) described in JP2005-238816A, JP2005-125749A, JP2006-239867A, and JP2006-215263A, and low-molecular-weight or high-molecular-weight compounds containing functional groups and hydrophilic groups that interact with the surface of a support are preferably used.

More preferred examples thereof include high-molecular-weight polymers containing adsorptive groups which can be adsorbed on the surface of a support, hydrophilic groups, and crosslinkable groups described in JP2005-125749A and JP2006-188038A.

The content of the ethylenically unsaturated bond group in the polymer used for the undercoat layer is preferably in a range of 0.1 mmol to 10.0 mmol and more preferably in a range of 0.2 mmol to 5.5 mmol with respect to 1 g of the polymer.

The weight-average molecular weight (Mw) of the polymer used for the undercoat layer is preferably 5000 or greater and more preferably in a range of 10000 to 300000.

For the purpose of preventing stain over time, the undercoat layer may contain a chelating agent, a secondary or tertiary amine, a polymerization inhibitor, a compound that includes an amino group or a functional group having polymerization inhibiting ability and a group interacting with the surface of a support (for example, 1,4-diazabicyclo[2.2.2]octane (DABCO), 2,3,5,6-tetrahydroxy-p-quinone, chloranil, sulfophthalic acid, hydroxyethyl ethylene diamine triacetic acid, dihydroxyethyl ethylene diamine diacetic acid, or hydroxyethyl imino diacetic acid) in addition to the compounds for an undercoat layer described above.

The undercoat layer is applied according to a known method. The coating amount (solid content) of the undercoat layer is preferably in a range of 0.1 $mg/m^2$ to 100 $mg/m^2$ and more preferably in a range of 1 $mg/m^2$ to 30 $mg/m^2$.

(Method of Preparing Planographic Printing Plate and Planographic Printing Method)

A planographic printing plate can be prepared by image-exposing the planographic printing plate precursor according to the embodiment of the present disclosure and performing a development treatment thereon.

It is preferable that the method of preparing a planographic printing plate according to the embodiment of the present disclosure includes a step of imagewise-exposing an on-press development type planographic printing plate precursor according to the present disclosure (hereinafter, also referred to as an "exposure step"), and a step of supplying at least one selected from the group consisting of printing ink and dampening water to remove the image recording layer of the non-image area on the printing press (hereinafter, also referred to as an "on-press development step").

It is preferable that the planographic printing method according to the embodiment of the present disclosure includes a step of imagewise-exposing the on-press development type planographic printing plate precursor according to the embodiment of the present disclosure (an exposure step), a step of supplying at least one selected from the group consisting of printing ink and dampening water to remove the image recording layer of the non-image area on the printing press and preparing a planographic printing plate (an on-press development step), and a step of performing printing using the obtained planographic printing plate (a printing step).

Hereinafter, preferred embodiments of each step of the method of preparing a planographic printing plate according to embodiment of the present disclosure and each step of the planographic printing method according to the embodiment of the present disclosure will be sequentially described. Further, the planographic printing plate precursor according to the embodiment of the present disclosure can also be developed with a developer.

Hereinafter, the exposure step and the on-press development step in the method of preparing a planographic printing plate will be described, and the exposure step in the method of preparing a planographic printing plate according to the embodiment of the present disclosure is the same as the exposure step in the planographic printing method according to the embodiment of the present disclosure, and the on-press development step in the method of preparing a planographic printing plate according to the embodiment of the present disclosure is the same as the on-press development step in the planographic printing method according to the embodiment of the present disclosure.

<Exposure Step>

It is preferable that the method of preparing a planographic printing plate according to the embodiment of the present disclosure includes an exposure step of imagewise-exposing the planographic printing plate precursor according to the embodiment of the present disclosure to form an exposed portion and an unexposed portion. It is preferable that the planographic printing plate precursor according to the embodiment of the present disclosure is exposed to a laser through a transparent original picture having a line image, a halftone image, and the like or imagewise-exposed by laser beam scanning using digital data.

A light source having a wavelength of 750 nm to 1400 nm is preferably used. As the light source having a wavelength of 750 nm to 1400 nm, a solid-state laser or a semiconductor laser that radiates infrared rays is suitable. The output of the infrared laser is preferably 100 mW or greater, the exposure time per one pixel is preferably shorter than 20 microseconds, and the irradiation energy quantity is preferably in a range of 10 $mJ/cm^2$ to 300 $mJ/cm^2$. For the purpose of reducing the exposure time, it is preferable to use a multi-beam laser device. The exposure mechanism may be any of an internal drum system, an external drum system, or a flat bed system.

The image exposure can be performed using a plate setter according to a usual method. In a case of the on-press development, the planographic printing plate precursor may be mounted on the printing press and then image-exposed on the printing press.

<On-Press Development Step>

It is preferable that the method of preparing a planographic printing plate according to the embodiment of the present disclosure includes an on-press development step of supplying at least one selected from the group consisting of printing ink and dampening water to remove the image recording layer of the non-image area on the printing press.

Hereinafter, the on-press development method will be described.

[On-Press Development Method]

According to the on-press development method, it is preferable that the planographic printing plate is prepared from the image-exposed planographic printing plate precursor by supplying oil-based ink and an aqueous component on the printing press to remove the image recording layer of the non-image area.

That is, in a case where the planographic printing plate precursor is image-exposed and then mounted on the printing press without performing any development treatment thereon or the planographic printing plate precursor is mounted on the printing press, image-exposed on the printing press, and oil-based ink and an aqueous component are supplied to perform printing, the uncured image recording layer is removed by being dissolved or dispersed by any or both the supplied oil-based ink and aqueous component in the non-image area at an initial state of the printing so that the hydrophilic surface is exposed to the portion thereof. Meanwhile, the image recording layer cured by exposure forms an oil-based ink receiving unit having a lipophilic surface in the exposed portion. The oil-based ink or the aqueous component may be initially supplied to the plate surface, but it is preferable that the oil-based ink is initially supplied from the viewpoint of preventing contamination of the aqueous component due to the component of the removed image recording layer. In this manner, the planographic printing plate precursor is on-press developed on the printing press and used as it is for printing a plurality of sheets. As the oil-based ink and the aqueous component, printing ink and dampening water for typical planographic printing are suitably used.

As the laser for image-exposing the planographic printing plate precursor according to the embodiment of the present disclosure, a light source having a wavelength of 300 nm to 450 nm or 750 nm to 1400 nm is preferably used. A planographic printing plate precursor containing, in the image recording layer, a sensitizing dye that has an absorption maximum in this wavelength range is preferably used as the light source having a wavelength of 300 nm to 450 nm, and those described above are preferably used as the light source having a wavelength of 750 nm to 1400 nm. A semiconductor laser is suitable as the light source having a wavelength of 300 nm to 450 nm.

<Printing Step>

The planographic printing method according to the embodiment of the present disclosure includes a printing step of supplying printing ink to the planographic printing plate and performing printing with a recording medium.

The printing ink is not particularly limited, and various known inks can be used as desired. Further, preferred examples of the printing ink include oil-based ink and ultraviolet curable ink (UV ink).

In the printing step, dampening water may be supplied as necessary.

Further, the printing step may be performed continuously with the on-press development step without stopping the printing press.

The recording medium is not particularly limited, and a known recording medium can be used as desired.

In the method of preparing a planographic printing plate from the planographic printing plate precursor according to the embodiment of the present disclosure and the planographic printing method according to the embodiment of the present disclosure, the entire surface of the planographic printing plate precursor may be heated before the exposure, during the exposure, and between the exposure and the development as necessary. In a case where the surface is heated in the above-described manner, there is an advantage that the image forming reaction in the image recording layer is promoted, the sensitivity and the printing durability are improved, and the sensitivity is stabilized. In a case where the surface is heated before the development, it is preferable that the heating is performed under a mild temperature condition of 150° C. or lower. In this manner, problems of curing the non-image area and the like can be prevented. In a case where the surface is heated after the development, it is preferable that the heating is performed under an extremely high temperature condition of 100° C. to 500° C. In a case where the temperature is in the above-described range, a sufficient image strengthening effect can be obtained, and problems such as deterioration of the support and thermal decomposition of the image area can be suppressed.

EXAMPLES

Hereinafter, the present disclosure will be described in detail with reference to examples, but the present disclosure is not limited thereto. In the present examples, "%" and "part" respectively indicate "% by mass" and "part by mass" unless otherwise specified. Further, in a polymer compound, the molecular weight indicates the weight-average molecular weight (Mw) and the proportion of repeating constitutional units indicates mole percentage unless otherwise specified. Further, the weight-average molecular weight (Mw) is a value in terms of polystyrene obtained by performing measurement using gel permeation chromatography (GPC).

<Preparation of Support>

An aluminum alloy plate made of the material 1S with a thickness of 0.3 mm was subjected to (A-a) mechanical roughening treatment (brush grain method) described in paragraph 0126 of JP2012-158022A to (A-i) desmutting treatment in an acidic aqueous solution described in paragraph 0134 of JP2012-158022.

Next, an anodized film which had large-diameter pores having an average diameter of 35 nm and a depth of 100 nm and small-diameter pores having an average diameter of 10 nm and a depth of 1000 nm and in which the ratio of the depth of the large-diameter pores to the average diameter of the large-diameter pores was 2.9 was formed by appropriately adjusting the treatment conditions for (A j) first stage anodization treatment described in paragraph 0135 of JP2012-158022A to (A-m) third stage anodization treatment described in paragraph 0138 of JP2012-158022A, thereby obtaining an aluminum support A.

Moreover, during all treatment steps, a water washing treatment was performed, and liquid draining was performed using a nip roller after the water washing treatment.

<<Synthesis of Polymer Particle A-1, Functional Group A: Carboxy Group>>

Polymer particle A-1 was synthesized according to the following synthetic scheme. 40 parts of a compound (1) shown below, 10 parts of a compound (2) shown below, and 950 parts of distilled water were added to a three-neck flask, and the solution was stirred in a nitrogen atmosphere and heated to 70° C. Next, 1.9 g of potassium persulfate was added thereto, and the solution was stirred for 5 hours. Thereafter, the solution was heated to 95° C. and stirred for 2 hours. The reaction solution was allowed to be naturally cooled to room temperature (25° C., the same applies hereinafter), thereby obtaining a dispersion liquid of polymer particle A-1 (the concentration of solid contents: 5% by mass). The average particle diameter of the polymer particle A-1 was 180 nm.

Further, the average particle diameter of the polymer particle A-1 was measured by the method described above.

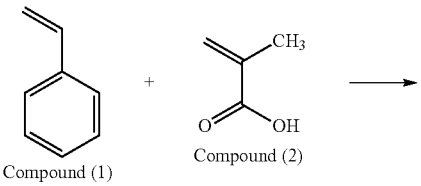

Compound (1) Compound (2)

-continued

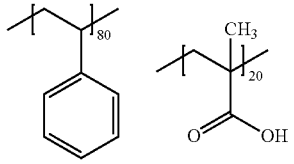

A-1

<<Polymer Particles A-2, A-4, A-7, A-11, and A-13 to A-16>>

The synthesis of particle was carried out according to the same method as that for the polymer particle A-1 except that the monomer used and the amount of the monomer used were appropriately changed so as to obtain the resin composition listed in Table 1.

<<Synthesis of Resin B-1, Functional Group B: Tertiary Amino Group>>

A resin B-1 was synthesized according to the following synthetic scheme. 25 parts of a compound (3) shown below, 25 parts of a compound (4) shown below, and 70 parts of 1-methoxy 2-propanol were added to a three-neck flask, and the solution was stirred in a nitrogen atmosphere and heated to 80° C. 0.5 part of dimethyl 2,2'-azobisisobutyronitrile was added thereto so that the solution was allowed to react for 6 hours, thereby obtaining a resin B-1. The number average molecular weight of the obtained resin B-1 was 36000.

Further, the average particle diameter of the resin B-1 was measured by the method described above.

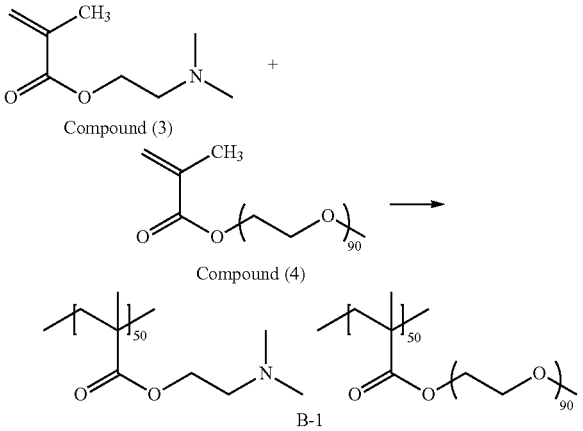

<<Synthesis of Resin B-6, Functional Group B: Tertiary Amino Group>>

41.7 parts of a compound A, 26.4 parts of a compound B, 102.16 parts of 1-methoxy-2-propanol (MFG), 0.705 parts of dipentaerythritol hexa(3-mercaptopropionate), and 0.124 parts of an initiator V601 (dimethyl azobis(isobutyrate), manufactured by FUJIFILM Wako Pure Chemical Corporation) were added to a three-neck flask and heated at 80° C. for 6 hours, thereby obtaining an intermediate C. The intermediate was diluted with 126 parts of MFG, 24.3 parts of acrylic acid and 5.4 parts of tetrabutylammonium bromide were added thereto, and the solution was heated at 90° C. for 16 hours, thereby obtaining an intermediate D. 50 parts of the obtained intermediate solution (concentration of solid contents: 30% by mass) and 0.8 parts of diethylamine were added thereto, and the solution was heated at 80° C. for 30 minutes, thereby obtaining 51 parts of a MFG solution in which the concentration of solid contents of the target B-6 was 30% by mass. As a result of measurement of the molecular weight according to GPC, the weight-average molecular weight thereof was 70000.

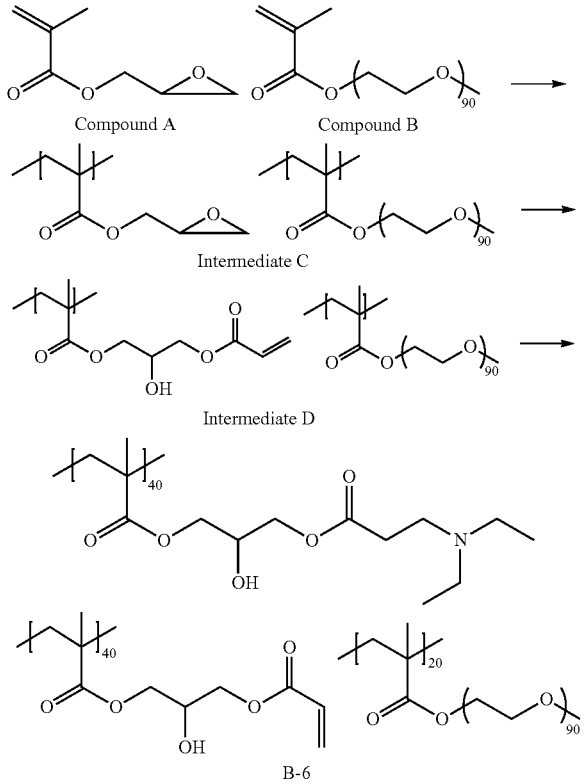

<<Resins B-3 to B-6, B-6-2, B-9, and B-12 to B-15>>

The synthesis of resins was carried out according to the same method as that for the resin B-1 except that the monomer used and the amount of the monomer used were appropriately changed so as to obtain the resin composition listed in Table 1.

[Preparation of Core-Shell Particle CS-1]

2 parts of a 35 mass % aqueous solution of the resin A-1 and 8 parts of a 7.5 mass % MFG solution of the resin B-13 were mixed, stirred at 60° C. for 30 minutes, and then filtered through a 200 mesh nylon filter cloth to obtain a particle liquid.

In core-shell particle CS-1, the coating amount of the resin B was 30% by mass with respect to the total mass of the resin A, and the arithmetic average particle diameter of the core-shell particle CS-1 was 190 nm.

[Preparation of Core-Shell Particles CS-2 to CS-16, CS-C1, and CS-C2]

Particles were prepared according to the same method as that for the core-shell particle CS-1 except that the polymer particle and the resin B used and the amount thereof used were appropriately changed.

<Formation of Planographic Printing Plate Precursor>

The support was coated with an undercoat liquid (1) having the following composition such that the dry coating amount reached 20 mg/m$^2$, and dried in an oven at 100° C. for 30 seconds, thereby preparing a support having an undercoat layer.

The undercoat layer was bar-coated with the following image recording layer coating solution (1) and dried in an oven at 100° for 60 seconds to form an image recording layer having a dry coating amount of 0.60 g/m$^2$ (a film thickness of approximately 0.60 μm), thereby obtaining a planographic printing plate precursor.

Thereafter, in a case where the protective layer was "present" in Table 1, the image recording layer was bar-coated with a protective layer coating solution having the following composition and dried in an oven at 120° C. for 60 seconds, thereby forming a protective layer having a dry coating amount of 0.15 g/m$^2$.

[Undercoat Liquid (1)]

Undercoat compound 1 shown below: 0.18 parts

Methanol: 55.24 parts

Distilled water: 6.15 parts

—Synthesis of Undercoat Compound 1—

<<Purification of Monomer m-1>>

420 parts of light ester P-1M (2-methacryloyloxyethyl acid phosphate, manufactured by Kyoeisha Chemical Co., Ltd.), 1050 parts of diethylene glycol dibutyl ether, and 1050 parts of distilled water were added to a separatory funnel, violently stirred, and allowed to stand still. After the upper layer was disposed of, 1050 parts of diethylene glycol dibutyl ether was added thereto, and the mixture was violently stirred and allowed to stand still. The upper layer was disposed of, thereby obtaining 1300 parts of an aqueous solution of the monomer M-1 (10.5% by mass in terms of solid content).

<<Synthesis of Undercoat Compound 1>>

53.73 parts of distilled water and 3.66 parts of a monomer M-2 shown below were added to a three-neck flask and heated to 55° C. in a nitrogen atmosphere. Next, a dripping liquid 1 described below was added dropwise thereto for 2 hours, the solution was stirred for 30 minutes, 0.386 parts of VA-046B (manufactured by FUJIFILM Wako Pure Chemical Corporation) was added thereto, and the resulting solution was heated to 80° C. and stirred for 1.5 hours. After the reaction solution was cooled to room temperature (25° C.), a 30 mass % sodium hydroxide aqueous solution was added thereto to adjust the pH thereto to 8.0, and 0.005 parts of 4-hydroxy-2,2,6,6-tetramethylpiperidin-1-oxyl (4-OH-TEMPO) was added thereto. 180 parts of an aqueous solution of the undercoat compound 1 was obtained by performing the above-described operation. Further, the weight-average molecular weight (Mw) in terms of polyethylene glycol according to a gel permeation chromatography (GPC) method was 170000.

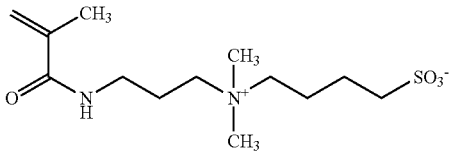

Monomer M-2

<<Dripping Liquid 1>>

Monomer M-1 aqueous solution shown above: 87.59 parts

Monomer M-2 shown above: 14.63 parts

VA-046B (2,2'-azobis[2-(2-imidazolin-2-yl)propane] disulfate dihydrate, manufactured by FUJIFILM Wako Pure Chemical Corporation): 0.386 parts Distilled water: 20.95 parts <Image Recording Layer Coating Solution (1)>

Infrared absorbing agents listed in Table 1 (compounds having structure shown below): amounts listed in Table 1

Polymerizable compound listed in Table 1 (compounds having structure shown below): amount listed in Table 1

Thermoplastic resin listed in Table 1: amount listed in Table 1

BYK 306 (manufactured by BYK Chemie GmbH): 60 parts

1-Methoxy-2-propanol (MFG): 8000 parts

Methyl ethyl ketone: 1000 parts

Electron-accepting polymerization initiator listed in Table 1: amount listed in Table 1

Electron-donating polymerization initiator listed in Table 1: amount listed in Table 1, 0 part in a case where the electron-donating polymerization initiator is "absent" in Table 1

Development accelerator (compound shown below): 20 parts

Sensitizing agent (compound shown below): 50 parts

Surfactant (compound shown below, Mw=13000): 4 parts

Development accelerator: tris(2-hydroxyethyl) isocyanurate, value of polarization element of SP value=6.4

Sensitizing agent: 1,4-bis(triphenylphosphonio) butane=di(hexafluorophosphate), SP value=16.2

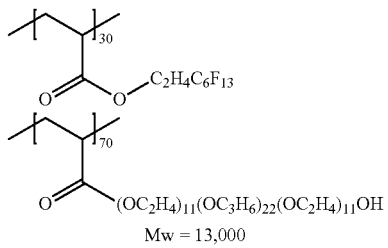

<Preparation of Protective Layer Coating Solution>

Inorganic layered compound dispersion liquid (1) (described below): 1.5 parts

Polyvinyl alcohol (CKS50, manufactured by Nippon Synthetic Chemical Industry Co., Ltd., sulfonic acid-modified, saponification degree of 99% by mole or greater, degree of polymerization of 300), 6 mass % aqueous solution: 0.55 parts Polyvinyl alcohol (PVA-405, manufactured by Kuraray Co., Ltd., saponification degree of 81.5% by mole, degree of polymerization of 500), 6 mass % aqueous solution: 0.03 parts Surfactant (EMALEX 710, manufactured by Nihon Emulsion Co., Ltd., polyoxyethylene lauryl ether), 1 mass % aqueous solution): 0.86 parts by mass Ion exchange water: 6.0 parts The method of preparing the inorganic layered compound dispersion liquid (1) used in the protective layer coating solution is shown below.

—Preparation of Inorganic Layered Compound Dispersion Liquid (1)—

6.4 parts of synthetic mica (SOMASIF ME-100, manufactured by CO-OP CHEMICAL CO., LTD.) was added to 193.6 g of ion exchange water and dispersed such that the average particle diameter (laser scattering method) was set to 3 μm using a homogenizer. The aspect ratio of the obtained dispersed particle was 100 or greater.

<Evaluation>

[UV Printing Durability]

Each of the obtained planographic printing plate precursors was exposed by Luxel PLATESETTER T-6000III (manufactured by Fujifilm Corporation) equipped with an infrared semiconductor laser under conditions of an external drum rotation speed of 1000 rpm (revolutions per minute), a laser output of 70%, and a resolution of 2400 dpi (dot per inch, 1 inch=2.54 cm). The exposed image had a solid image, a 50% halftone dot chart of a 20 μm dot FM screen, and a non-image area.

The obtained exposed planographic printing plate precursor was attached to the plate cylinder of a printing press LITHRONE26 (manufactured by KOMORI Corporation) without performing a development treatment. The water supply roller was decelerated by 5% with respect to the plate cylinder, dampening water and ink were supplied to perform on-press development using dampening water of ECOLITY-2 (manufactured by Fujifilm Corporation) and tap water at a volume ratio of 2/98 and UV ink (T & K UV OFS K-HS ink GE-M (manufactured by T&K TOKA Co., Ltd.) according to a standard automatic printing start method of LITHRONE26, and printing was performed on 50000 sheets of Tokubishi Art (manufactured by Mitsubishi Paper Mills Ltd., ream weight of 76.5 kg) paper at a printing speed of 10000 sheets per hour.

As the number of printed sheets increased, the image recording layer was gradually worn and the ink receiving property was degraded, and thus the ink density on the printing paper decreased. The number of printed sheets in a case where the value obtained by measuring the halftone dot area ratio of FM screen 3% halftone dots using X-Rite (manufactured by X-Rite Inc.) in the printed material was decreased by 5% than the measured value of the 100th printed sheet was defined as the number of completely printed sheets, and the UV printing durability was evaluated.

[Dispersion Stability]

The dispersion stability of the obtained core-shell particle with respect to the coating solvent was evaluated.

First, 1 g of each of the obtained core-shell particle dispersion liquids was added to 9 g of a coating solvent (methyl ethyl ketone (MEK)/MFG=85/15), and the solution was stirred under a temperature condition of 40° C. for 30 minutes, thereby preparing an evaluation solution.

Thereafter, the evaluation solution was allowed to stand at 60° C. for 1 week and filtered through a 200 mesh nylon net, and the recovery rate (%) of the filtrate was acquired from a difference between the weight of the evaluation solution before being allowed to stand and the weight of the filtrate, and the dispersion stability was evaluated based on the following evaluation standards. It can be said that the dispersion stability is excellent as the recovery rate of the filtrate increases.

—Evaluation Standards—

A: The recovery rate of the filtrate is 90% or greater.

B: The recovery rate of the filtrate is 70% or greater and less than 90%.

C: The recovery rate of the filtrate is less than 70%.

[Surface State]

The surface state of the surface of the outermost layer (hereinafter, also referred to as "the surface of the planographic printing plate precursor") on a side opposite to the support of the obtained planographic printing plate precursor was observed using a SEM (magnification: 1000 times), and the surface state of the obtained image was evaluated based on the following evaluation standards.

It can be said that the dispersibility of the core-shell particle is excellent as the number of irregularities on the surface of the planographic printing plate precursor decreases.

—Evaluation Standards—

A: The number of irregularities on the surface of the planographic printing plate precursor is 5 or less, and the surface appears to be flat.

B: The number of irregularities in an area of 5 μm square on the surface of the planographic printing plate precursor is greater than 5 and 20 or less.

C: The number of irregularities in an area of 5 μm square on the surface of the planographic printing plate precursor is greater than 20.

TABLE 1

| | | Image recording layer Core-shell particle | | | | | | | | |
|---|---|---|---|---|---|---|---|---|---|---|
| | | | Core portion: resin A (polymer particle A) | | Shell portion: resin B | | | | | |
| | | Type | Type | Particle diameter | Type | Molecular weight | Arithmetic average particle diameter | Coating amount of resin B to resin A (% by mass) | C = C value (mmol/g) | Addition amount (parts) |
| Example | 1 | CS-1 | A-1 | 180 | B-9 | 54,000 | 190 | 30 | 0.6 | 400 |
| | 2 | CS-2 | A-1 | 300 | B-1 | 36,000 | 290 | 10 | — | 200 |
| | 3 | CS-3 | A-1 | 60 | B-4 | 12,000 | 80 | 50 | — | 250 |
| | 4 | CS-4 | A-11 | 200 | B-3 | 98,000 | 230 | 40 | — | 250 |
| | 5 | CS-5 | A-2 | 350 | B-9 | 54,000 | 400 | 70 | — | 250 |
| | 6 | CS-6 | A-4 | 200 | B-6 | 70,000 | 220 | 20 | 0.32 | 250 |
| | 7 | CS-7 | A-7 | 500 | B-5 | 53,000 | 500 | 10 | — | 330 |
| | 8 | CS-8 | A-11 | 200 | B-12 | 50,000 | 230 | 40 | 0.8 | 330 |
| | 9 | CS-9 | A-1 | 100 | B-9 | 54,000 | 110 | 70 | 1.4 | 250 |
| | 10 | CS-10 | A-4 | 200 | B-9 | 35,000 | 220 | 10 | 0.2 | 400 |
| | 11 | CS-11 | A-13 | 45 | B-6-2 | 22,000 | 60 | 40 | 0.8 | 400 |
| | 12 | CS-12 | A-14 | 130 | B-12 | 80,000 | 130 | 10 | — | 330 |
| | 13 | CS-13 | A-15 | 250 | B-13 | 78,000 | 250 | 10 | — | 300 |
| | 14 | CS-14 | A-11 | 45 | B-14 | 120,000 | 65 | 40 | 1.2 | 300 |
| | 15 | CS-15 | A-16 | 30 | B-15 | 62,000 | 60 | 50 | 1.0 | 300 |
| | 16 | CS-16 | A-11 | 60 | B-14 | 35,000 | 80 | 60 | 1.2 | 300 |

TABLE 1-continued

| | | | | | | | | | | |
|---|---|---|---|---|---|---|---|---|---|---|
| Comparative Example | 1 | CS-C1 | C-A1 | — | C-B1 | — | — | — | — | 250 |
| | 2 | CS-C2 | C-A2 | — | C-B2 | — | — | — | — | 250 |

| | | Image recording layer | | | | | | Evaluation | | |
|---|---|---|---|---|---|---|---|---|---|---|
| | | Electron-accepting polymerization initiator (parts) | Infrared absorbing agent (parts) | Electron-donating polymerization initiator (parts) | Polymerizable compound (parts) | Thermoplastic resin (parts) | Protective layer | UV printing durability | Dispersion stability | Surface state |
| Example | 1 | IA-1150 | IR-130 | R-190 | M-4220 | 125 | Absent | 100 | A | A |
| | 2 | IA-160 | IR-160 | R-190 | M-1300 | 180 | Present | 80 | A | A |
| | 3 | IA-1130 | IR-130 | R-160 | M-3220 | | Present | 85 | A | B |
| | 4 | IA-1100 | IR-130 | R-160 | M-4/M-5150/80 | | Present | 90 | A | A |
| | 5 | IA-1100 | IR-130 | R-160 | M-4/M-5150/80 | | Present | 80 | A | A |
| | 6 | IA-1130 | IR-130 | R-160 | M-4/M-5150/80 | 125 | Present | 95 | A | A |
| | 7 | IA-3130 | IR-330 | R-160 | M-4/M-5150/80 | 125 | Absent | 50 | B | B |
| | 8 | IA-1130 | IR-130 | R-160 | M-4/M-5150/80 | 125 | Absent | 90 | A | A |
| | 9 | IA-3130 | IR-330 | R-160 | M-4/M-5150/80 | | Absent | 85 | A | A |
| | 10 | IA-3130 | IR-330 | R-160 | M-2150 | 50 | Present | 95 | A | A |
| | 11 | IA-3130 | IR-330 | R-160 | M-4/M-580/40 | 125 | Absent | 95 | A | A |
| | 12 | IA-3130 | IR-330 | R-160 | M-4/M-5150/80 | 125 | Absent | 55 | B | B |
| | 13 | IA-3130 | IR-330 | R-160 | M-4/M-5150/80 | 125 | Absent | 60 | B | B |
| | 14 | IA-3130 | IR-330 | R-160 | M-4/M-5150/80 | 125 | Absent | 90 | A | A |
| | 15 | IA-3130 | IR-330 | R-160 | M-4/M-5150/80 | 125 | Absent | 90 | A | A |
| | 16 | IA-3130 | IR-330 | R-160 | M-4/M-5150/80 | 125 | Absent | 100 | A | A |
| Comparative Example | 1 | IR-1150 | IR-130 | — | M-1300 | 125 | Absent | 0 | C | C |
| | 2 | IR-2150 | IR-230 | — | M-1300 | 125 | Absent | 0 | C | D |

The "C═C value" in Table 1 represents an ethylenically unsaturated group value. Further, the "molecular weight" in Table 1 is a number average molecular weight Mn.

The details of the compounds listed in Table 1 are as follows.

A-1, A-2, A-4, A-7, A-11, and A-13 to A-16: resins shown below

A-1

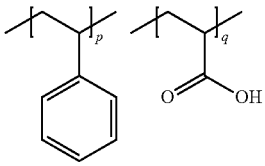

A-2

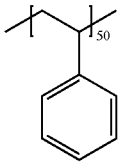

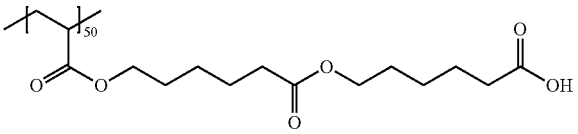

-continued

A-4

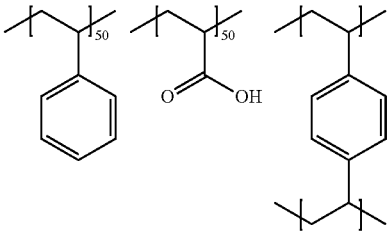

A-7

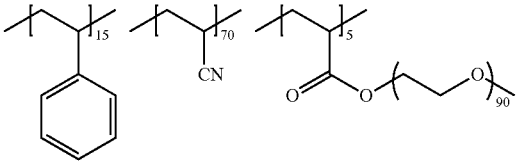

A-11

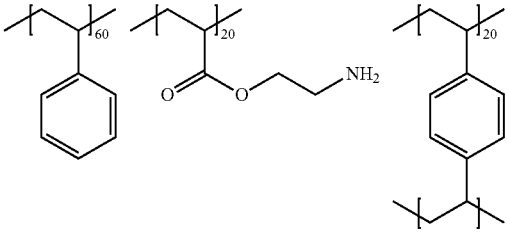

Further, the values of a and bin A-1 were respectively 80 and 20 in Example 1, 90 and 10 in Example 2, and 70 and 30 in Example 3.

A-13
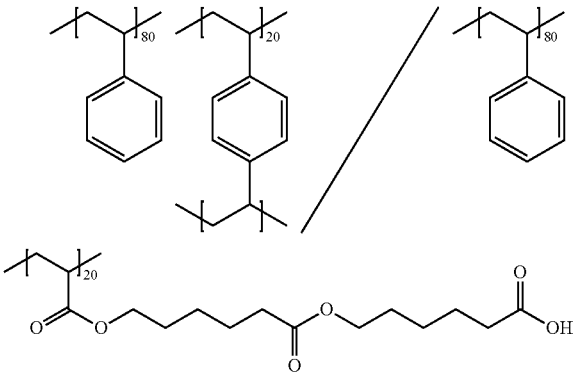
A-14
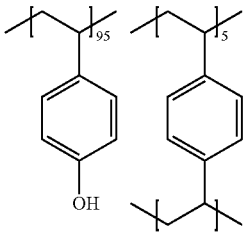
-continued
A-15
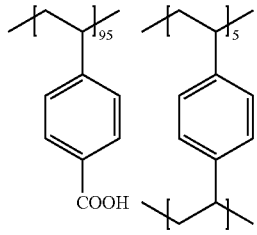
A-16
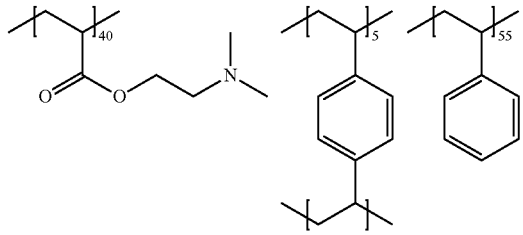
Further, A-13 represents a particle in which a large amount of the resin shown on the left side is present inside the core portion and a large amount of the resin A shown on the right side is present toward the outside of the core portion.
<Preparation A-13>
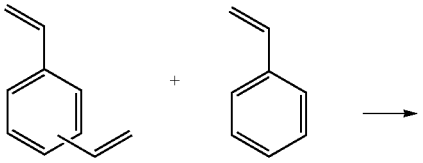
Compound (1) Compound (2)
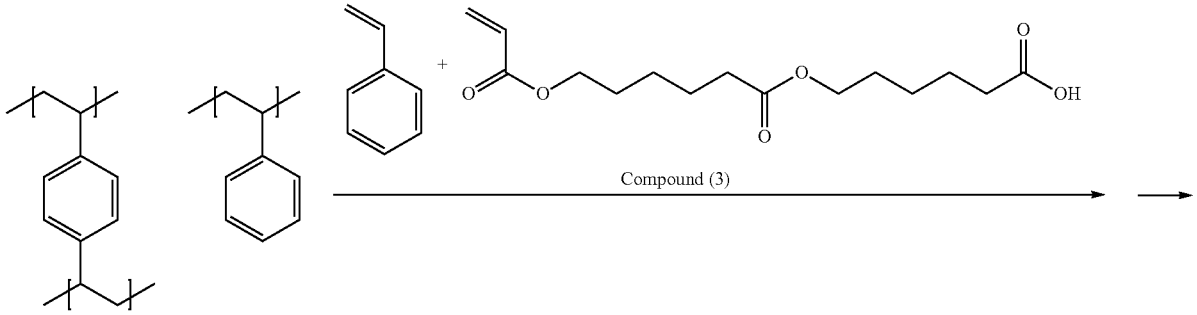
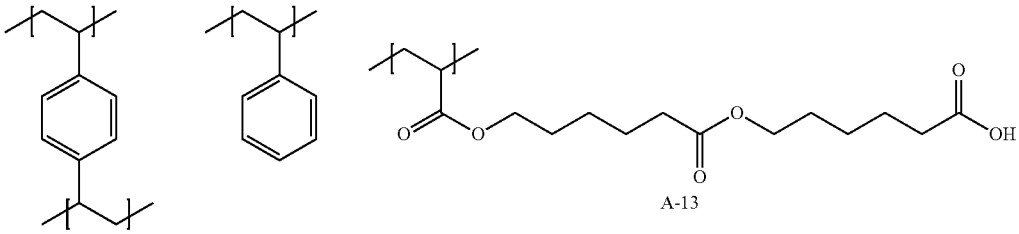
A-13

77.3 parts of distilled water, 0.1543 parts of Rongalit, 0.5144 parts of a 1 mass % ethylenediaminetetraacetic acid aqueous solution, and 0.643 parts of a 0.2 mass % iron (II) sulfate heptahydrate were added to a three-neck flask, stirred in a nitrogen atmosphere, and heated to 60° C. An emulsion containing 27.4 parts of the compound (1), 8.23 parts of the compound (2), 2.057 parts of ADEKA REASOAP (SR-10, manufactured by ADEKA Corporation, anionic surfactant), 0.203 parts of a 70 mass % t-butyl hydroperoxide aqueous solution, and 20.61 parts of distilled water was added dropwise to the solution for 30 minutes, and the solution was heated and stirred for 30 minutes. Subsequently, an emulsion containing 2.061 parts of the compound (2), 8.24 parts of the compound (3), 0.052 parts of ADEKA REASOAP (SR-10), 0.025 parts of a 70 mass % t-butyl hydroperoxide aqueous solution, and 5.15 parts of distilled water was added dropwise to dispersion liquid for 10 minutes, and the solution was heated and stirred for 2 hours, thereby obtaining a dispersion liquid of polymer particle A-13 (35%). The median diameter of the polymer particle A-13 in the obtained dispersion liquid was 100 nm.

B-1, B-3, B-4, B-5, B-6, B-6-2, B-9, and B-12 to B-15: resins shown below

B-1

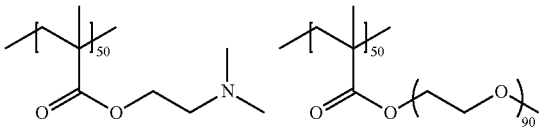

B-3

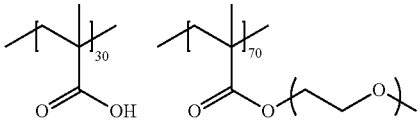

B-4

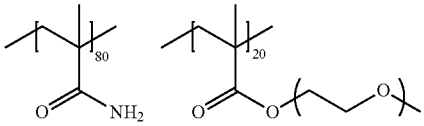

B-5

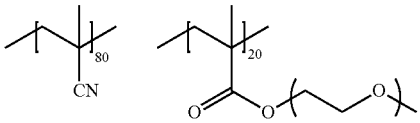

B-6

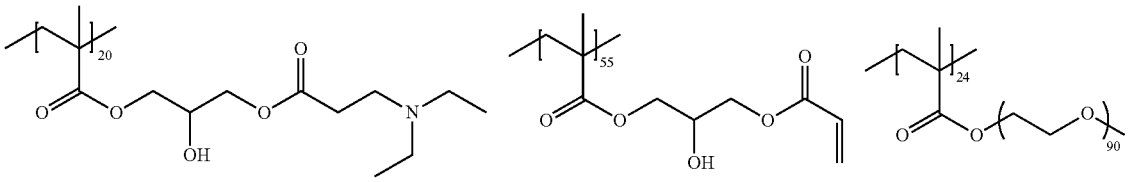

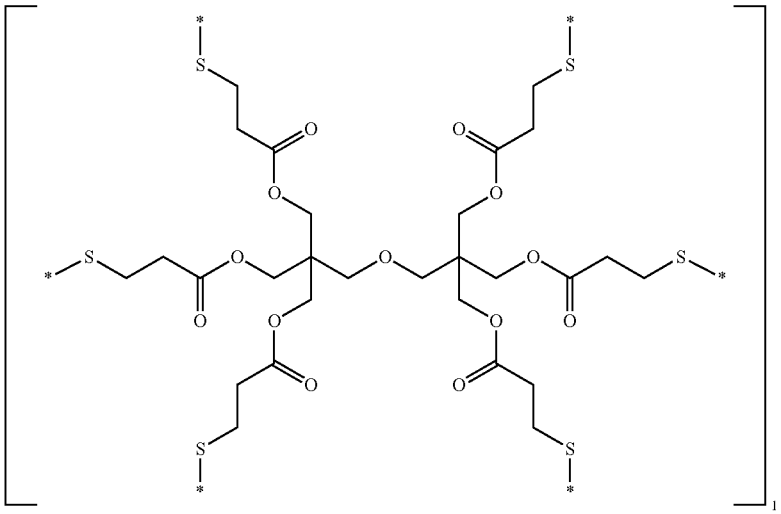

-continued
B-9
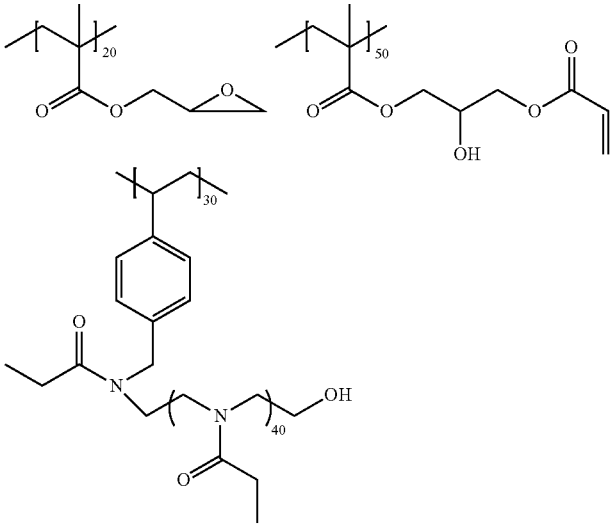
In addition, * in B-6 represents a bonding position with respect to the polymer chain shown on the left side.
B-6-2
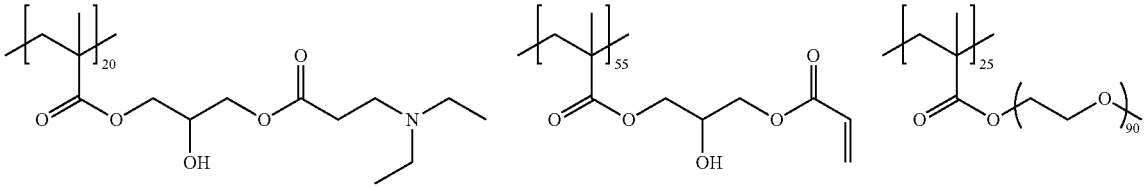
B-12
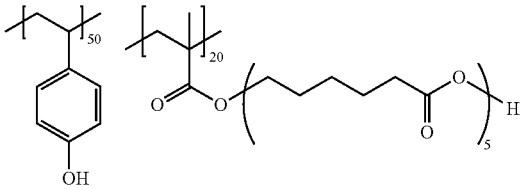
B-13
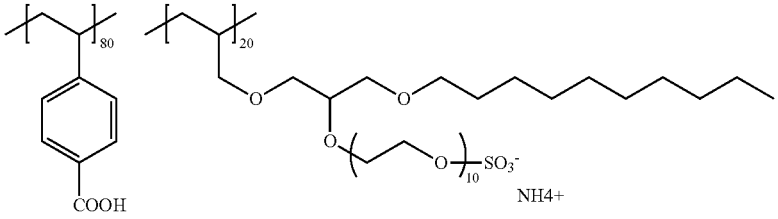

-continued

B-14

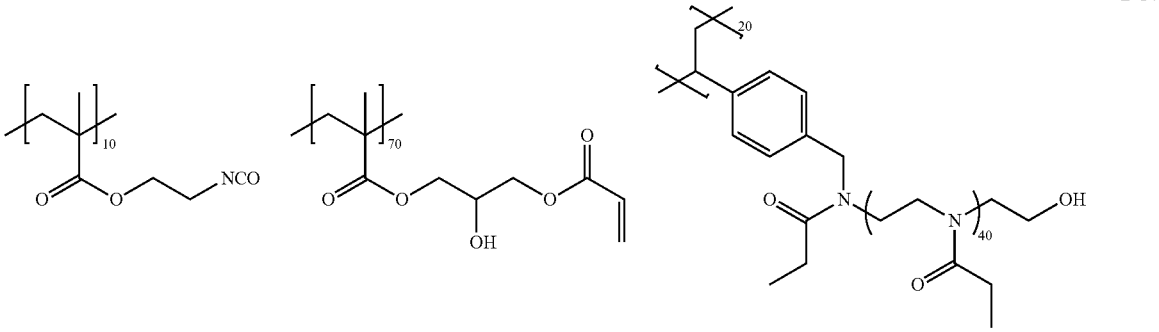

B-15

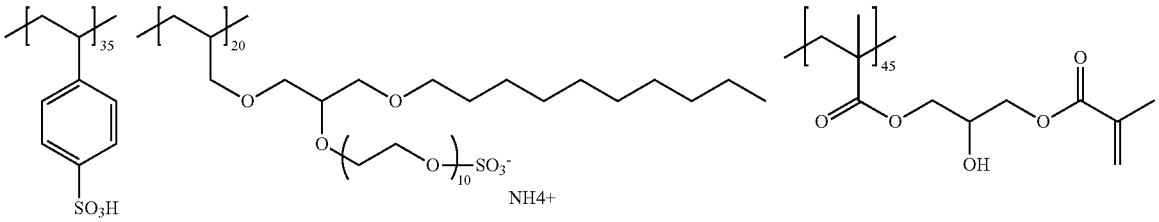

CA1, CA2, CB1, and CB2: resins shown below

C-2: compound having structure shown below

Further, in CS-2, —$OCH_3$ at the terminal contained in the resin constituting the core portion and —$SO_3^-$ at the terminal contained in the resin constituting the shell portion are not bonded to or interact with each other.

C-A1

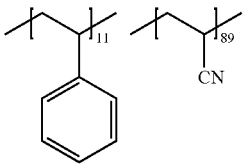

C-B1

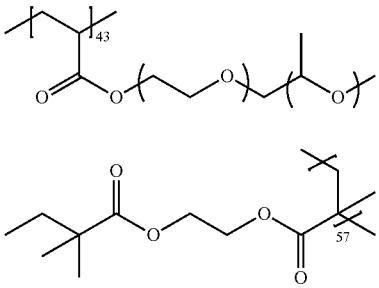

C-A2

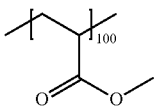

C-B2

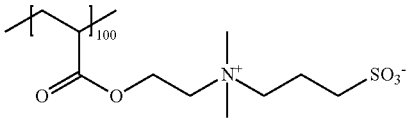

[Electron-Donating Polymerization Initiator]

R-1: compound having structure shown below, HOMO (eV)=−5.905 eV

R-1

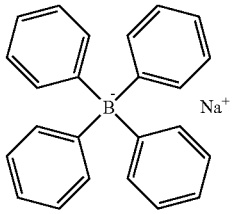

[Electron-Accepting Polymerization Initiator]

IA-1: compound having structure shown below, LUMO=−3.02 eV

IA-2: compound having structure shown below

IA-3: compound having structure shown below, LUMO=−3.02 eV

IA-1

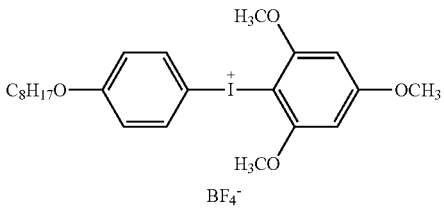

IA-2

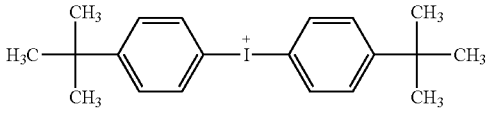

-continued

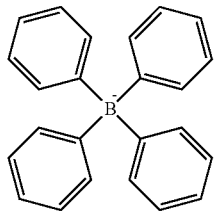

IA-3

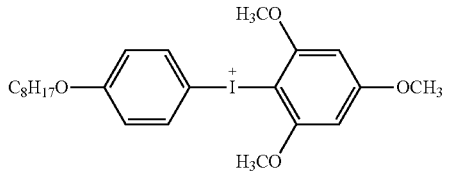

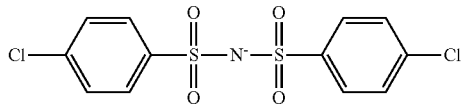

[Infrared Absorbing Agent]

IR-1: compound having structure shown below, HOMO=−5.27 eV, LUMO=−3.66 eV

IR-2: compound having structure shown below

IR-3: compound having structure shown below, HOMO=−5.35 eV, LUMO=−3.73 eV

IR-1

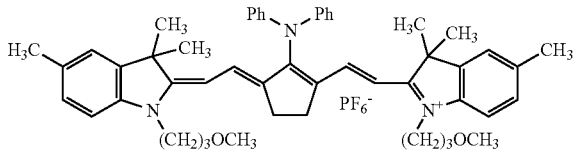

IR-2

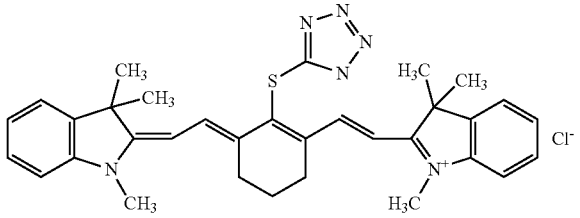

IR-3

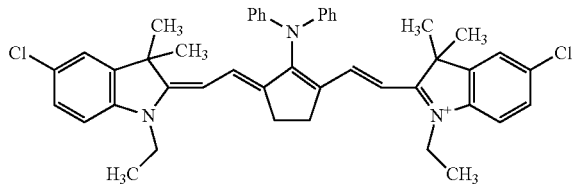

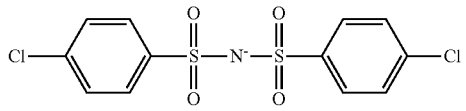

[Thermoplastic Resin]

Thermoplastic resin: resin having structure shown below

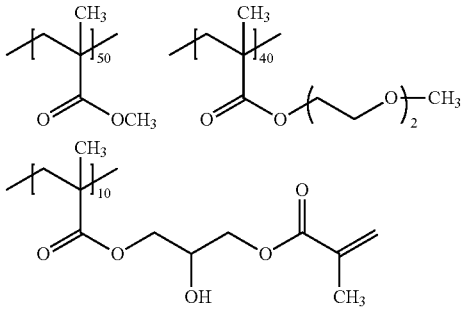

Mw = 70,000

In the formula shown above, the content of each constitutional unit (the subscript on the lower right side of the parentheses) indicates the mass ratio, and the subscript on the lower right side of the parentheses of the ethyleneoxy structure indicates the repetition number.

[Polymerizable Compound]

M-1: tris(acryloyloxyethyl) isocyanurate, NK ESTER A-9300, manufactured by Shin-Nakamura Chemical Co., Ltd.

M-2: dipentaerythritol pentaacrylate, SR-399, manufactured by Sartomer Japan Inc.

M-3: dipentaerythritol hexaacrylate, A-DPH, manufactured by Shin-Nakamura Chemical Co., Ltd.

M-4: dipentaerythritol pentaacrylate hexamethylene diisocyanate urethane prepolymer, UA-510H, manufactured by Kyoeisha Chemical Co., Ltd.

M-5: ethoxylated pentaerythritol tetraacrylate, ATM-4E, manufactured by Shin-Nakamura Chemical Industry Co., Ltd.

Based on the results listed in Table 1, it was found that planographic printing plates with excellent UV printing durability are obtained from the planographic printing plate precursors of the examples compared to those obtained from the planographic printing plate precursors of the comparative examples.

Further, based on the results listed in Table 1, it was found that the planographic printing plate precursors of the examples have excellent dispersion stability and an excellent surface state.

The disclosure of JP2019-016538 filed on Jan. 31, 2019 is incorporated herein by reference in its entirety.

All documents, patent applications, and technical standards described in the present specification are incorporated herein by reference to the same extent as in a case of being specifically and individually noted that individual documents, patent applications, and technical standards are incorporated by reference.

EXPLANATION OF REFERENCES

10: planographic printing plate precursor
12: aluminum support
16: image recording layer
14: undercoat layer
18: aluminum plate
20: anodized film
24: large-diameter pore
26: small-diameter pore
50: main electrolytic cell
52: radial drum roller
51: AC power source

53*a*, 53*b*: main pole
55: electrolytic solution
54: electrolytic solution supply port
56: slit
57: electrolytic solution passage
60: auxiliary anode cell
58: auxiliary anode
Ex: electrolytic solution discharge port
S: liquid supply
W: aluminum plate
1: aluminum plate
2, 4: roller-like brush
3: polishing slurry liquid
5, 6, 7, 8: support roller
610: anodization treatment device
616: aluminum plate
618: electrolytic solution
612: power supply tank
614: electrolytic treatment tank
616: aluminum plate
620: power supply electrode
622: roller
624: nip roller
626: electrolytic solution
628: roller
630: electrolytic electrode
634: DC power source
A: depth of large-diameter pore
Y: communication position (bottom portion of large-diameter pore)
ECa: current of aluminum plate for anodic reaction
ECb: current of aluminum plate for cathodic reaction

What is claimed is:

1. A planographic printing plate precursor comprising:
a support; and
an image recording layer on the support,
wherein the image recording layer contains an infrared absorbing agent, a polymerization initiator, and a core-shell particle,
a core portion of the core-shell particle contains a resin A containing a functional group A,
a shell portion of the core-shell particle contains a resin B containing a functional group B that is bondable to or interactable with the functional group A and a dispersion group,
wherein the polymerization initiator includes an electron-donating polymerization initiator,
wherein a difference between the highest occupied molecular orbital (HOMO) of the infrared absorbing agent and HOMO of the electron-donating polymerization initiator is 0.70 eV or less,
wherein the resin B has a constitutional unit containing the functional group B and represented by the following Formula b-1 or Formula a1:

Formula b-1

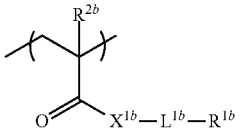

in Formula b-1, $X^{1b}$ represents —O—, OH, $NR^{3b}$, or $NH_2$, $L^{1b}$ represents a divalent linking group having 1 to 20 carbon atoms, $R^{1b}$ represents a carboxy group, a hydroxy group, or a glycidyl group, $R^{2b}$ represents a hydrogen atom or a methyl group, and $R^{3b}$ represents a hydrogen atom, an alkyl group, or an aryl group, and in a case where $X^{1b}$ represents OH or $NH_2$, $L^{1b}$ and $R^1$b may not be present accordingly;

Formula a1

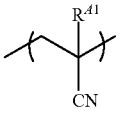

in Formula a1, $R^{A1}$ represents a hydrogen atom or an alkyl group, and
wherein the resin B has a constitutional unit containing the dispersion group and represented by the following Formula b-3 or b-4:

Formula b-3

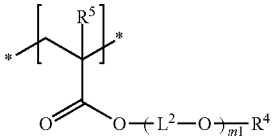

Formula b-4

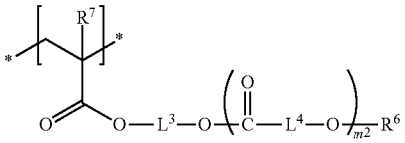

in formulae b-3 and b-4, $L^2$ represents an ethylene group or a propylene group, $L^3$ represents an alkylene group having 2 to 10 carbon atoms, $L^4$ represents an alkylene group having 1 to 10 carbon atoms, $R^4$ and $R^6$ each independently represents a hydrogen atom, an alkyl group, or an aryl group, $R^5$ and $R^7$ each independently represents a hydrogen atom or a methyl group, m1 represents an integer of 2 to 200, and m2 represents an integer of 2 to 20.

2. The planographic printing plate precursor according to claim 1,
wherein the polymerization initiator includes an electron-accepting polymerization initiator.

3. The planographic printing plate precursor according to claim 2,
wherein a difference between the lowest unoccupied molecular orbital (LUMO) of the electron-accepting polymerization initiator and LUMO of the infrared absorbing agent is 0.70 eV or less.

4. The planographic printing plate precursor according to claim 1,
wherein the image recording layer further contains a polymerizable compound.

5. The planographic printing plate precursor according to claim 1,
wherein the image recording layer further contains an acid color former.

6. The planographic printing plate precursor according to claim 1,
wherein the functional group B is a group that forms a covalent bond with the functional group A.

7. The planographic printing plate precursor according to claim 1, wherein the functional group B is a group that forms an ionic bond with the functional group A.

8. The planographic printing plate precursor according to claim 1, wherein the functional group B is a group that forms a hydrogen bond with the functional group A.

9. The planographic printing plate precursor according to claim 1, wherein the functional group B is a group that is dipole-interactable with the functional group A.

10. The planographic printing plate precursor according to claim 1, wherein the resin A contains a resin having a crosslinked structure.

11. The planographic printing plate precursor according to claim 1, wherein the resin B further contains a polymerizable group.

12. The planographic printing plate precursor according to claim 11, wherein the polymerizable group is a (meth)acryloxy group.

13. The planographic printing plate precursor according to claim 11, wherein an ethylenically unsaturated group value of the resin B contained in the core-shell particle is in a range of 0.05 mmol/g to 5 mmol/g.

14. A method of preparing a planographic printing plate, comprising:

imagewise-exposing the planographic printing plate precursor according to claim 1; and supplying at least one selected from the group consisting of printing ink and dampening water to remove an image recording layer of a non-image area on a printing press.

15. A planographic printing method comprising:

imagewise-exposing the planographic printing plate precursor according to claim 1;

supplying at least one selected from the group consisting of printing ink and dampening water to remove an image recording layer of a non-image area on a printing press and preparing a planographic printing plate; and performing printing using the obtained planographic printing plate.

16. The planographic printing plate precursor according to claim 1, wherein the functional group A is at least one group selected from the group consisting of a carboxy group, a cyano group, and an amino group.

* * * * *